US008485381B2

(12) United States Patent
Raghunathan et al.

(10) Patent No.: US 8,485,381 B2
(45) Date of Patent: Jul. 16, 2013

(54) REFUSE CONTAINER

(75) Inventors: Narayan Raghunathan, Mississauga (CA); Basil Thompson Martheenal, Brampton (CA)

(73) Assignee: Orbis Canada Limited, Toronto, Ontario (CA)

( * ) Notice: Subject to any disclaimer, the term of this patent is extended or adjusted under 35 U.S.C. 154(b) by 1210 days.

(21) Appl. No.: 12/217,536

(22) Filed: Jul. 7, 2008

(65) Prior Publication Data

US 2009/0223965 A1 Sep. 10, 2009

(30) Foreign Application Priority Data

Mar. 7, 2008 (CA) ..... 2624658
Mar. 7, 2008 (CA) ..... 2624663
Jun. 27, 2008 (CA) ..... 2636306

(51) Int. Cl.
*B65D 45/16* (2006.01)
*B65D 45/00* (2006.01)
*B65D 43/14* (2006.01)

(52) U.S. Cl.
USPC ..... 220/324; 220/318; 220/833

(58) Field of Classification Search
USPC ..... 292/DIG. 11, 200, 194; 220/908, 220/843, 840, 833–835, 831, 4.22, 326, 324, 220/322, 318, 283, 263, 244, 212.5
See application file for complete search history.

(56) References Cited

U.S. PATENT DOCUMENTS

| | | | | |
|---|---|---|---|---|
| 3,825,150 | A | 7/1974 | Taylor | |
| 4,182,530 | A * | 1/1980 | Hodge | 294/68.26 |
| 4,349,121 | A | 9/1982 | Lafferty | |
| 4,753,367 | A | 6/1988 | Miller et al. | |
| 5,160,063 | A | 11/1992 | Bailey | |
| 5,184,836 | A | 2/1993 | Andrews, Jr. | |
| D347,095 | S | 5/1994 | Apps et al. | |
| 5,377,858 | A | 1/1995 | Morris, Sr. | |
| D355,741 | S | 2/1995 | Craft et al. | |
| 5,445,397 | A | 8/1995 | Evans | |
| 5,555,996 | A | 9/1996 | Lang-Ree et al. | |
| D388,577 | S | 12/1997 | Rehrig et al. | |
| D398,120 | S | 9/1998 | Rehrig et al. | |
| 5,881,901 | A | 3/1999 | Hampton | |
| 5,899,468 | A * | 5/1999 | Apps et al. | 280/47.26 |
| 5,947,295 | A * | 9/1999 | Lutin | 206/554 |
| D445,228 | S | 7/2001 | Apps et al. | |
| D465,348 | S | 11/2002 | Lucatello | |
| D491,328 | S | 6/2004 | Aiken et al. | |
| 6,918,508 | B2 | 7/2005 | Hwang | |

(Continued)

FOREIGN PATENT DOCUMENTS

| | | |
|---|---|---|
| CA | ID125054 | 4/2009 |
| CA | ID126678 | 4/2009 |
| GB | 2453055 | 3/2009 |

*Primary Examiner* — J. Gregory Pickett
*Assistant Examiner* — Kaushikkumar Desai
(74) *Attorney, Agent, or Firm* — Ungaretti & Harris LLP

(57) ABSTRACT

A refuse container has a lid rotatably coupled to a bin. A locking mechanism for the lid includes a latch including a handle and is moveable between a locked lid position and an unlocked lid position. A detent acts between the bin and the lid and cooperates with the latch so as to effect locking of the lid to the bin when the latch is in the locked lid position, and permit movement of the lid, relative to the bin, from the closed position to the open position when the latch is in the unlocked lid position.

4 Claims, 75 Drawing Sheets

U.S. PATENT DOCUMENTS

| | | | | |
|---|---|---|---|---|
| D515,313 | S | 2/2006 | Uffner et al. | |
| 7,017,773 | B2 | 3/2006 | Gruber et al. | |
| 7,048,346 | B2 | 5/2006 | Saravis | |
| 7,114,631 | B2 | 10/2006 | Aiken et al. | |
| 7,121,564 | B2 * | 10/2006 | Hassell | 280/47.26 |
| D532,173 | S | 11/2006 | Aiken et al. | |
| D535,448 | S | 1/2007 | Kilduff et al. | |
| 7,287,665 | B2 | 10/2007 | Meissen et al. | |
| D600,943 | S | 9/2009 | Austin et al. | |
| D600,944 | S | 9/2009 | McConnell et al. | |
| D624,723 | S | 9/2010 | Raghunathan et al. | |
| D654,723 | S | 2/2012 | Gormezano | |
| D656,730 | S | 4/2012 | Son | |
| 2004/0074913 | A1 * | 4/2004 | McDade et al. | 220/908.1 |
| 2005/0029763 | A1 * | 2/2005 | Hassell | 280/47.26 |
| 2006/0065657 | A1 | 3/2006 | Wong | |
| 2006/0076260 | A1 | 4/2006 | Luburic | |
| 2006/0236612 | A1 | 10/2006 | Sheng et al. | |

* cited by examiner

REFUSE CONTAINER

FIELD OF THE INVENTION

The present invention relates to containers for storing refuse, and particularly to containers configured for facilitating easier filling and emptying.

BACKGROUND OF THE INVENTION

In modern, urban communities, refuse containers are used to store accumulated household refuse until such household refuse can be collected by garbage trucks or the like. Typically, such refuse containers includes a lid for concealing the household refuse collected therein, as well as to prevent wild animals from accessing this household refuse. With some containers, the lid is integrally mounted to a storage bin which contains the collected household refuse. Such containers, however, are awkward to use. For example, available latching mechanisms continue to be prone to opening by wild animals.

SUMMARY OF THE INVENTION

In one aspect, there is provided a refuse container comprising a container assembly including a bin defining a cavity, a lid rotatably coupled to the bin, and configured for movement, relative to the bin, between an open position providing access to the cavity, and a closed position inhibiting access to the cavity; and a locking mechanism including a latch including a handle, and moveable between a locked lid position and an unlocked lid position, a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position, wherein the latch is configured to move from the locked lid position to the unlocked lid position in response to application of an unlocking force to the handle, and wherein, when the latch is disposed in the unlocked lid position and the lid is disposed in the closed position, the lid is configured to move from the closed position to the open position in response to an application of a lid-opening force to the handle; and wherein the unlocking force includes a horizontal component and a vertical component, and wherein the lid-opening force includes a horizontal component and a vertical component, and wherein the direction of the horizontal component of the lid-opening force is disposed at an angle of between about 90 degrees and about 270 degrees in a clockwise direction about a vertical axis and relative to the direction of the horizontal component of the unlocking force.

In another aspect, there is provided a refuse container comprising a container assembly including a bin defining a cavity, a lid rotatably coupled to the bin, and configured for movement, relative to the bin, between an open position providing access to the cavity and a closed position inhibiting access to the cavity; and a locking mechanism including a latch including a handle, and moveable between a locked lid position and an unlocked lid position, a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position, wherein the latch is configured to move from the locked lid position to the unlocked lid position in response to application of an unlocking force to the handle, and wherein, when the latch is disposed in the unlocked lid position and the lid is disposed in the closed position, the lid is configured to move from the closed position to the open position in response to an application of a lid-opening force to the handle; and wherein the unlocking force includes a horizontal component and a vertical component, and wherein the lid-opening force includes a horizontal component and a vertical component, and wherein the direction of the horizontal component of the lid-opening force is substantially opposite to the direction of the horizontal component of the unlocking force.

In another aspect, there is provided a refuse container comprising a container assembly including a bin defining a cavity; a lid rotatably coupled to the bin, and configured for movement, relative to the bin, between an open position providing access to the cavity and a closed position inhibiting access to the cavity and a locking mechanism including a latch including a handle, and moveable between a locked lid position and an unlocked lid position a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position, wherein the latch is configured to move from the locked lid position to the unlocked lid position in response to application of an unlocking force to the handle; and wherein, when the latch is disposed in the unlocked lid position and the lid is disposed in the closed position, the lid is configured to move from the closed position to the open position in response to an application of a lid-opening force to the handle, and wherein the unlocking force effects rotation of the latch in one of a clockwise or counter clockwise direction, and wherein the lid-opening force effects rotation of the latch in the other one of a clockwise or a counter clockwise direction relative to the same frame of reference as the direction of the unlocking force.

In another aspect, there is provided a refuse container comprising a container assembly including a bin defining a cavity; a lid rotatably coupled to the bin, and configured for movement, relative to the bin, between an open position providing access to the cavity and a closed position inhibiting access to the cavity, and a locking mechanism including a latch including a handle, and moveable between a locked lid position and an unlocked lid position, a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position, wherein the latch is configured to move from the locked lid position to the unlocked lid position in response to application of an unlocking force to the handle, and wherein, when the latch is disposed in the unlocked lid position and the lid is disposed in the closed position, the lid is configured to move from the closed position to the open position in response to an application of a lid-opening force to the handle, and wherein, in moving from the locked lid position to the unlocked lid position, the latch rotates, relative to the container assembly, about a latch rotation axis, wherein the latch rotation axis and a longitudinal axis of the detent are substantially co-located.

In another aspect, there is provided a refuse container comprising a container assembly including a bin defining a cavity, a lid rotatably coupled to the bin, and configured for movement, relative to the bin, between an open position providing access to the cavity and a closed position inhibiting access to the cavity, and a locking mechanism including a latch including a handle, and moveable between a locked lid position and an unlocked lid position, a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position, wherein the latch is configured to move from the locked lid position to the unlocked lid position in response to application of an unlocking force to the handle, and wherein, when the latch is disposed in the unlocked lid position and the lid is disposed in the closed position, the lid is configured to move from the closed position to the open position in response to an application of a lid-opening force to the handle, and wherein, when the latch is disposed in the locked lid position, the latch is disposed in a cavity provided in the container assembly.

In another aspect, there is provided a refuse container comprising a container, assembly including a bin defining a cavity; a lid rotatably coupled to the bin, and configured for movement, relative to the bin, between an open position providing access to the cavity, and a closed position inhibiting access to the cavity, and a locking mechanism including a latch including a handle, and moveable between a locked lid position and an unlocked lid position, a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position; wherein the latch is configured to move from the locked lid position to the unlocked lid position in response to application of an unlocking force to the handle, and wherein, when the latch is disposed in the unlocked lid position and the lid is disposed in the closed position, the lid is configured to move from the closed position to the open position in response to an application of a lid-opening force to the handle, and the latch is moveable to an unlocked indication position wherein the latch is locked to the container assembly such that the latch extends peripherally of the container assembly and thereby provides a visual indication that the latch is in the unlocked lid positions In another aspect, there is provided a refuse container comprising a container assembly including a bin defining a cavity, and including: a lip defining an opening to the cavity, and a rim extending peripherally about the lip, a lid rotatably coupled to the bin, and configured for movement, relative to the bin, between an open position providing access to the cavity, and a closed position inhibiting access to the cavity, and a locking mechanism including a latch including a handle, and moveable between a locked lid position and an unlocked lid position, a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position, wherein the latch is configured to move from the locked lid position to the unlocked lid position in response to application of an unlocking force to the handle, and wherein, when the latch is disposed in the unlocked lid position and the lid is disposed in the closed position, the lid is configured to move from the closed position to the open position in response to an application of a lid-opening force to the handle, and wherein the detent extends upwardly from the rim and is disposed below the lip.

In another aspect, there is provided a refuse container comprising a container assembly including a bin defining a cavity, and including a lip defining an opening to the cavity, and a rim extending peripherally about the lip, a lid rotatably coupled to the bin, and configured for movement, relative to the bin, between an open position providing access to the cavity, and a closed position inhibiting access to the cavity, and a locking mechanism including a latch including a handle and a detent co-operator, and moveable between a locked lid position and an unlocked lid position, a detent extending upwardly from the rim and acting between the bin and the lid, and co-operating with the latch so as to effect locking of the lid to the bin when the latch is in the locked lid position, and permit movement of the lid, relative to the bin, from the closed position to the open position when the latch is in the unlocked lid position, wherein the latch is configured to move from the locked lid position to the unlocked lid position in response to application of an unlocking force to the handle, and wherein, when the latch is disposed in the unlocked lid position and the lid is disposed in the closed position, the lid is configured to move from the closed position to the open position in response to an application of a lid-opening force to the handle, and wherein, when the latch is disposed in the locked lid position, the detent co-operator is disposed relative to the detent such that the detent interferes with movement of the detent co-operator along a vertical axis and thereby resists movement of the lid from the closed position to the open position, and a potential fouling space is defined between the detent co-operator and the detent, and wherein the container assembly includes a fouling guard extending from the lid and disposed between the detent and the peripheral edge of the container assembly and configured for reducing ingress of materials into the potential fouling space.

In another aspect, there is provided a refuse container comprising: a container assembly including a bin defining a cavity; a lid rotatably coupled to the bin, and configured for movement, relative to the bin, between an open position providing access to the cavity, and a closed position inhibiting access to the cavity, and a locking mechanism including a latch including a handle, and moveable between a locked lid position and an unlocked lid position, a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position, wherein the latch is configured to move from the locked lid position to the unlocked lid position in response to application of an unlocking force to the handle, and wherein, when the latch is disposed in the unlocked lid position and the lid is disposed in the closed position, the lid is configured to move from the closed position to the open position in response to an application of a lid-opening force to the handle, and wherein the container assembly includes an impact guard disposed below the locking mechanism for blocking physical contact with an external object when the latch is disposed in the locked lid position.

In another aspect, there is provided a refuse container comprising a bin defining a cavity, and including a lip defining an opening to the cavity, and a rim extending peripherally about the lip, and including a skirt seating surface and at least one impact pad seating surface, a lid rotatably coupled to the bin, and configured for movement, relative to the bin, between an open position providing access to the cavity, and a closed position inhibiting access to the cavity, and including a skirt, and at least one impact pad, wherein the skirt extends peripherally of and downwardly from the lid and includes a skirt contact surface configured to be seated upon the skirt seating surface, and wherein each one of the at least one impact pad extends downwardly from the lid and includes a respective contact surface configured to be seated upon a respective one of the at least one impact pad seating surface and thereby define at least one respective contact surface, wherein each one of the at least one respective contact surface corresponds to a respective one of the at least one impact pad; and wherein an operative impact surface is the sum of all of the at least one respective contact surface, and wherein the ratio of the surface area of the operative impact surface to the surface area of contact surface of the skirt is at least 0.1.

In another aspect, there is provided a refuse container comprising a bin defining a cavity, a lid rotatably coupled to the bin, and configured for movement, relative to the bin, between an open position providing access to the cavity, and a closed position inhibiting access to the cavity, and a lifting mechanism engagement system including a retention bar, wherein the retention bar is coupled to the bin and is disposed externally of the cavity.

In another aspect, a refuse container comprising a container assembly including a bin defining a cavity, a lid rotatably coupled to the bin, and configured for movement, relative to the bin, between an open position providing access to the cavity, and a closed position inhibiting access to the cavity, a lid locking mechanism including a latch including a handle, and moveable between a locked lid position and an unlocked lid position a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position, wherein the latch is configured to move from the locked lid position to the unlocked lid position in response to application of an unlocking force to the handle, and wherein, when the latch is disposed in the unlocked lid position and the lid is disposed in the closed position, the lid is configured to move from the closed position to the open position in response to an application of a lid-opening force to the handle, and a latch locking mechanism configured to move between a locked latch position and an unlocked latch position, wherein, in tile locked latch position, the latch locking mechanism acts between the latch and the lid to prevent the latch assuming an operative condition whereby the latch is capable of moving between the locked lid position and the unlocked lid position, and wherein, in the unlocked latch position, the latch is disposed in the operative condition.

BRIEF DESCRIPTION OF DRAWINGS

The invention will be better understood when consideration is given to the following detailed description thereof Such description makes reference the annexed drawings wherein.

DETAILED DESCRIPTION OF PREFERRED EMBODIMENTS

Figure 1:
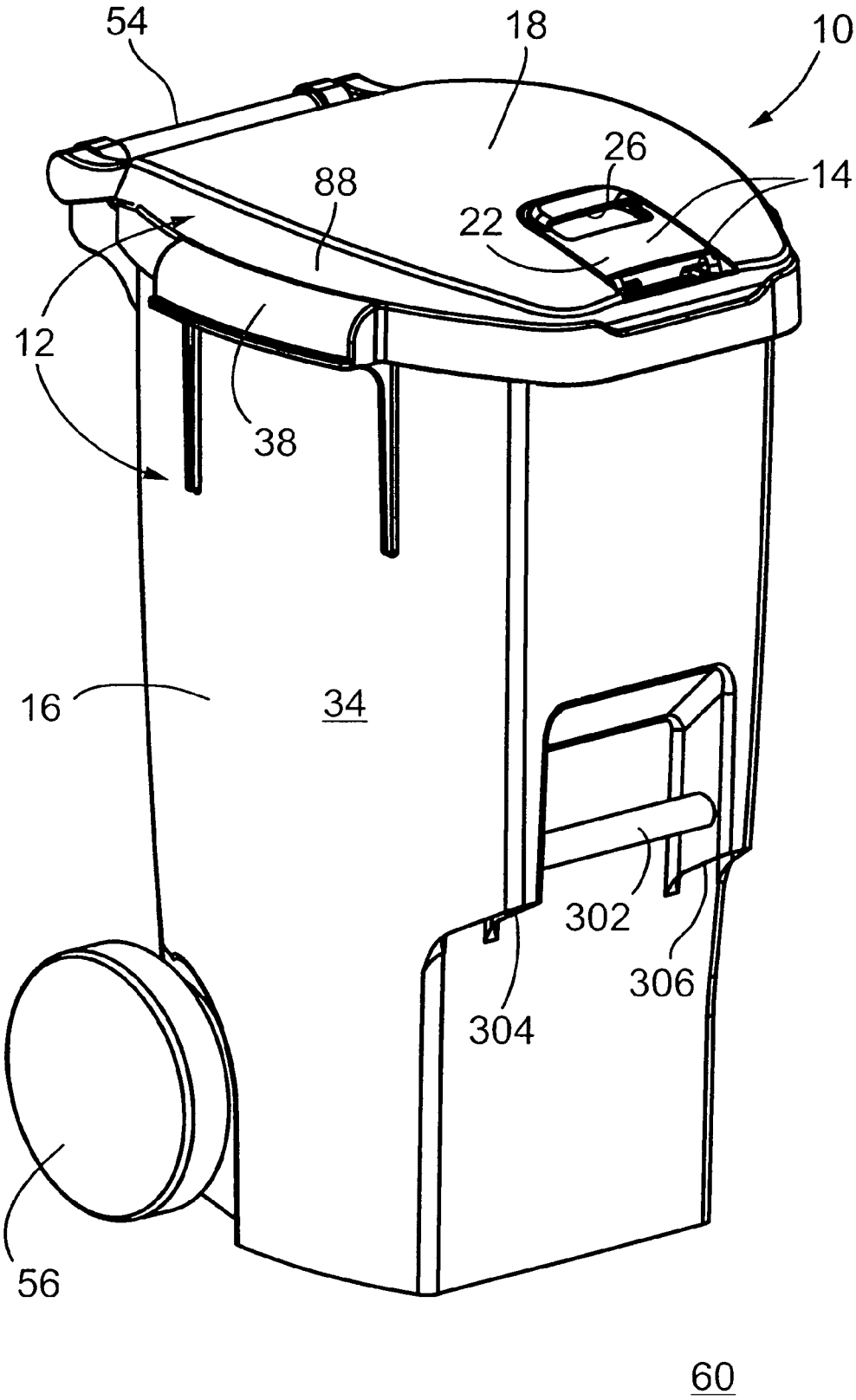
FIG. 1 is a front perspective view of a first embodiment of a refuse container.
Figure 2:
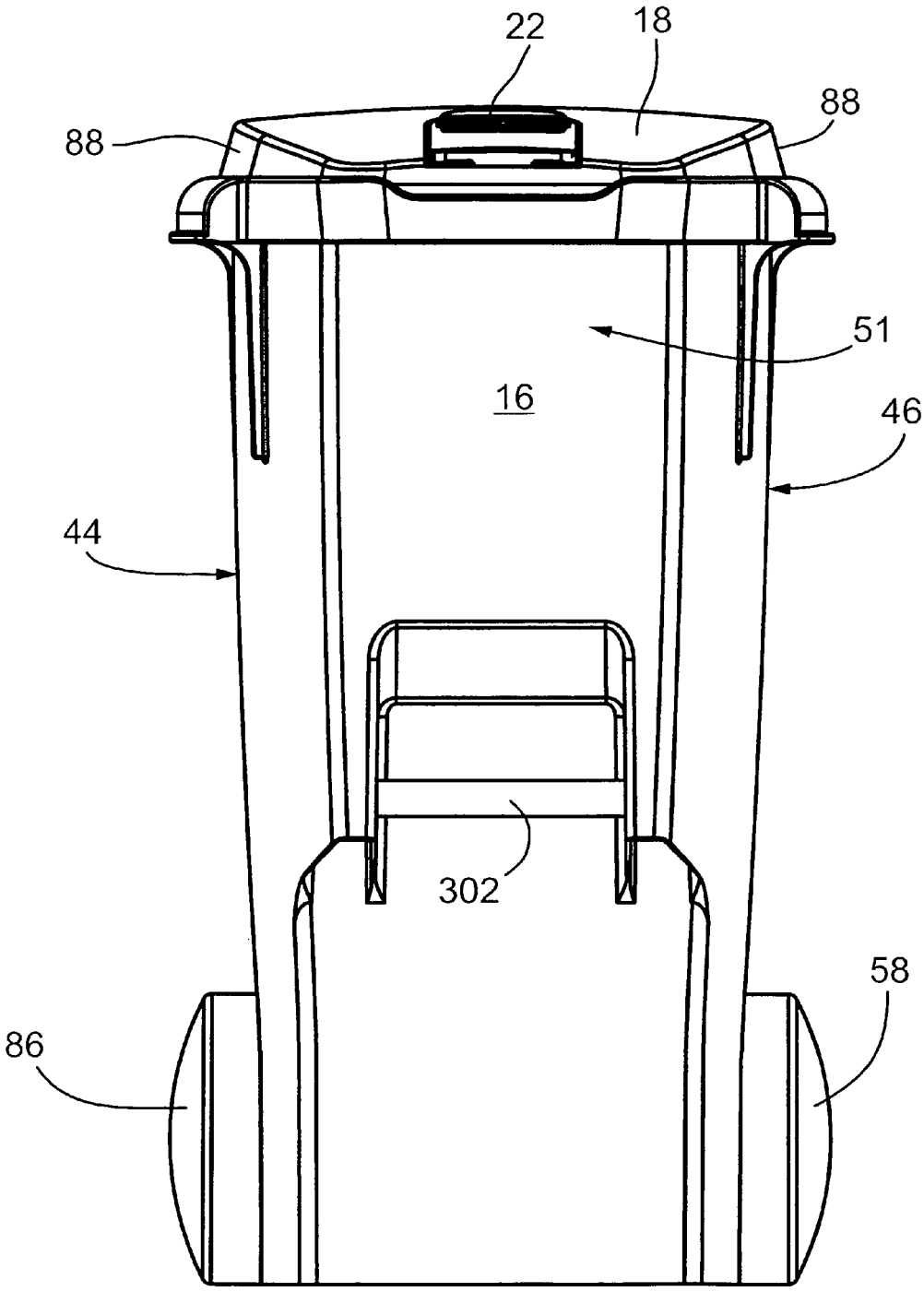
FIG. 2 is a front elevation view of the refuse container in FIG. 1.
Figure 3:
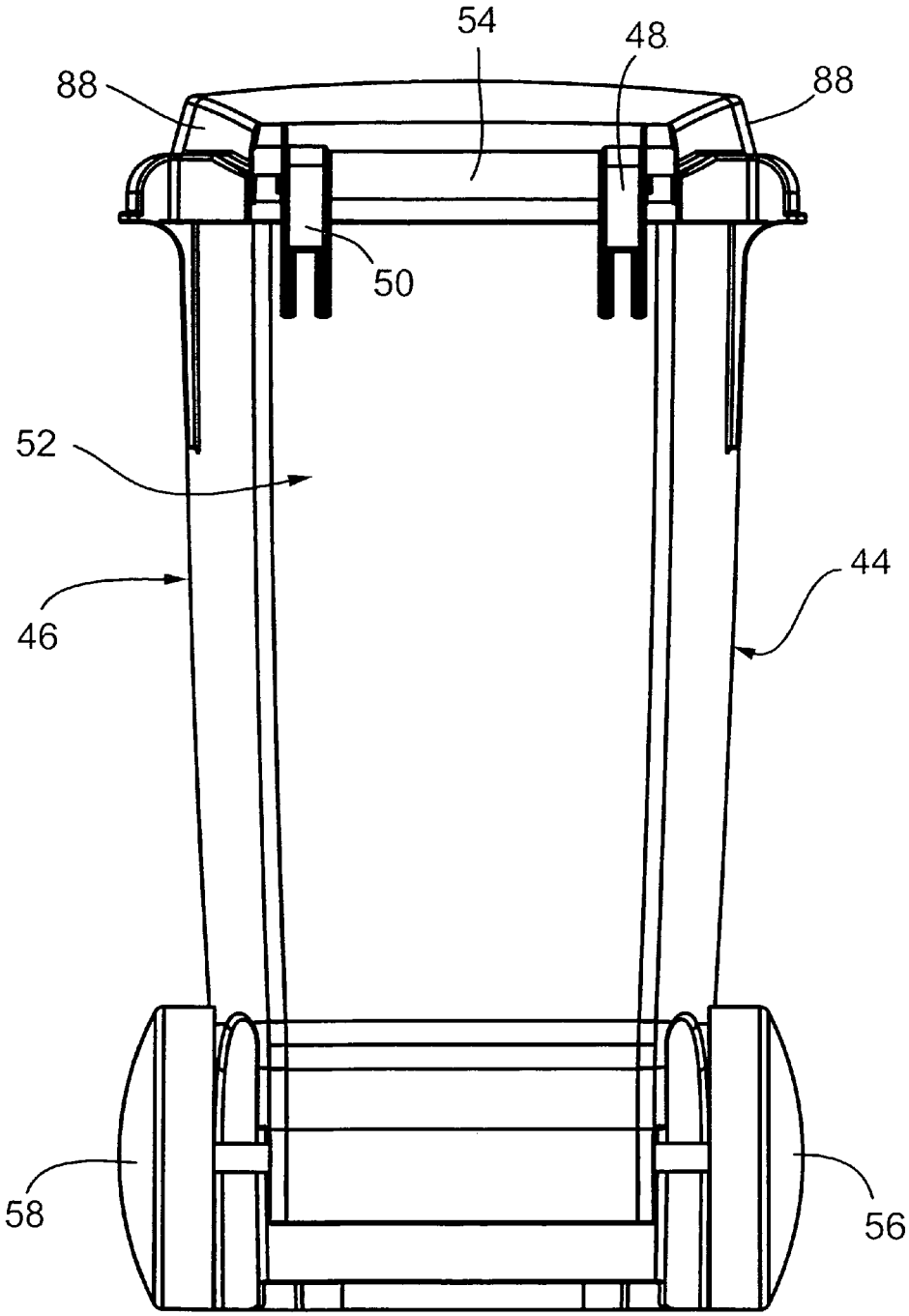
FIG. 3 is a rear elevation view of the refuse container in FIG. 1.
Figure 4:
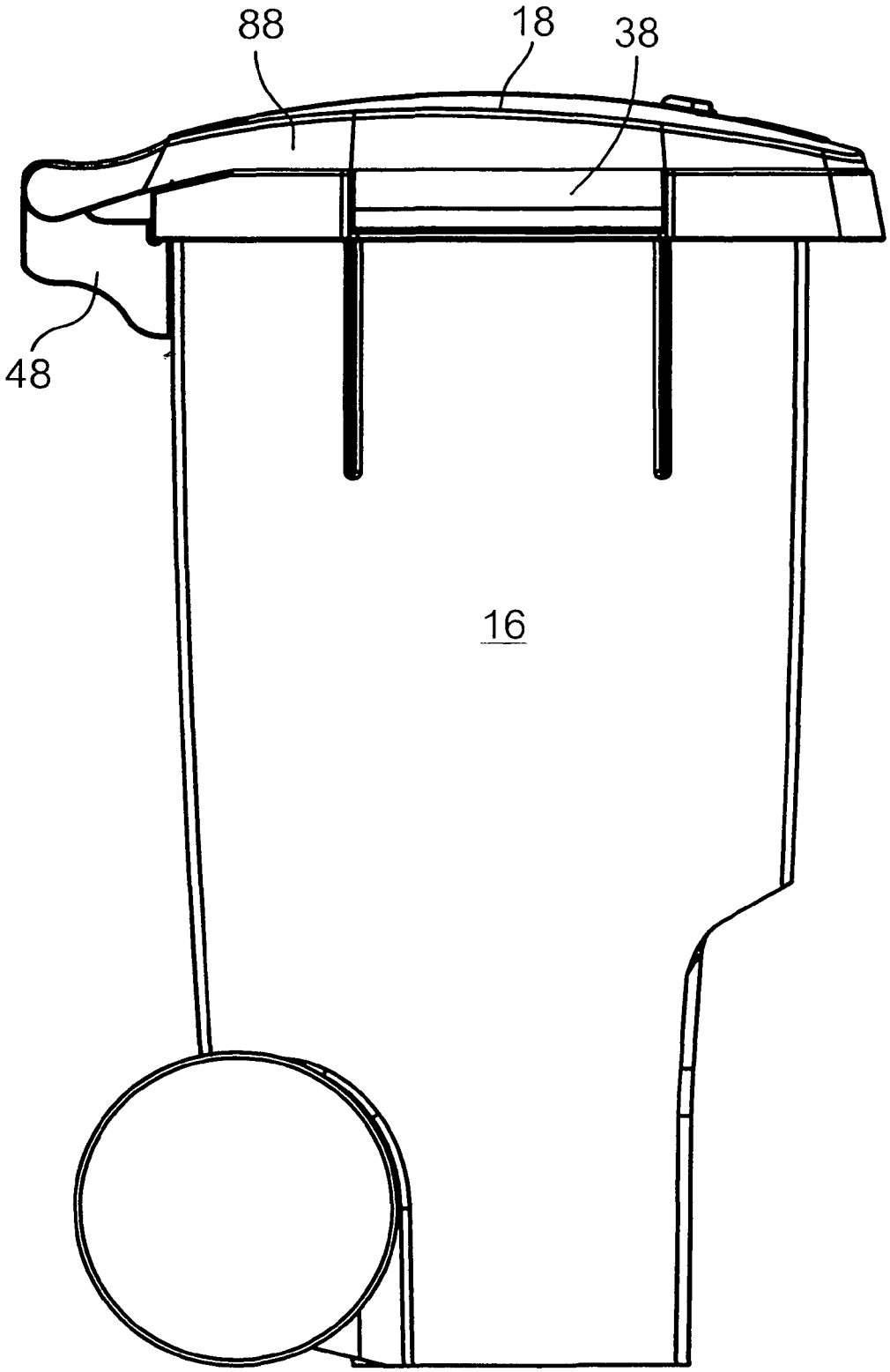
FIG. 4 is a side elevation view of one side of the refuse container in FIG. 1.
Figure 5:
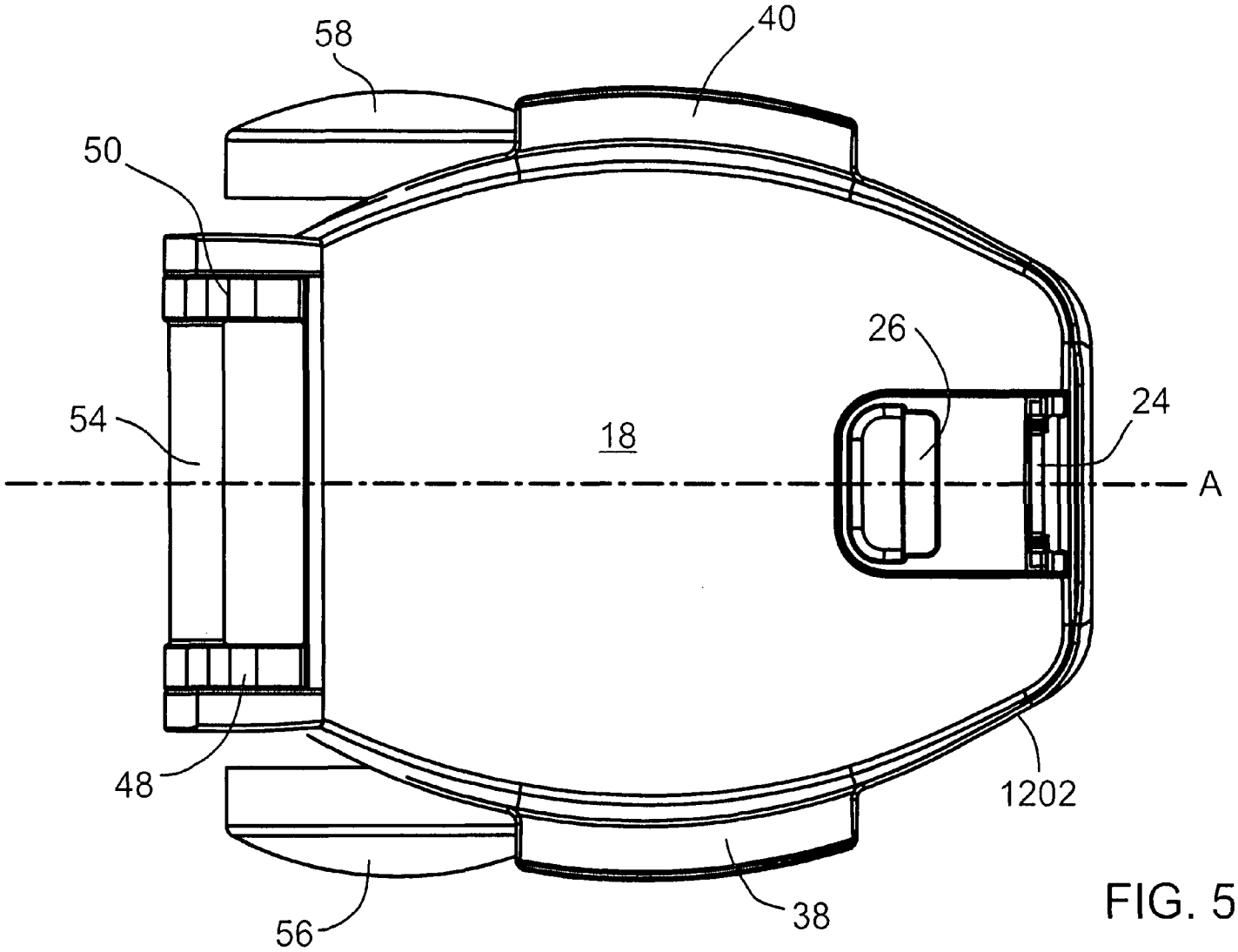
FIG. 5 is a top plan view of the refuse container in FIG. 1.
Figure 6:
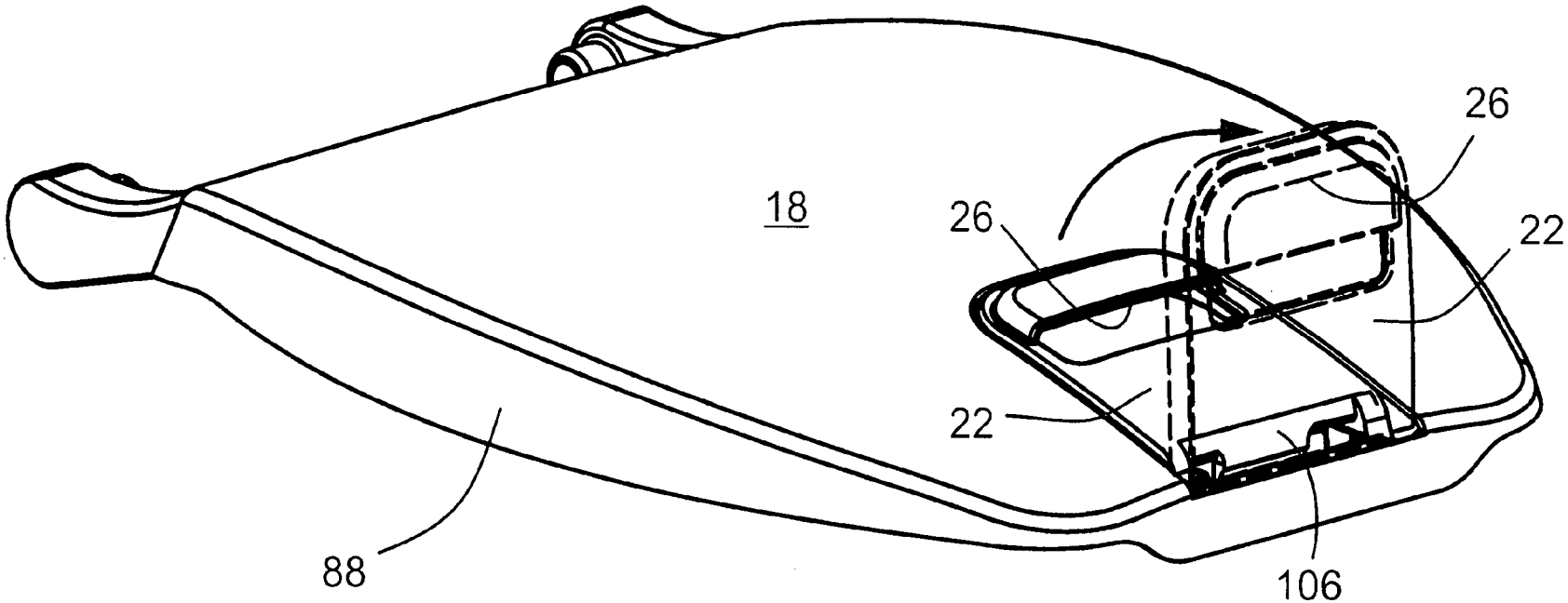
FIG. 6 is a top perspective view of the lid and the latch of the container in FIG. 1, illustrating the latch in the locked lid position and in the unlocked indication position.
Figure 32:
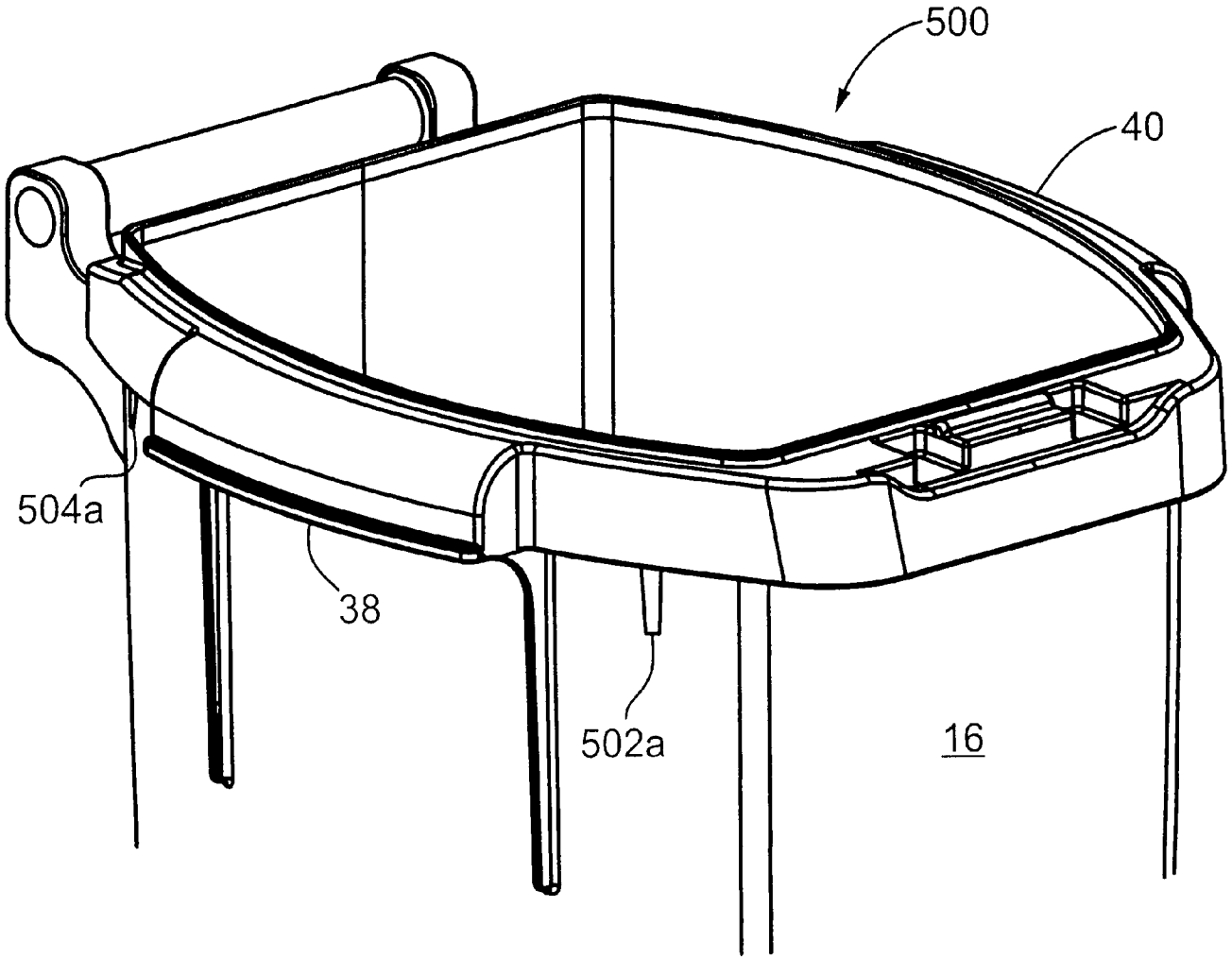
FIG. 32 is a top perspective view of one side of a second embodiment of a refuse container, taken from the front.
Figure 33:
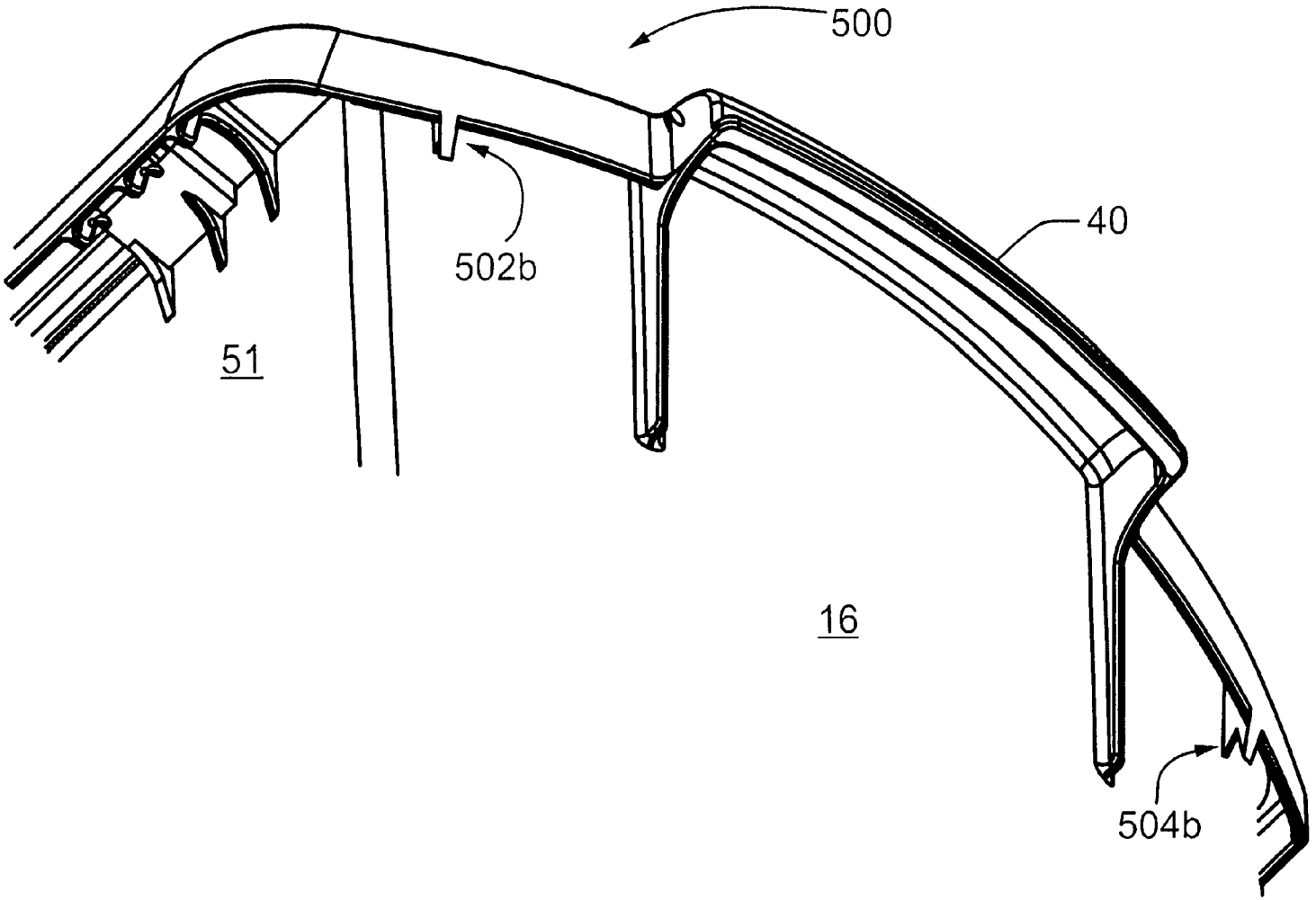
FIG. 33 is a bottom perspective view of the other side of the refuse container of FIG. 32, taken from the front.
Figure 34:
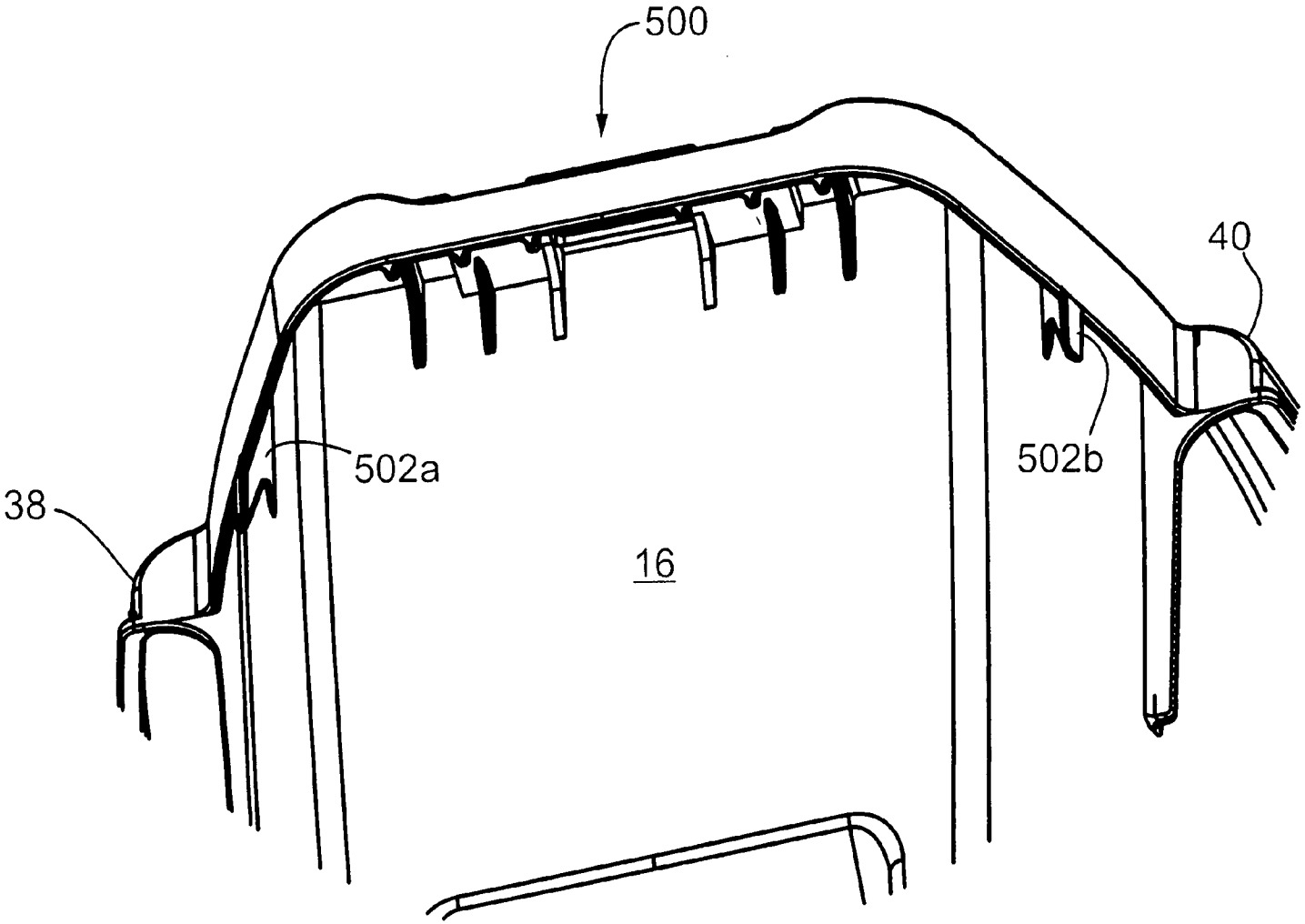
FIG. 34 is a bottom perspective view of the refuse container of FIG. 32, taken from the front and from a perspective where the leading edges of each one of the sides of the container is visible.
Figure 35:
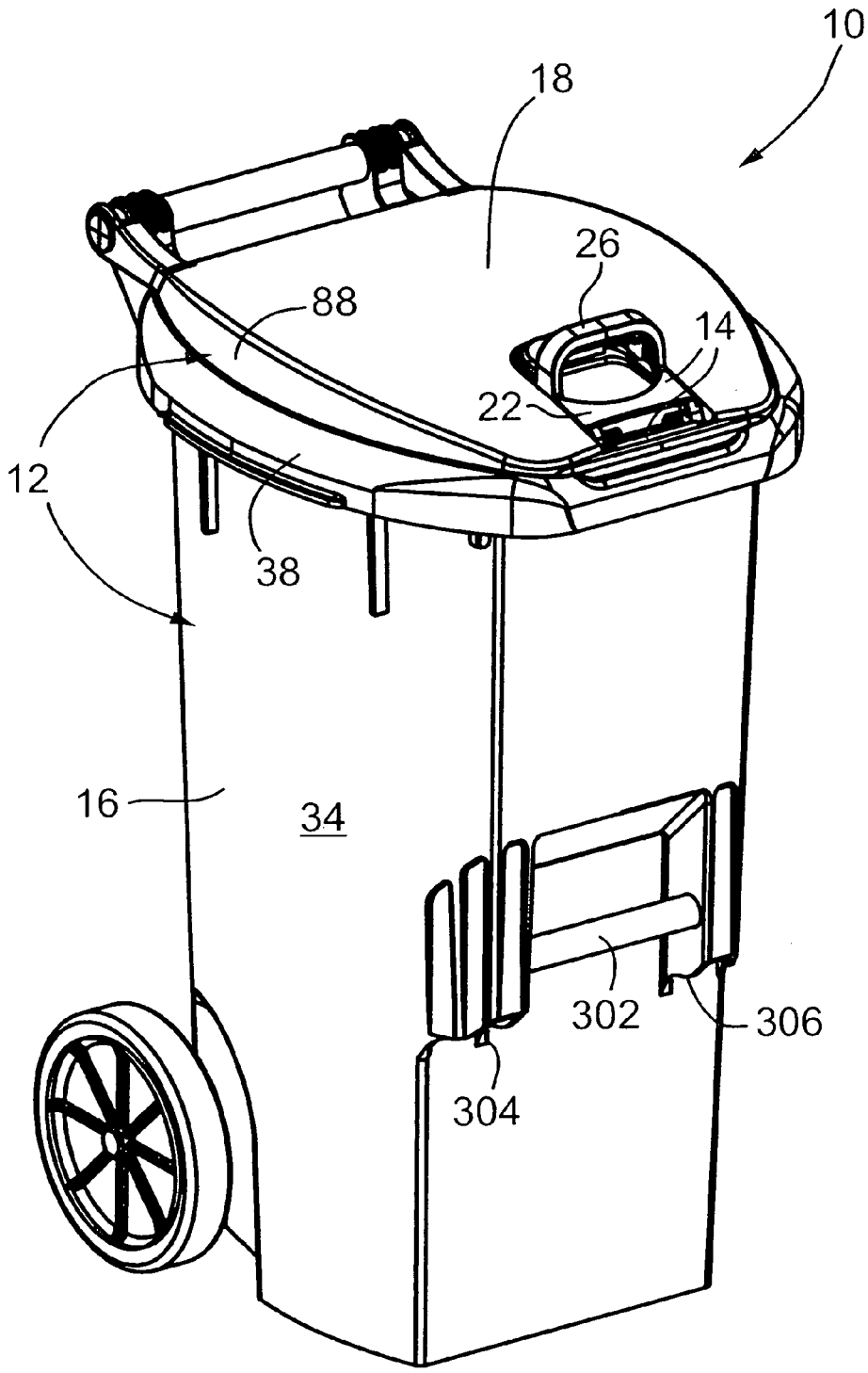
FIG. 35 is a front perspective view of a third embodiment of a refuse container.
Figure 36:
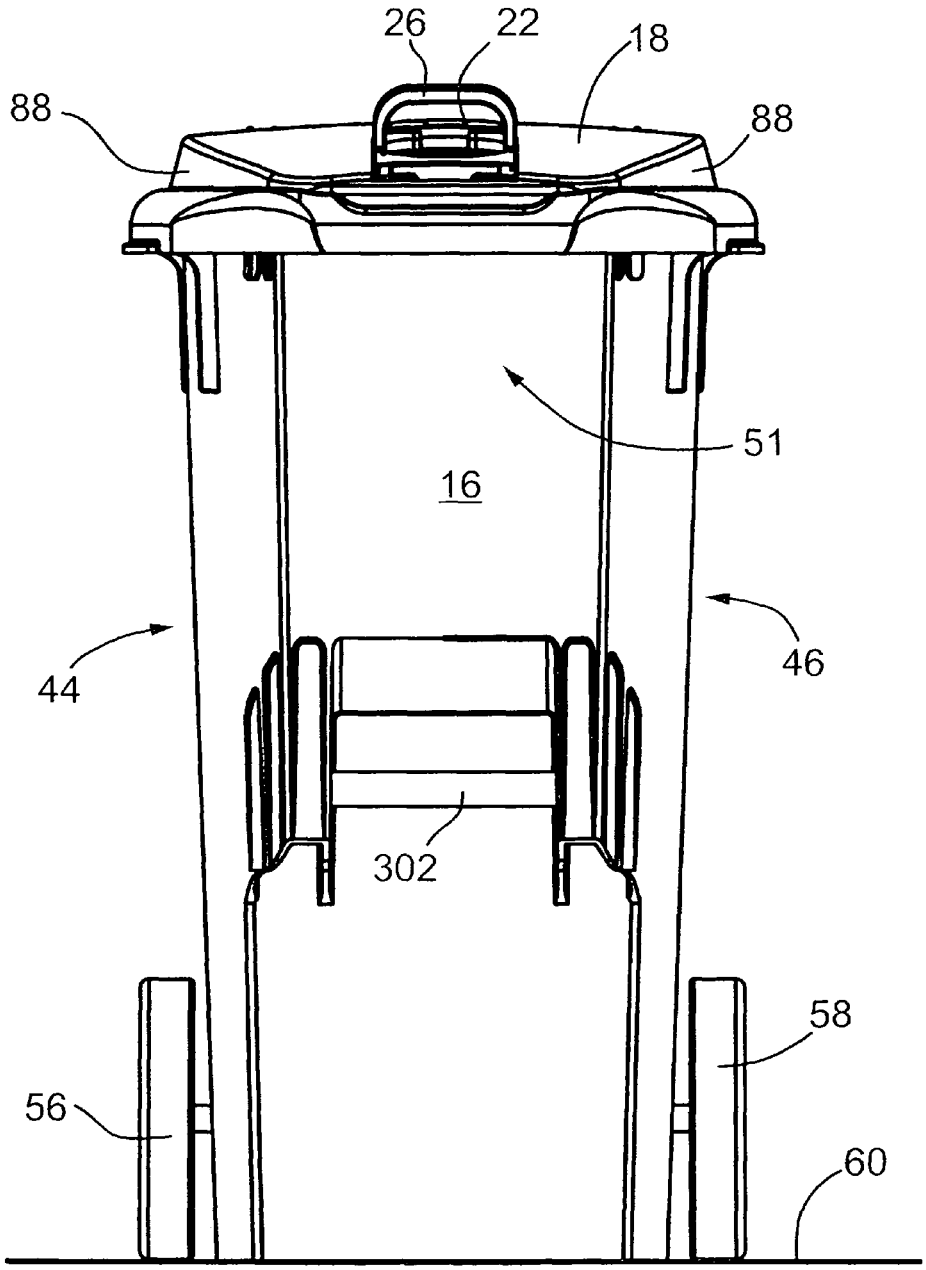
FIG. 36 is a front elevation view of the refuse container in FIG. 35.
Figure 37:
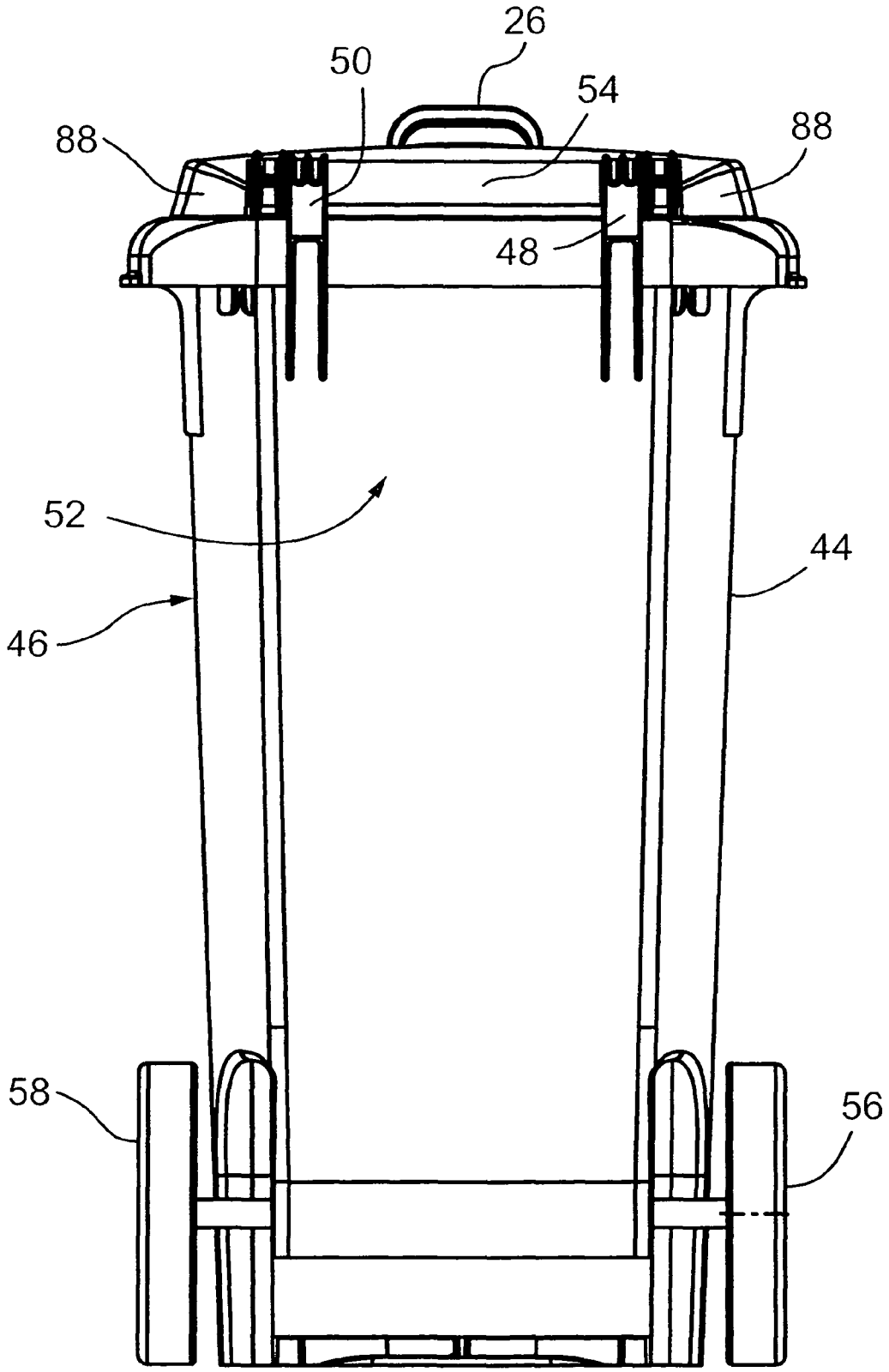
FIG. 37 is a rear elevation view of the refuse container in FIG. 35.
Figure 38:
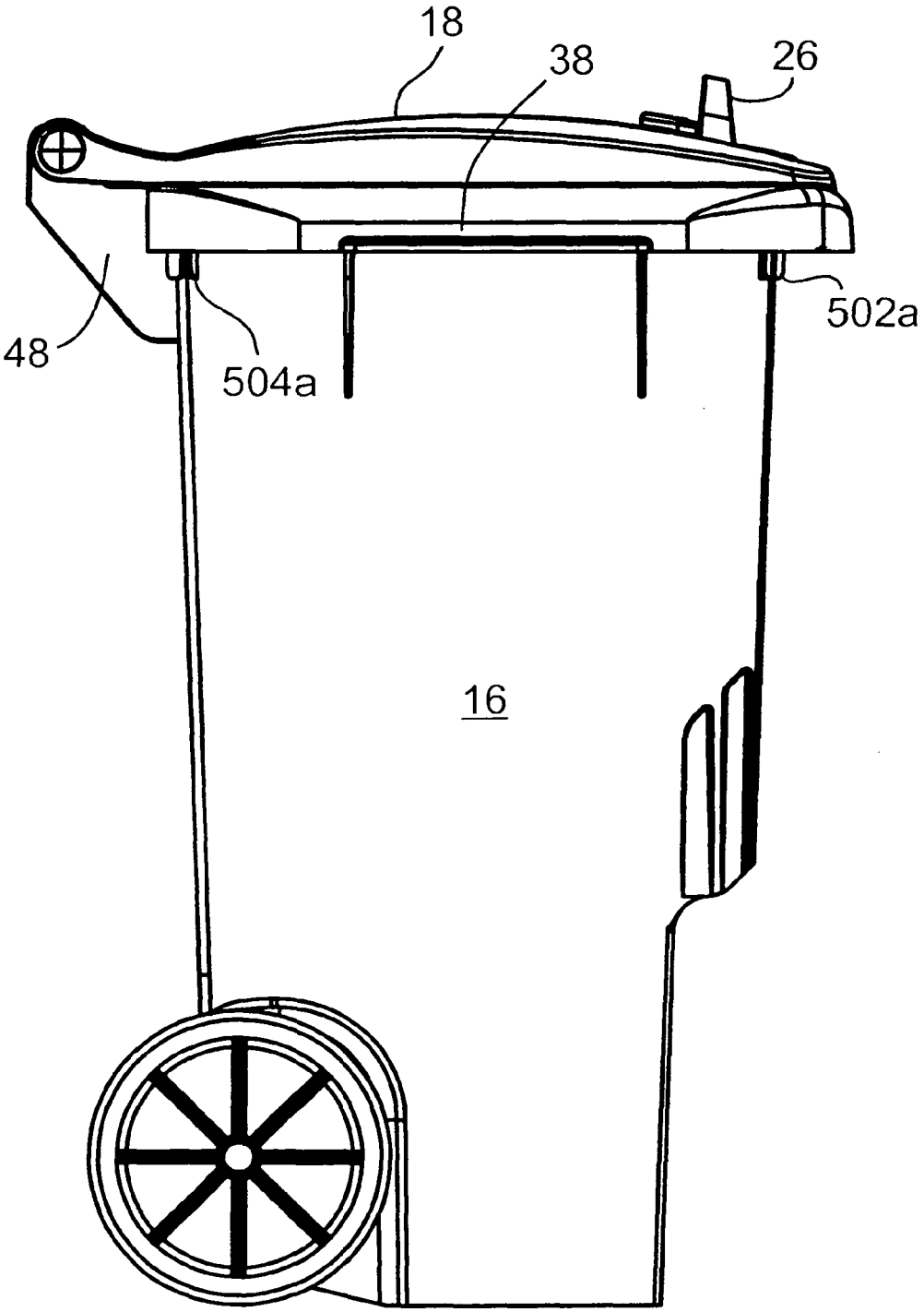
FIG. 38 is a side elevation view of one side of the refuse container in FIG. 35.
Figure 39:
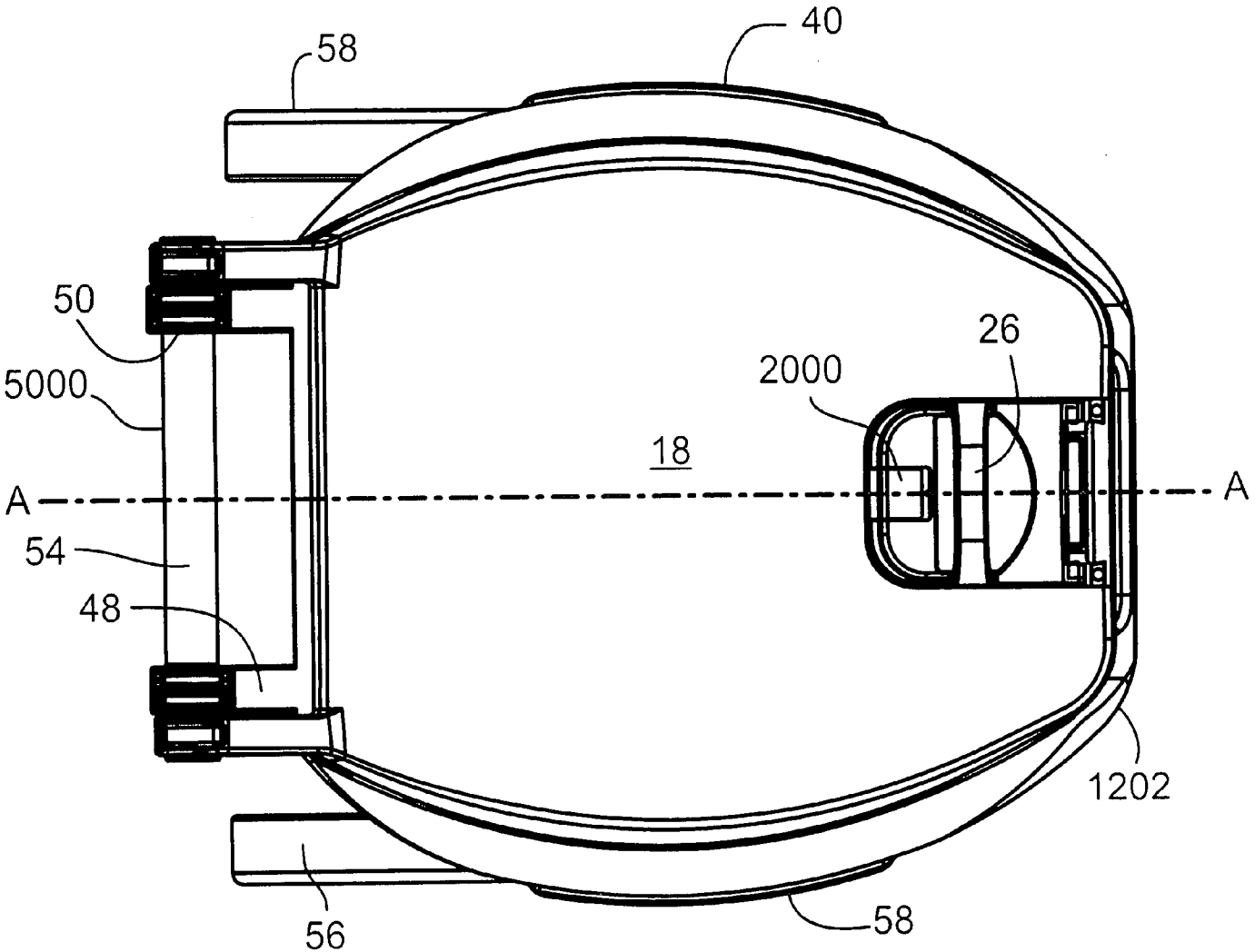
FIG. 39 is a top plan view of the refuse container in FIG. 35.
Figure 40:
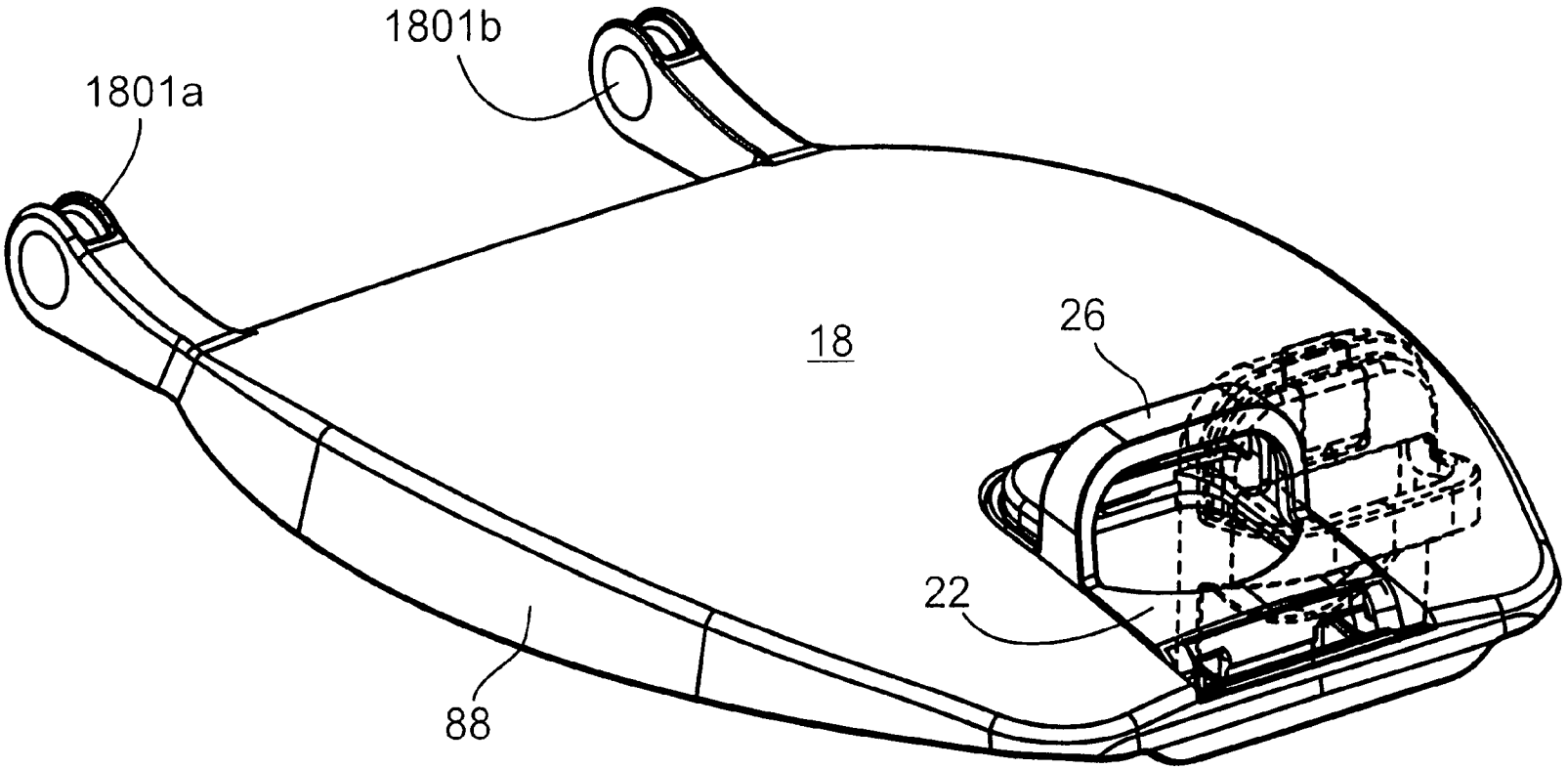
FIG. 40 is a top perspective view of the lid, and the latch, and the latch locking mechanism of the container in FIG. 35, illustrating the latch in the locked position and in the unlocked indication position.
Figure 41:
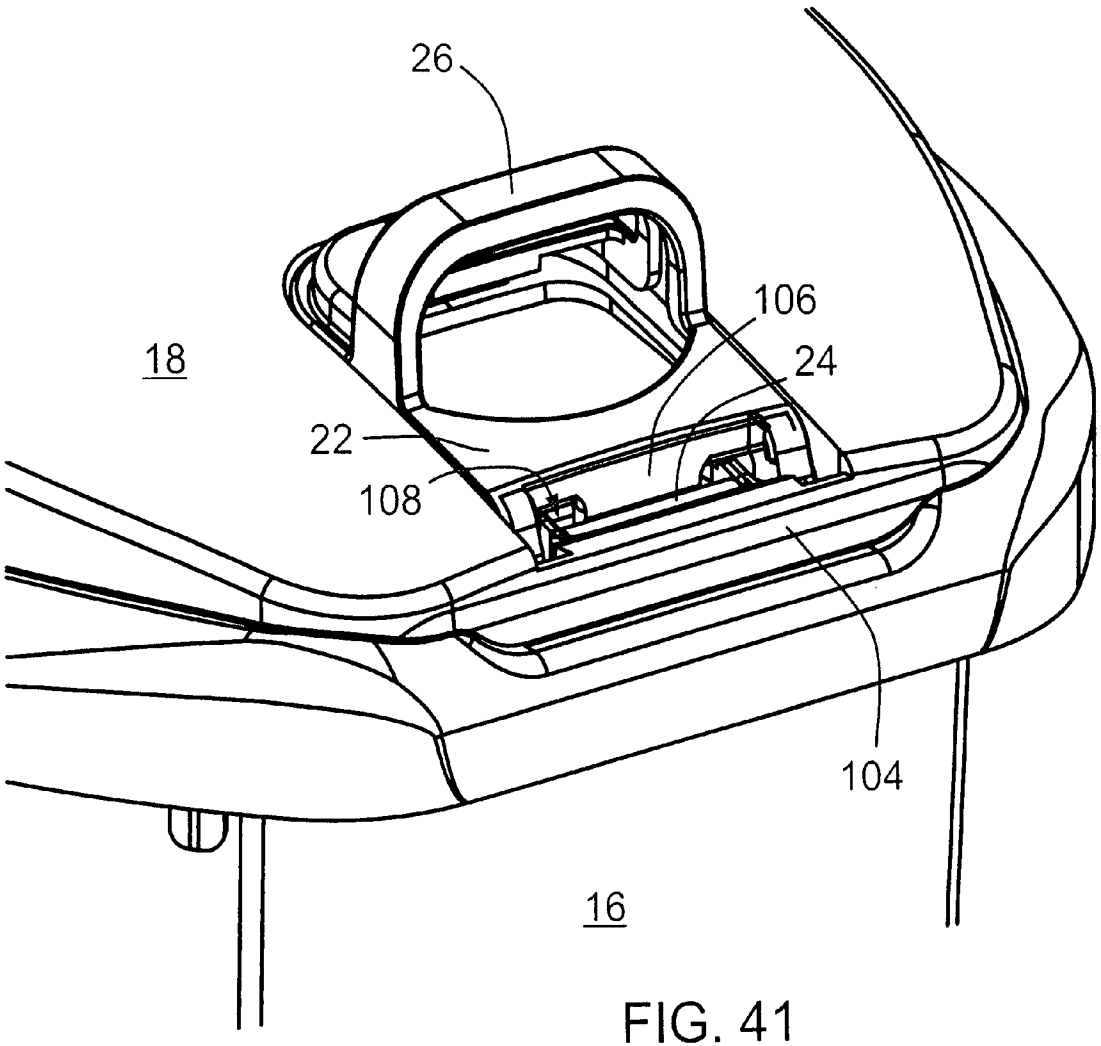
FIG. 41 is a top perspective view of a front detail of the container in FIG. 35, illustrating the latch in the locked position.
Figure 42:
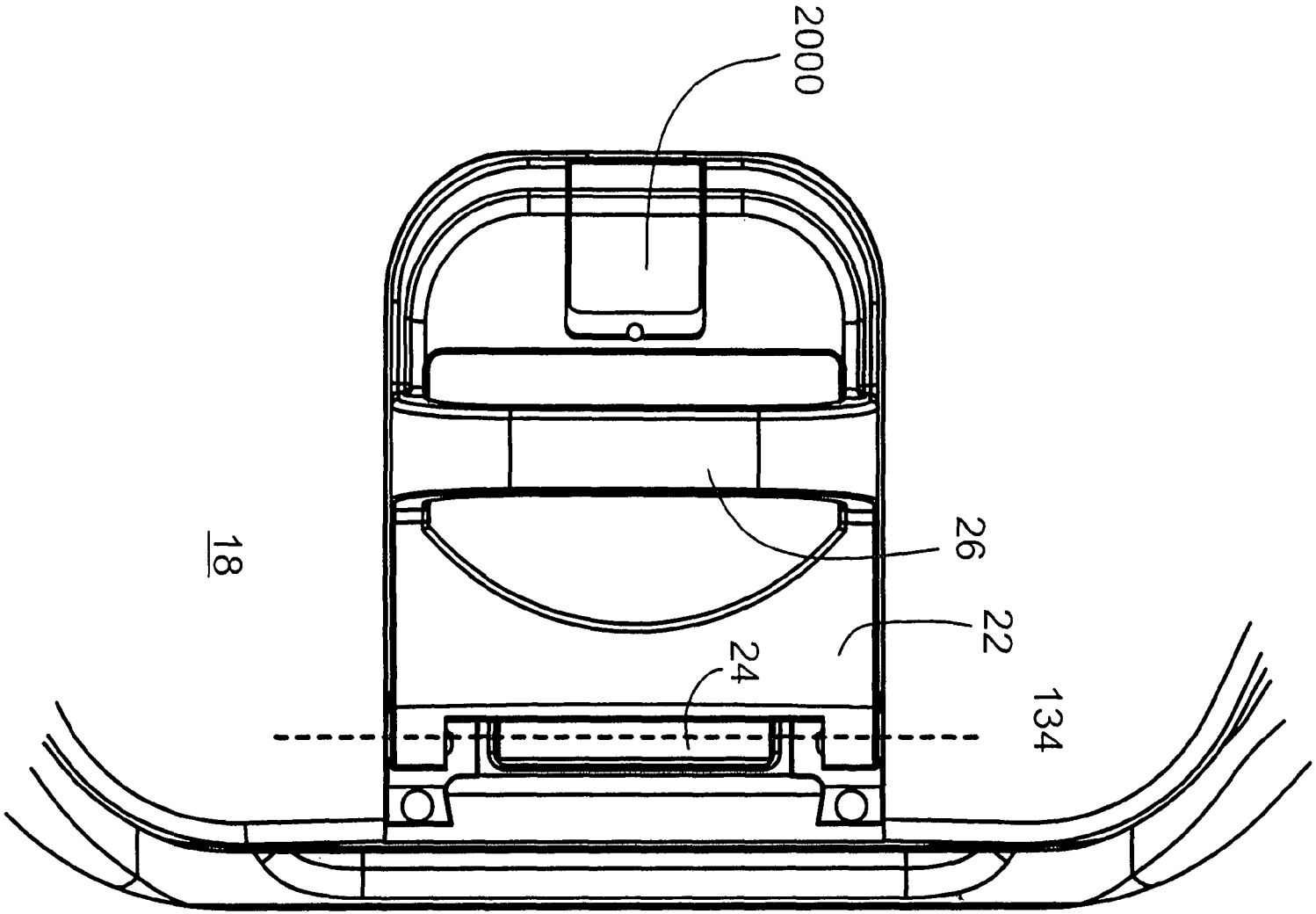
FIG. 42 is a top plan view of a front detail of the container in FIG. 35, illustrating the latch in the locked lid position.
Figure 43:
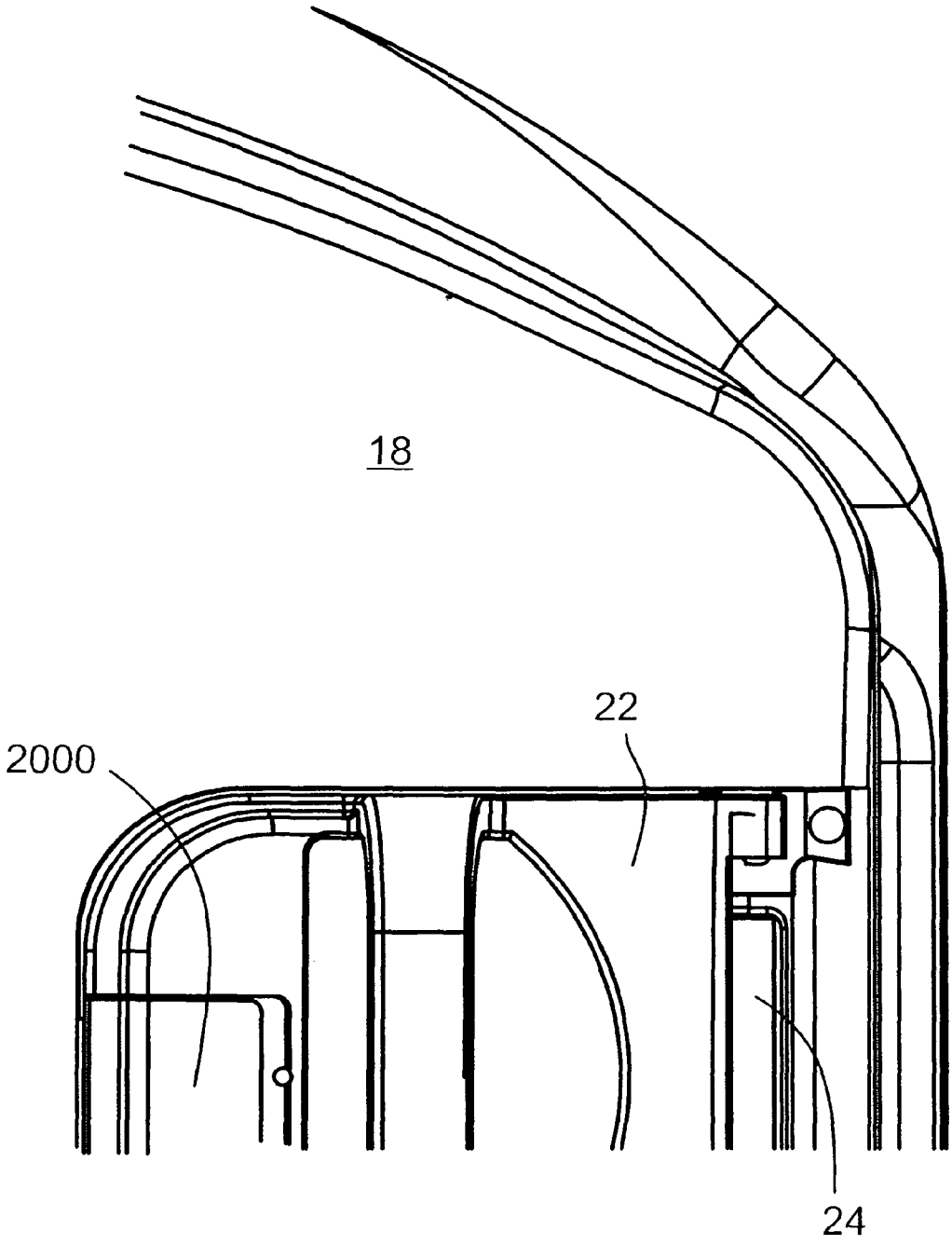
FIG. 43 is a further detail of the top plan view in FIG. 42.

There is provided a refuse container 10. A first embodiment is illustrated in FIGS. 1 to 31. A second embodiment is illustrated in FIGS. 32 to 34. A third embodiment is illustrated in FIGS. 35 to 68. Like elements are identified with like reference numerals. Descriptions of spatial disposition one element relative to another are provided in the context of a refuse container 10 disposed in a vertically upright and self-supporting position, and disposed on a substantially horizontal reaction surface 60, such as, for example, the container 10 illustrated in FIG. 2.

The refuse container 10 includes a container assembly 12 and a locking mechanism 14. For example, the container is manufactured by high pressure injection moulding.

The container assembly 12 includes a bin 16 and a lid 18. The lid 18 is coupled to the bin 16. For example, the material of the bin 16 and the lid 18 is high density polyethylene.

The bin 16 defines a cavity 20. The bin 16 includes a lip 74 which defines an opening 36 for effecting communication between the cavity 20 and the environment external to the bin 16 when the lid 18 is in an open position (see below). For example, the cavity 20 is configured for storing material including household organic waste.

For example, with respect to the bin 16, the bin 16 includes a floor 32 and a continuous upstanding sidewall 34 extending between the floor 32 and the lip 74. For example, with respect to the continuous sidewall 34, the continuous sidewall 34 includes interior and exterior surfaces 41, 42. A rim 28 extends peripherally about the perimeter of the lip 74. For example, the rim 28 includes a seating surface 30 configured to co-operate with the lid 18, as will be explained below. For example, the seating surface 30 extends peripherally about the perimeter of the lip 74.

For example, with respect to the interior surface 41 of the continuous sidewall, the interior surface is tapered so as to facilitate nesting of an identical container within the container, 10, and thereby facilitate stacking of multiple identical containers 10.

For example, with respect to the external surface 42 of the continuous sidewall 34, a pair of handles 38, 40 are mounted on opposite sides 44, 46 of the external surface 42 of the continuous sidewall 34. The handles 38, 40 are configured to be grasped by a human operator for effecting lifting of the container 10.

For example, with further respect to the external surface 42 of the continuous sidewall 34, a pair of brackets 48, 50 are mounted to a rear section 52 of the external surface 42 of the continuous sidewall 34. A handle 54 extends between the brackets 48, 50. The handle 54 is provided for grasping by a human operator for effecting lifting of the container. Alternatively, where the container 10 is provided with wheels 56, 58, the handle 54 facilitates grasping by a human operator for effecting rolling movement of the container 10 across a reaction surface 60.

For example, the lid 18 is rotatably coupled to the bin 16. For example, such rotational coupling can be accomplished by pivots incorporated in one of the lid 18 or the bin 16 and received within respective receptacles in the other one of the lid 18 or the bin 16, or through external pivots received within receptacles provided in each one of the lid 18 and the bin 16.

Figure 10:
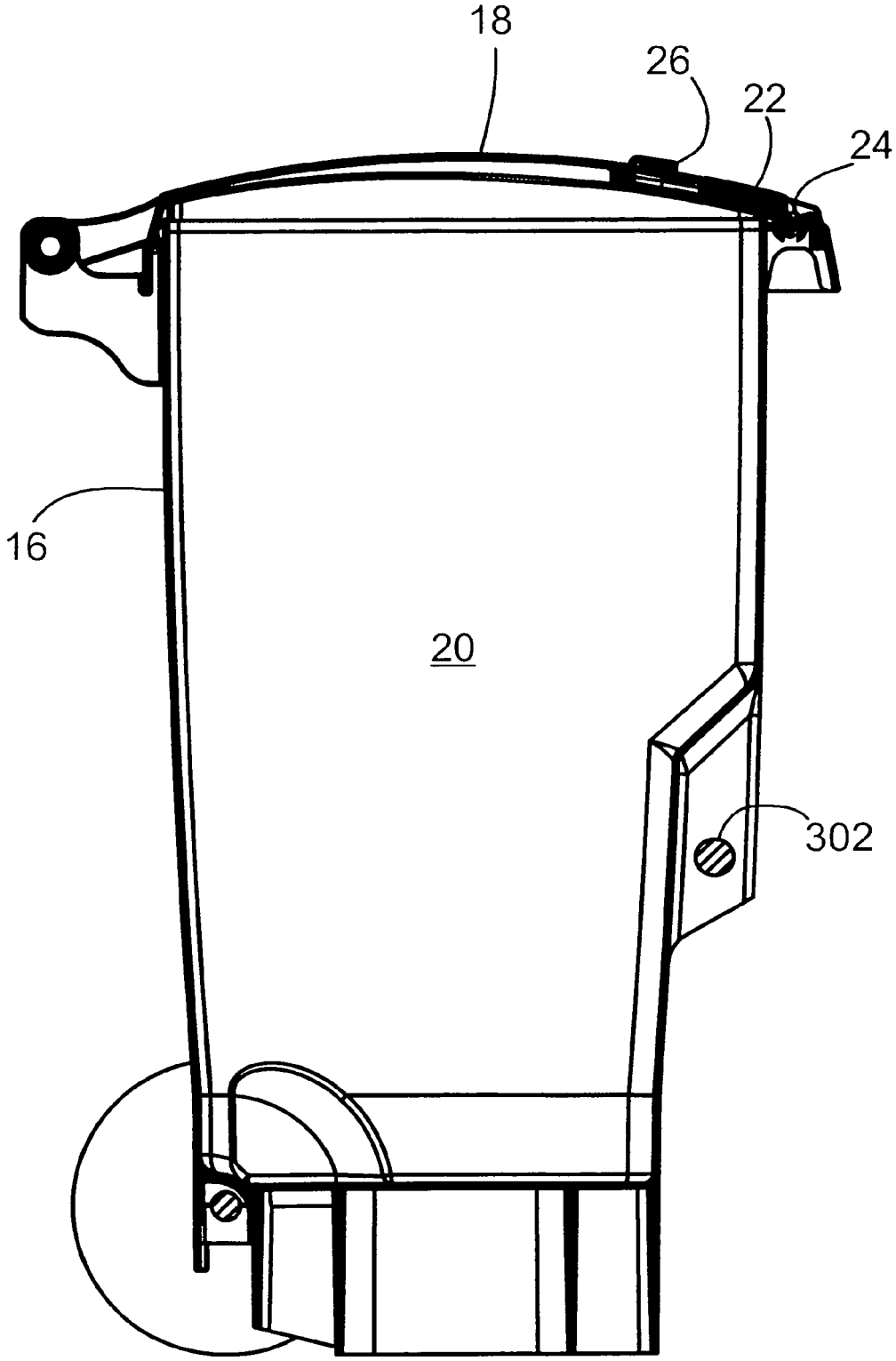
FIG. 10 is a sectional side elevation view of the container, taken along the lines A-A in FIG. 5, illustrating the latch in the locked lid position.
Figure 12:
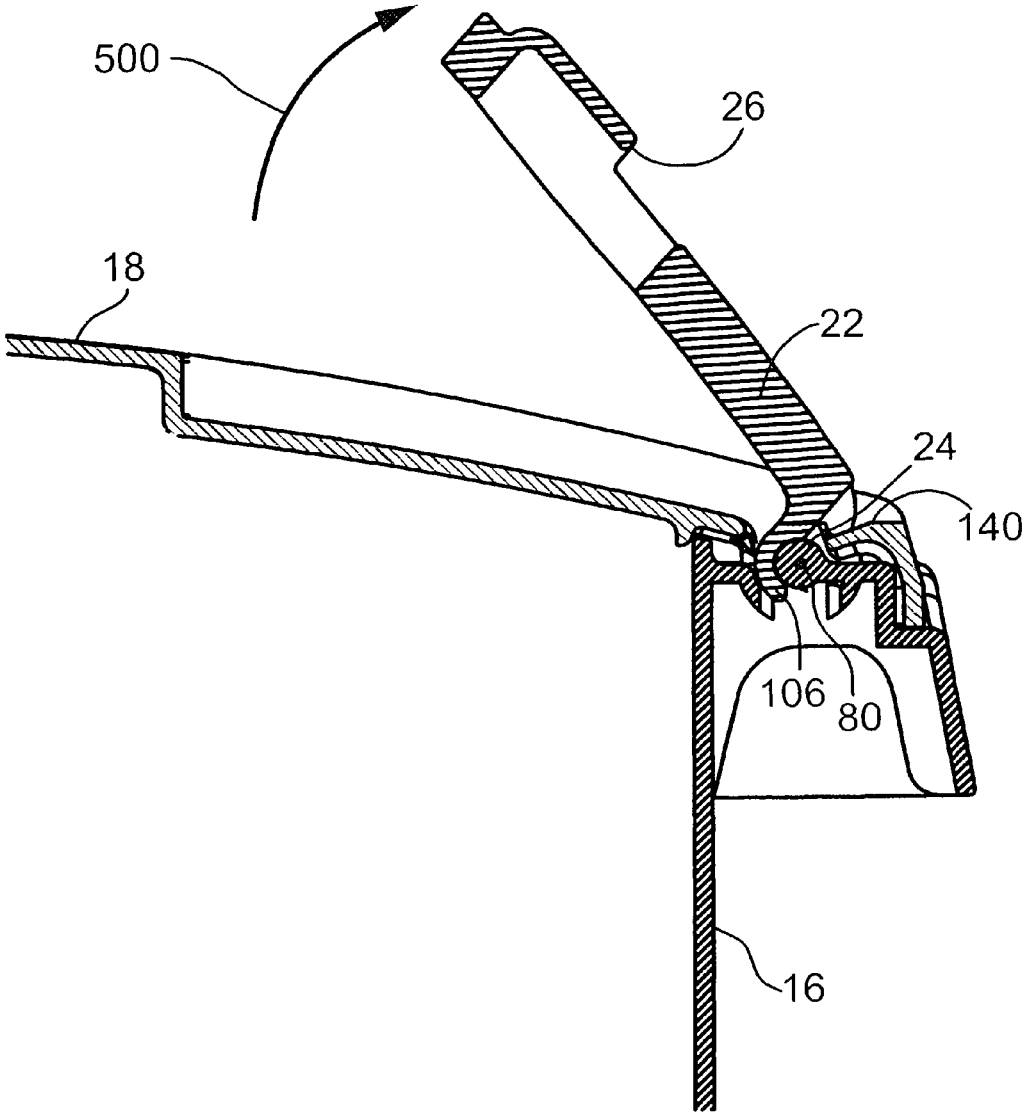
FIG. 12 is a front detail of a sectional side elevation view of the container, taken along the lines A-A in FIG. 5, illustrating the latch in the unlocked lid position.
Figure 13:
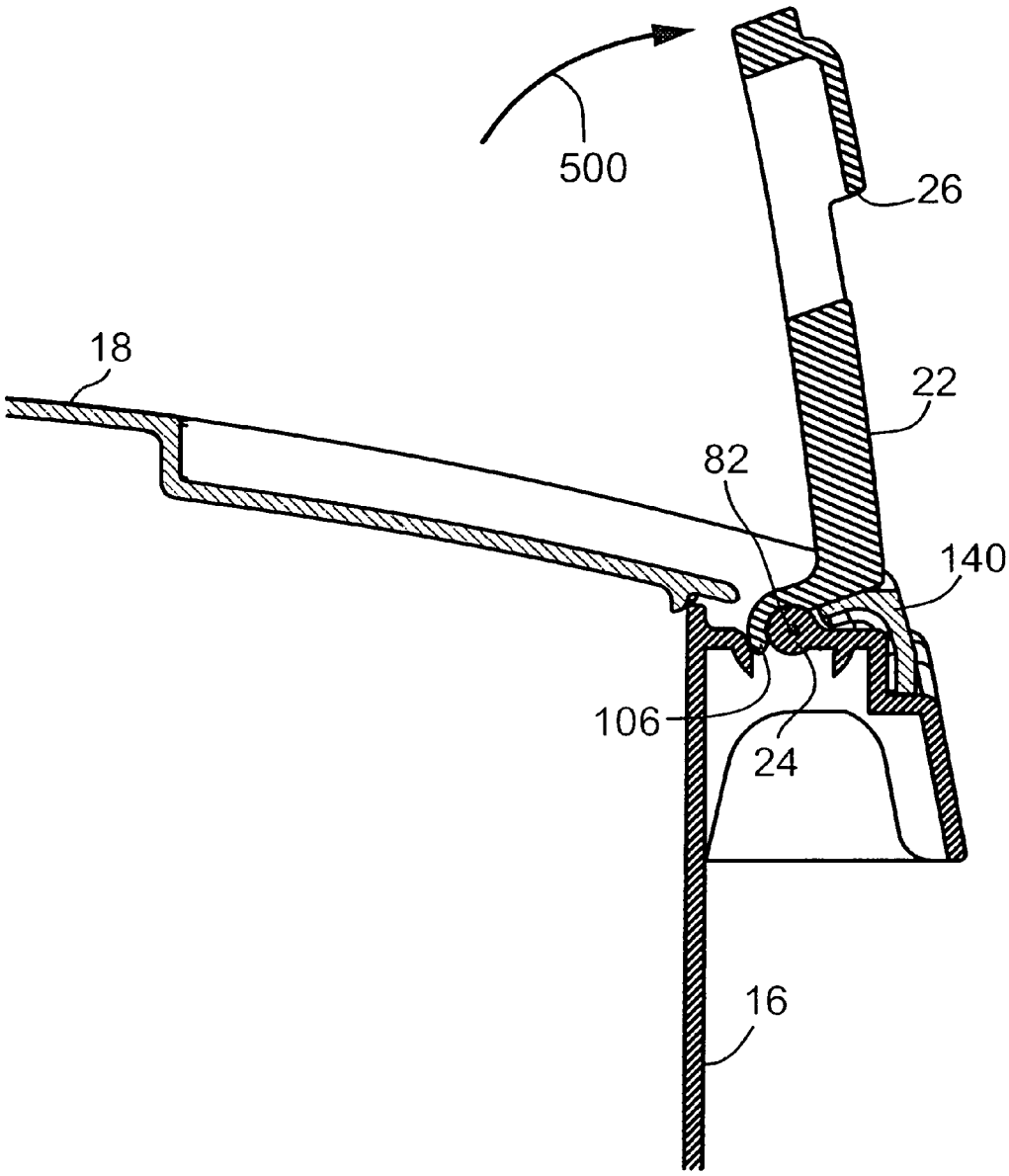
FIG. 13 is a front detail of a sectional side elevation view of the container, taken along the lines A-A in FIG. 5, illustrating the latch in the unlocked indication position.
Figure 14:
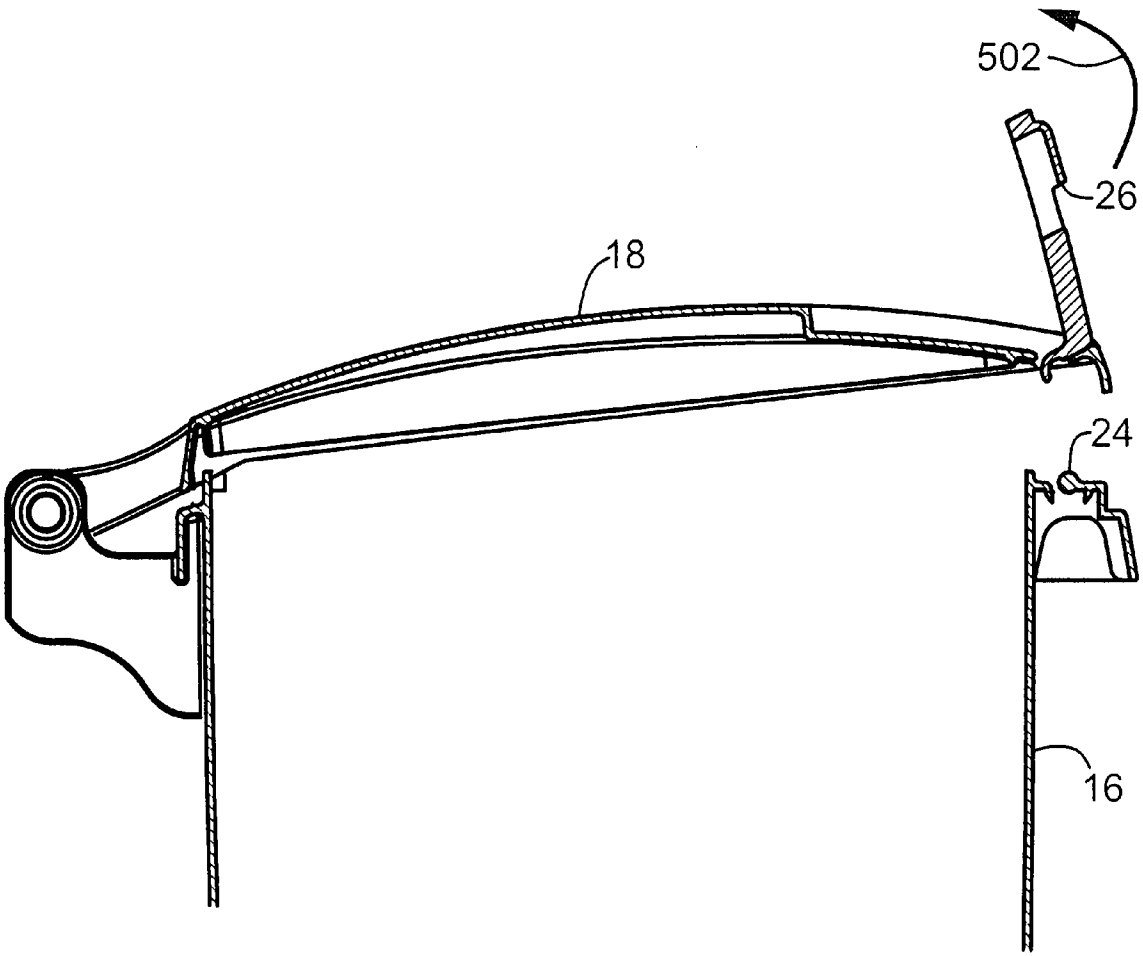
FIG. 14 is a top detail of a sectional side elevation view of the container, taken along the lines A-A in FIG. 5, illustrating the lid in an open position.
Figure 44:
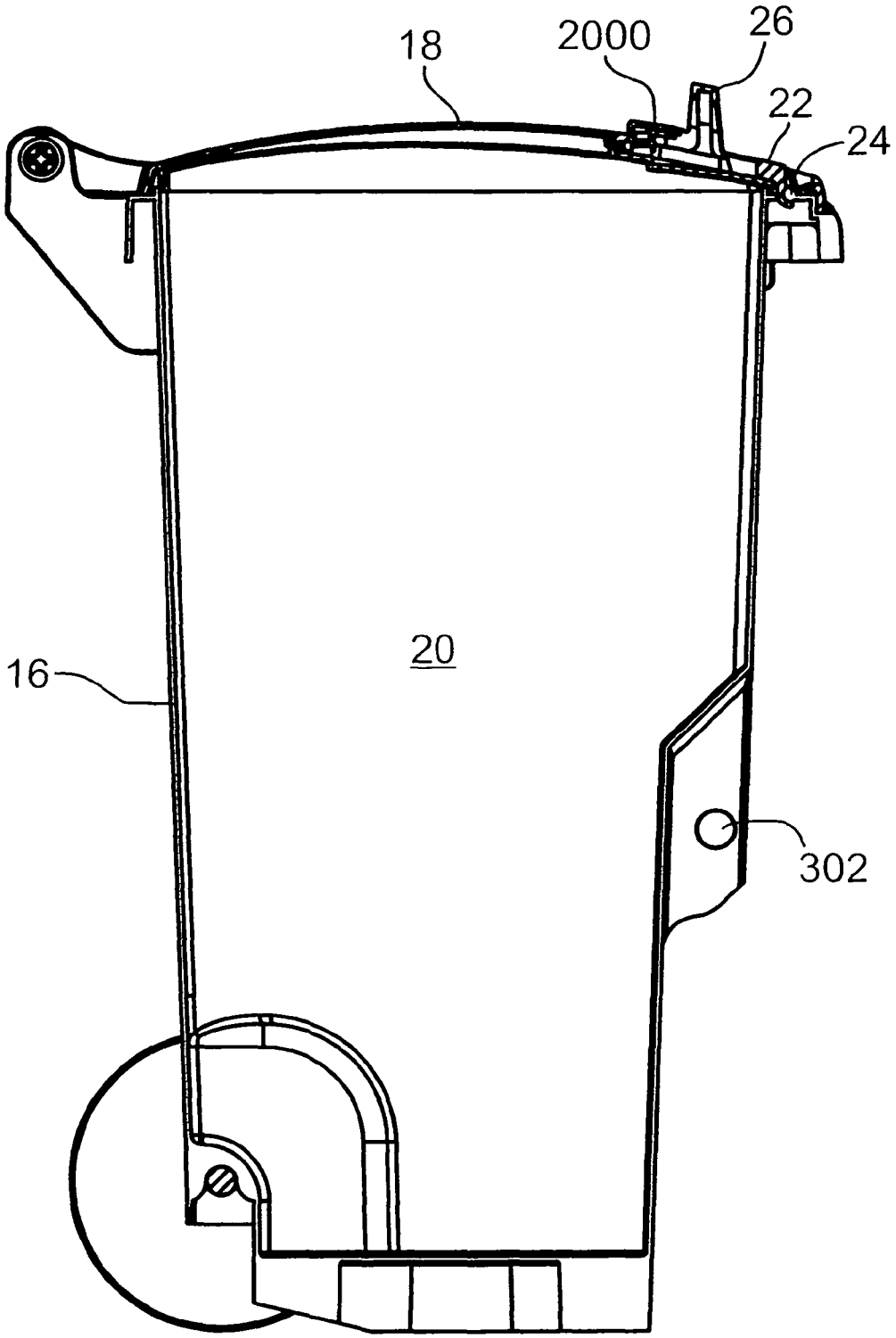
FIG. 44 is a sectional side elevation view of the container, taken along the lines A-A in FIG. 39, illustrating the latch in the locked lid position.
Figure 46:
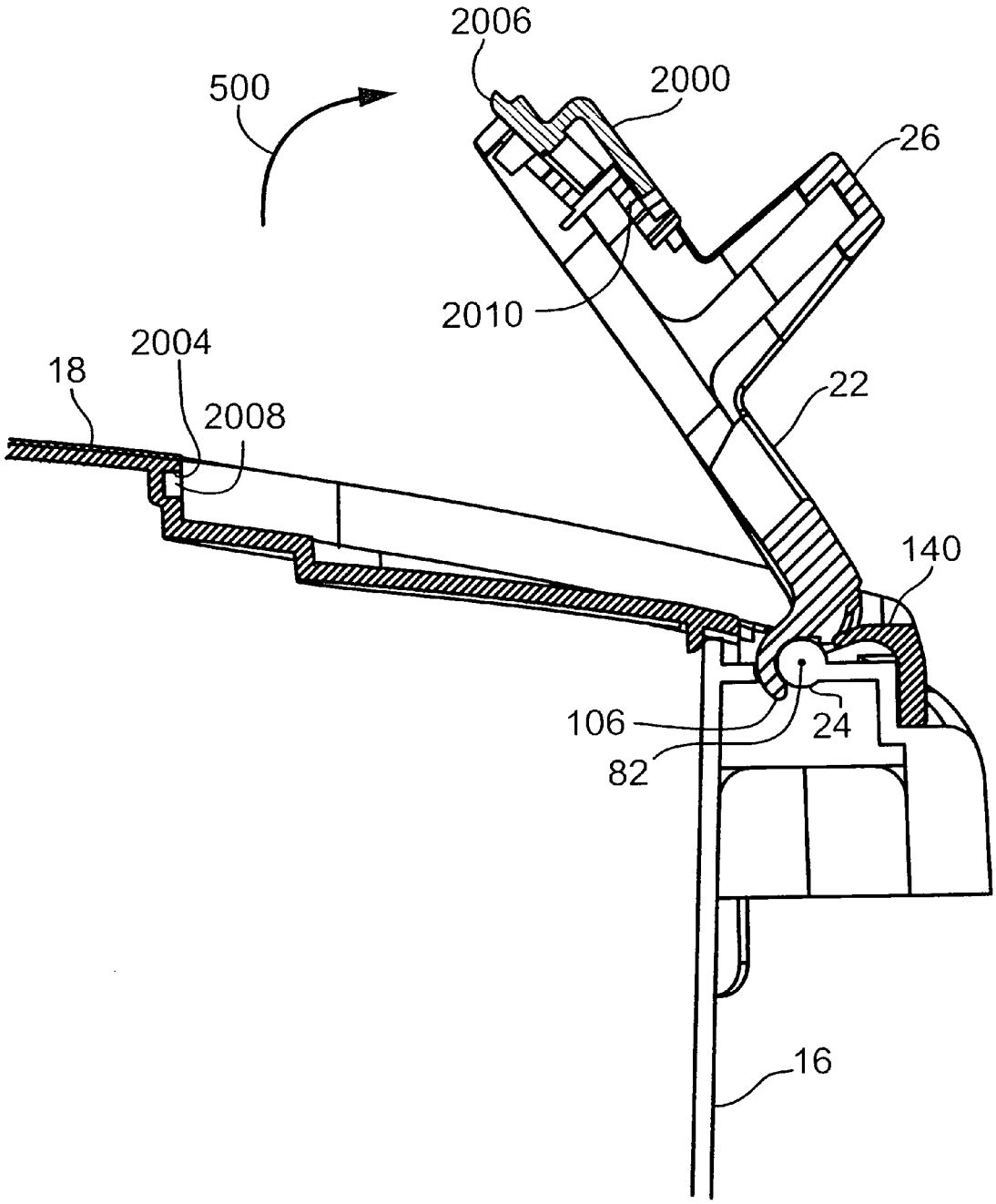
FIG. 46 is a front detail of a sectional side elevation view of the container, taken along the lines A-A in FIG. 39, illustrating the latch in the unlocked lid position.
Figure 47:
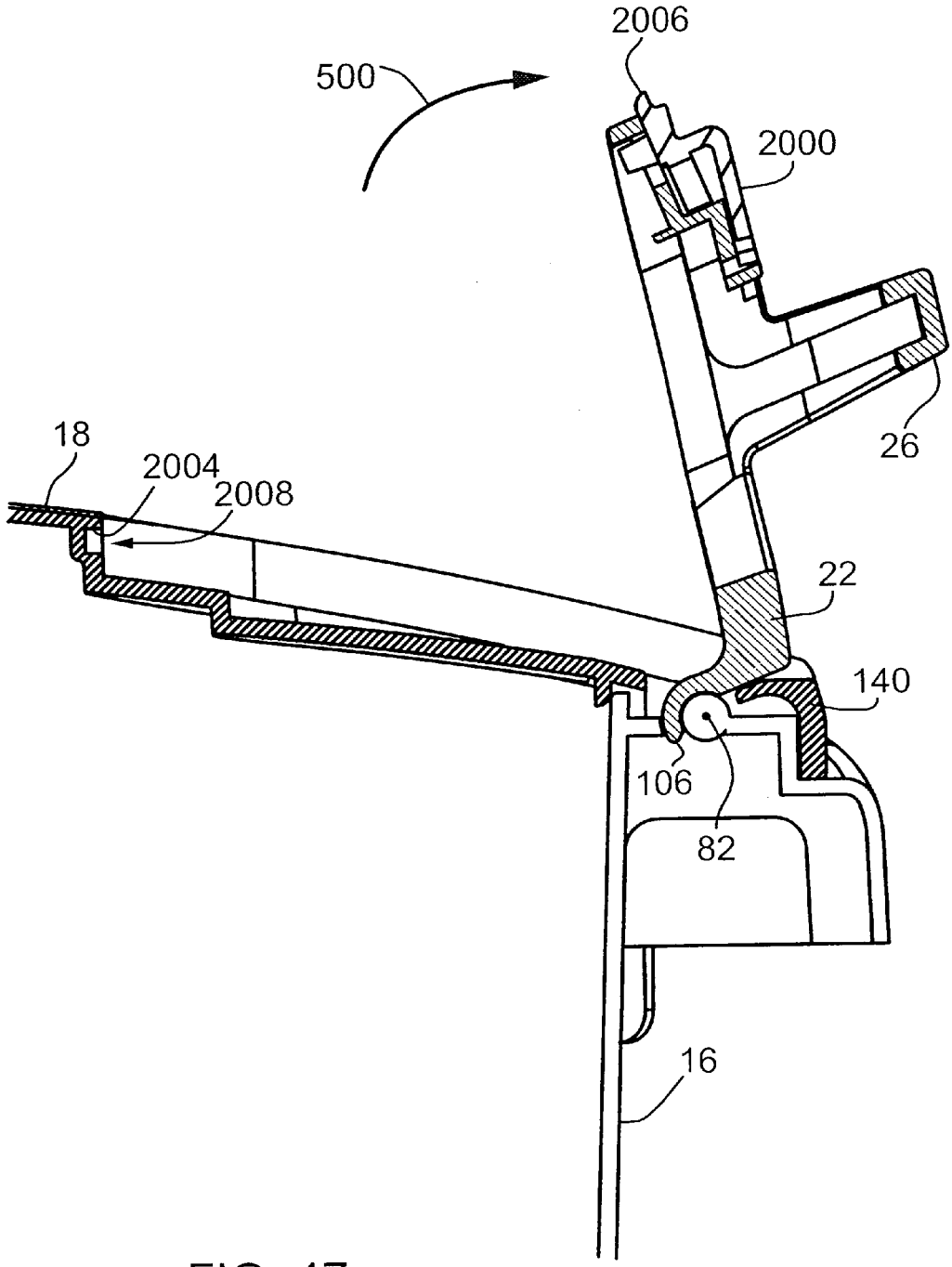
FIG. 47 is a front detail of a sectional side elevation view of the container, taken along the lines A-A in FIG. 39, illustrating the latch in the unlocked indication position.
Figure 48:
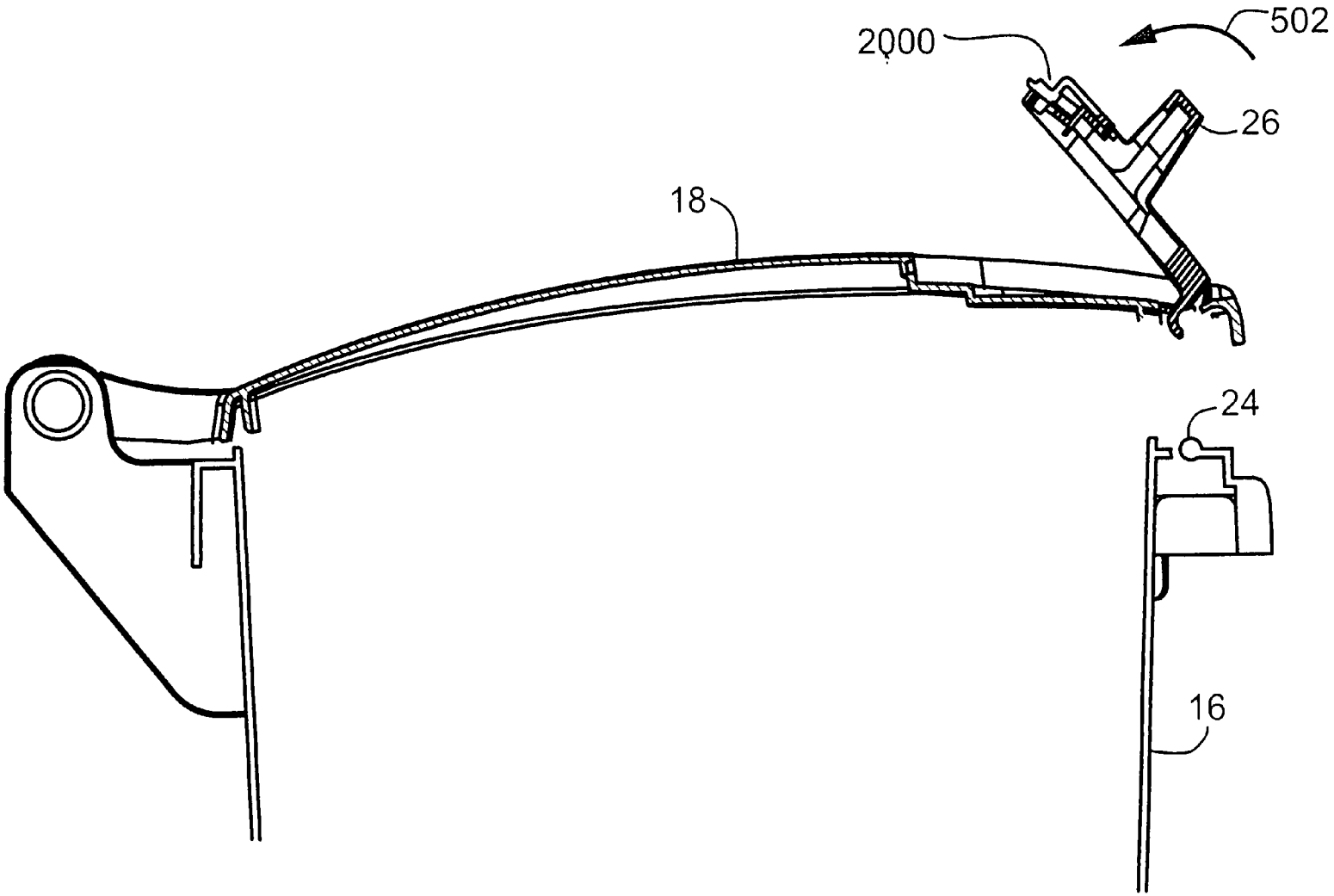
FIG. 48 is a top detail of a sectional side elevation view of tile container, taken along the lines A-A in FIG. 39, illustrating the lid in an open position.

The lid 18 is configured for movement, relative to the bin 16, between an open position (see FIG. 14 for the first embodiment, and FIG. 48 for the third embodiment) and a closed position (see FIGS. 10, 12, and 13 for the first embodiment, and FIGS. 44, 46, and 47 for the third embodiment). For example, the lid extends between and is rotatably coupled to each one of the brackets 48, 50. In this respect, for example, the lid in the first embodiment includes pins 76, 78 extending from opposite sides. Each one of the pins 76, 80 is received within a respective aperture of a respective one of the brackets 48, 50. In the third embodiment, the lid 18 is rotably coupled to each one of the brackets 48, 50 with a hinge pin 3000 (which also functions as handle 54). The hinge pin 3000 is press-fit through receiving apertures 1801*a*, 1801*b* provided on either side of the lid and through receiving apertures 481, 501 provided on the brackets 48, 50.

For example, with respect to the lid 16, when the lid 16 is in the open position, depositing of household organic waste into the cavity 20 can be effected. As a further example, when the lid 16 is open, removal, from the cavity 20, of the contents of the cavity 20 is enabled. For example, when the lid 18 is in the closed position, removal or egress, from the cavity 20, of the contents of the cavity 20 is inhibited. As a further example, when the lid 18 is in the closed position, the contents of the cavity 20 are hidden from view. As a further example, when the lid 18 is in the closed position, egress of odours, from the cavity 20, and from the materials within the cavity 20, is inhibited.

Figure 24:
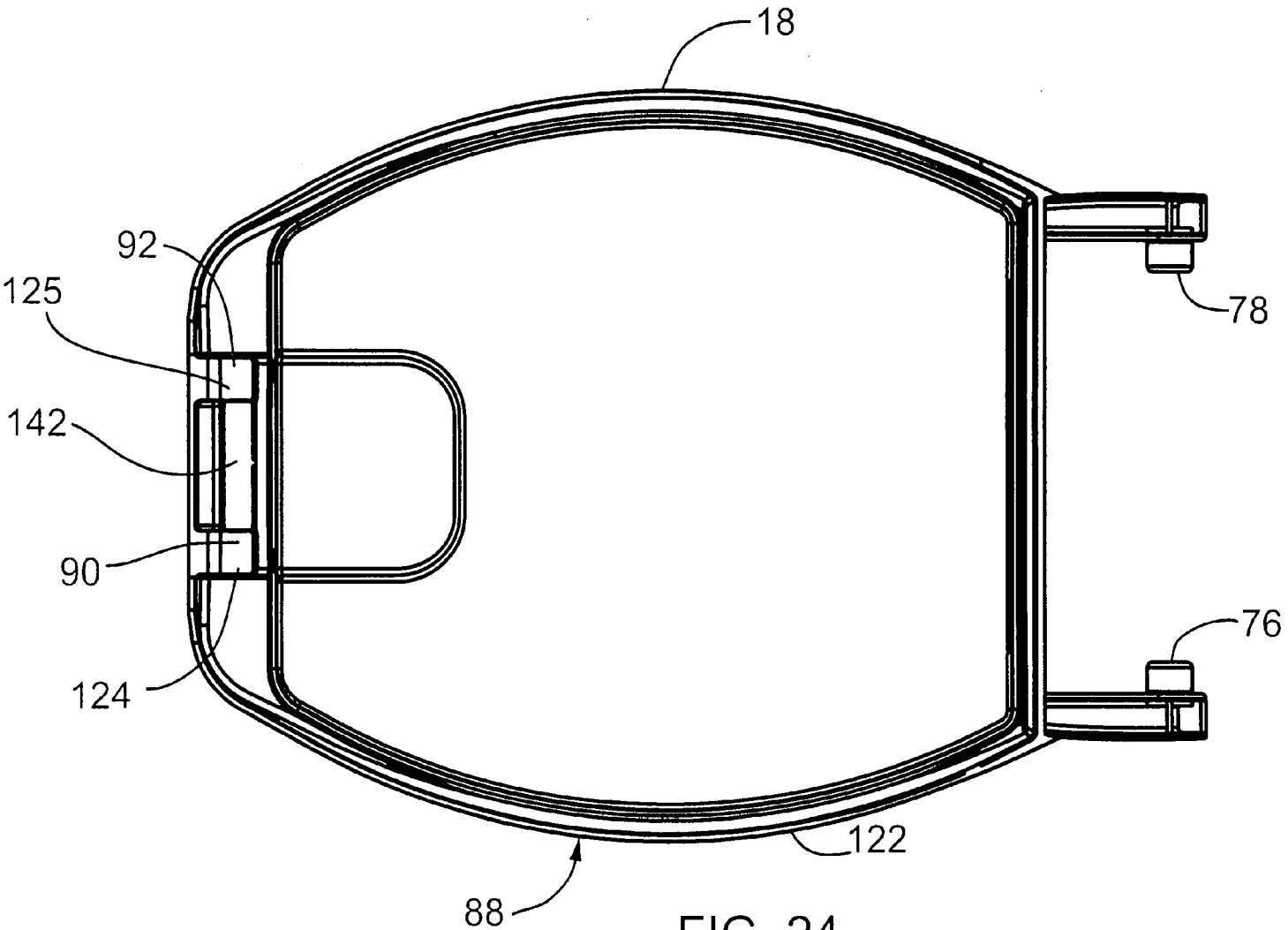
FIG. 24 is a bottom plan view of a lid of the container in FIG. 1.
Figure 25:
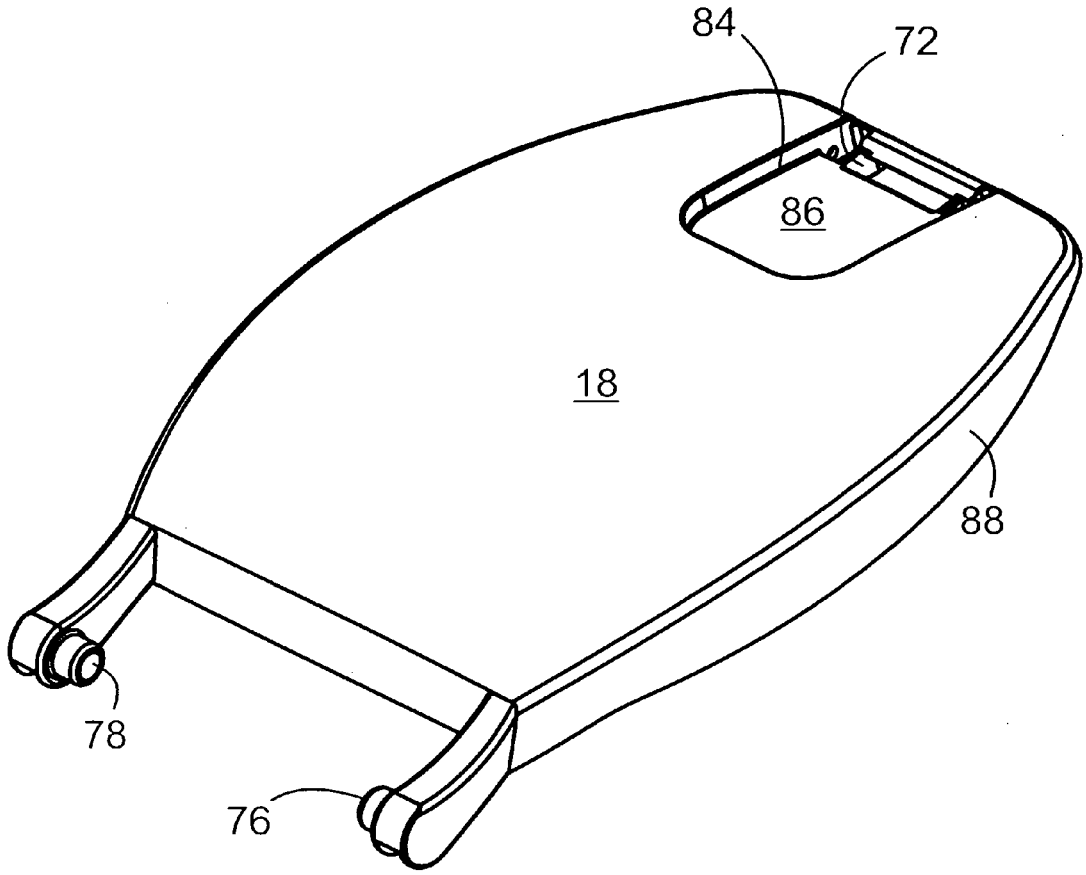
FIG. 25 is a top perspective of the lid of the container in FIG. 1, taken from the rear.
Figure 26:
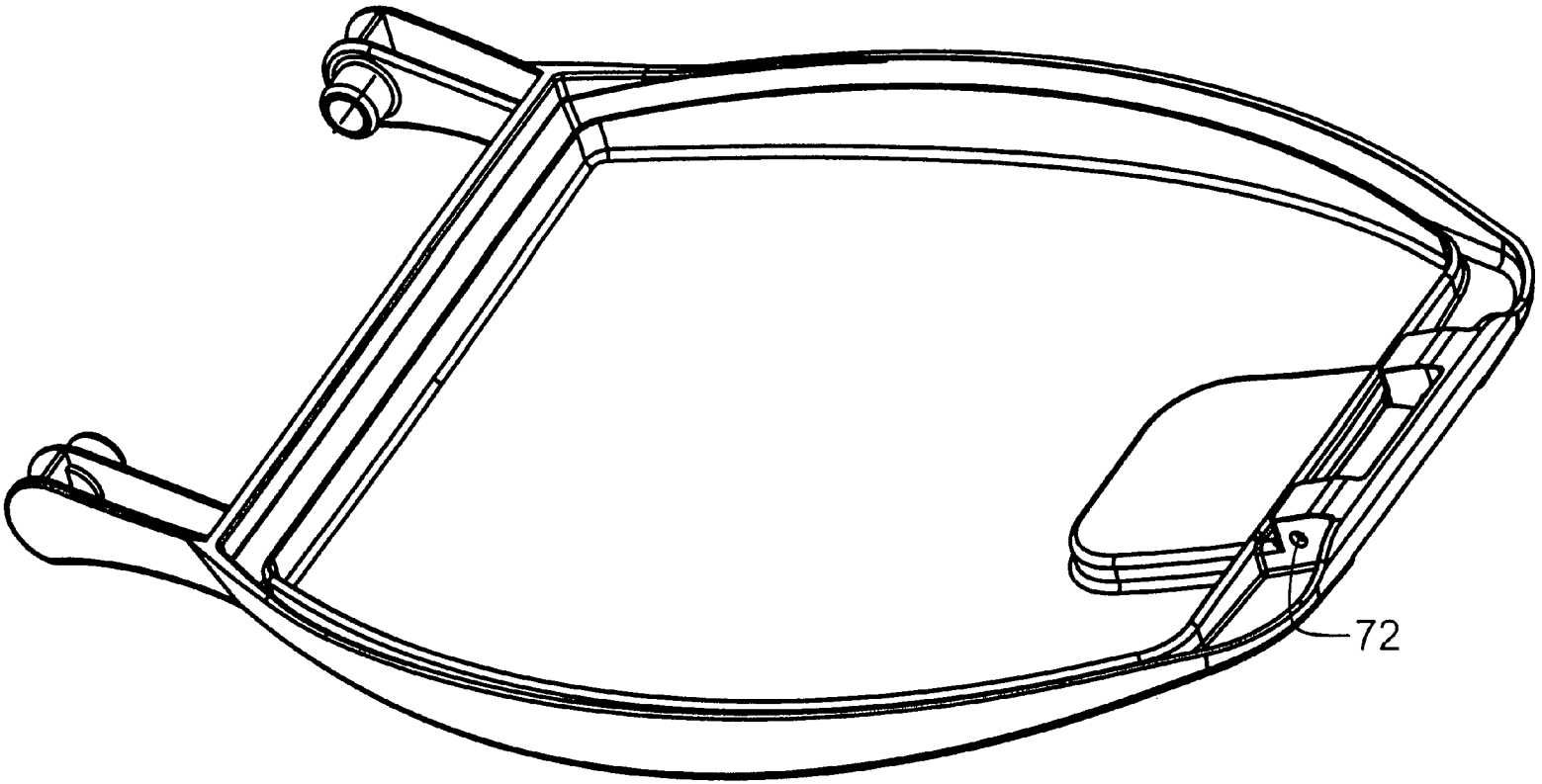
FIG. 26 is a bottom perspective view of the lid of the container in FIG. 1, taken from the rear.
Figure 28:
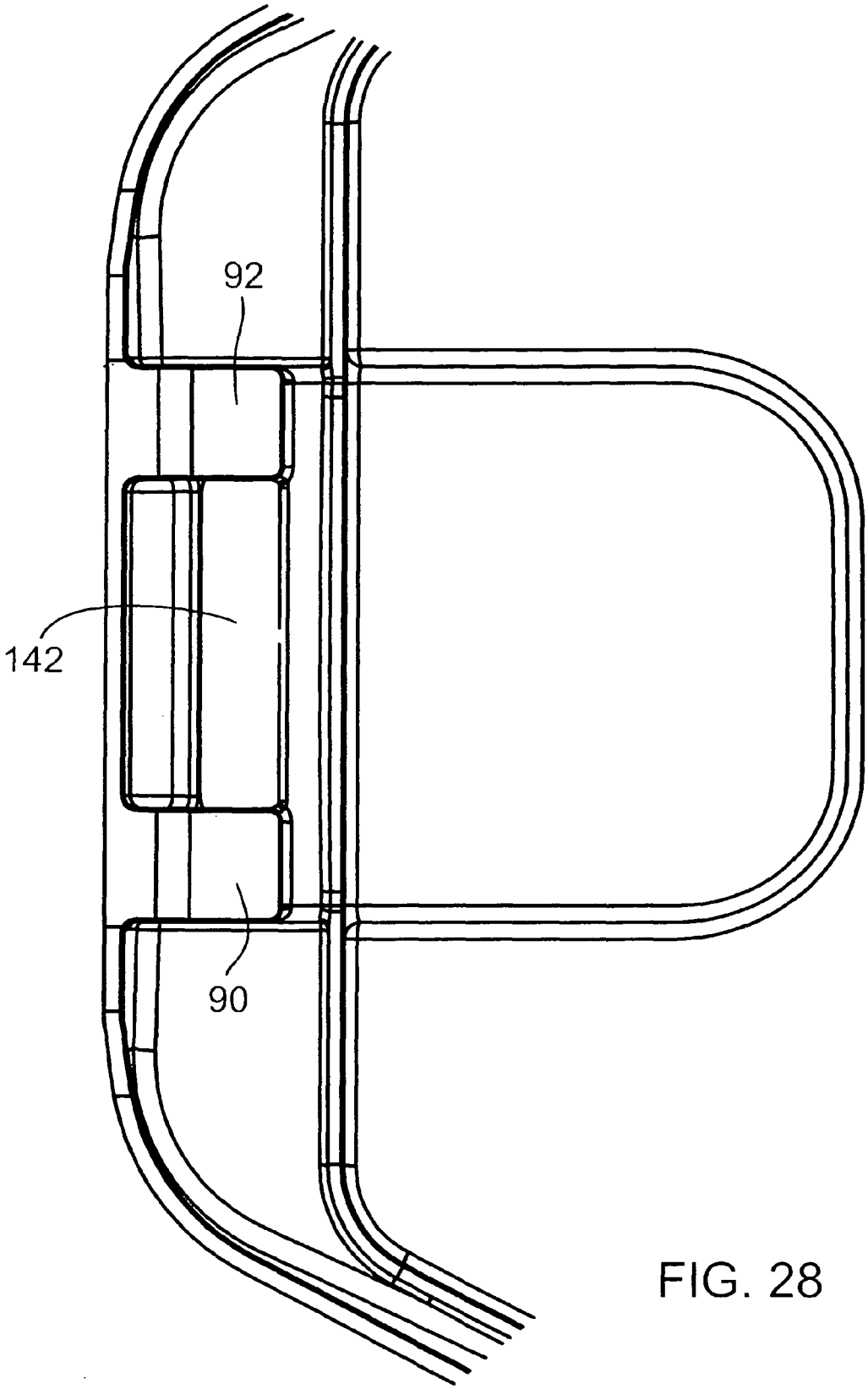
FIG. 28 is a bottom plan view of a front detail of the lid of the container in FIG. 1.
Figure 29:
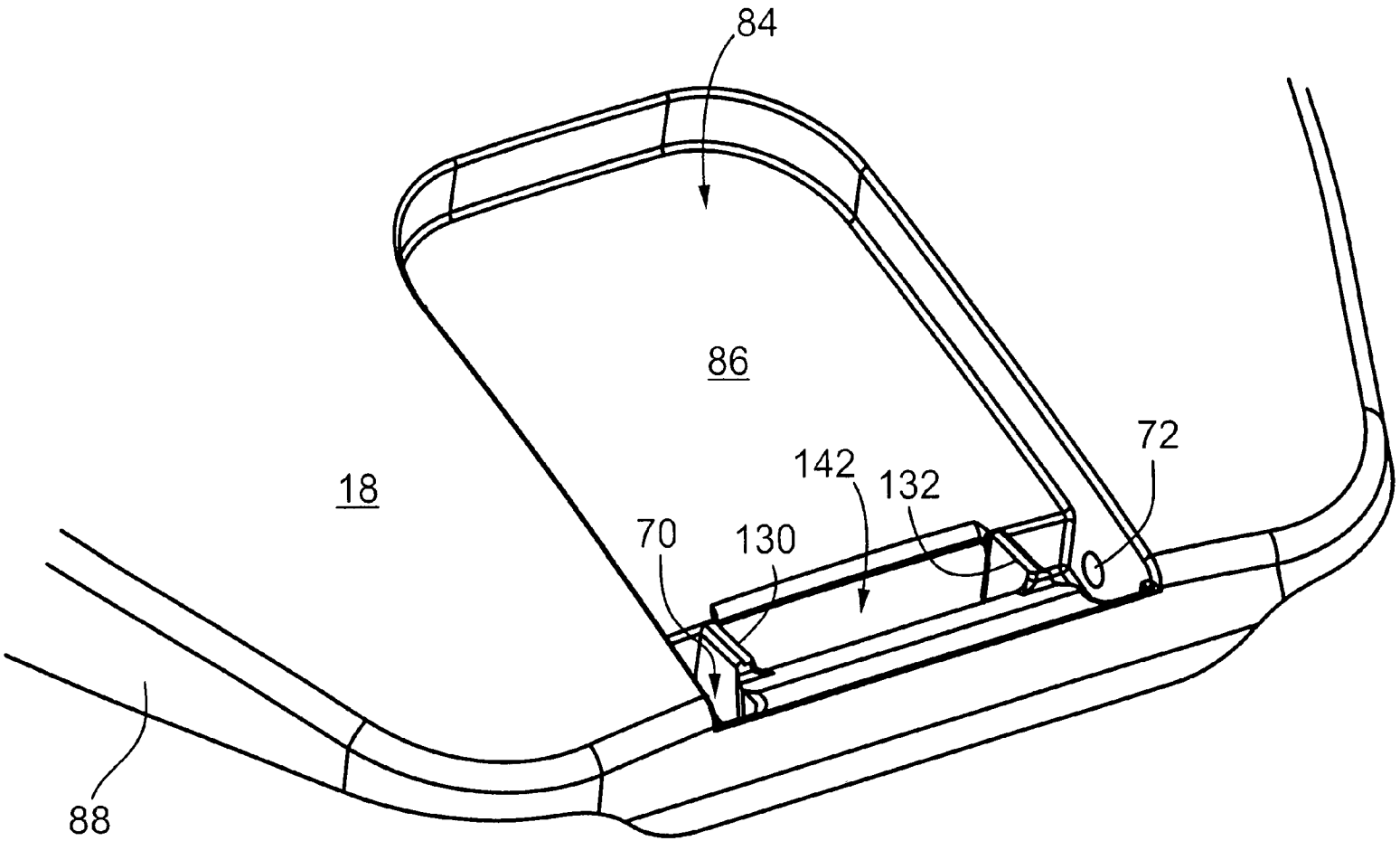
FIG. 29 is top perspective view of a front detail of the lid of the container in FIG. 1.
Figure 58:
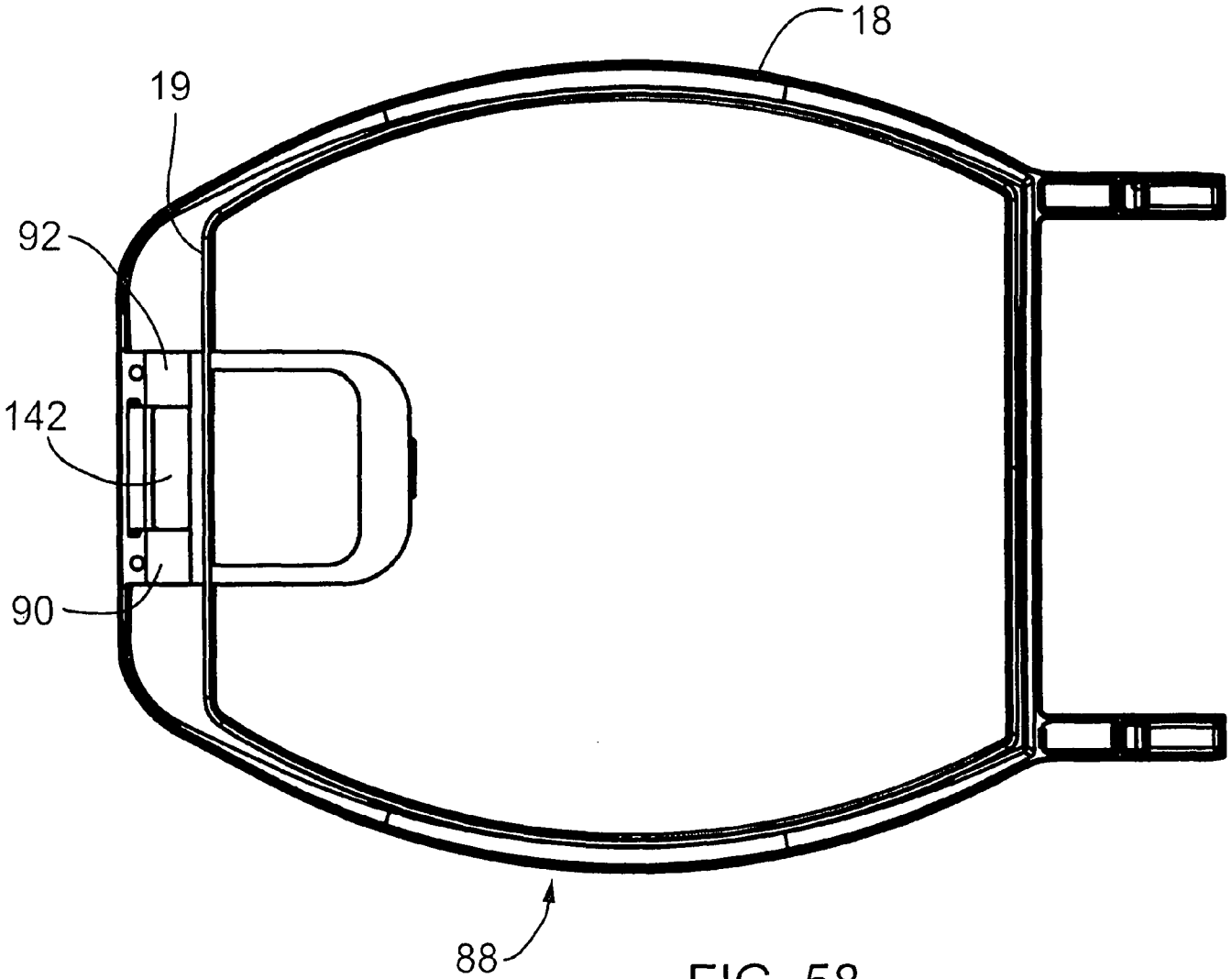
FIG. 58 is a bottom plan view of a lid of the container in FIG. 35.
Figure 59:
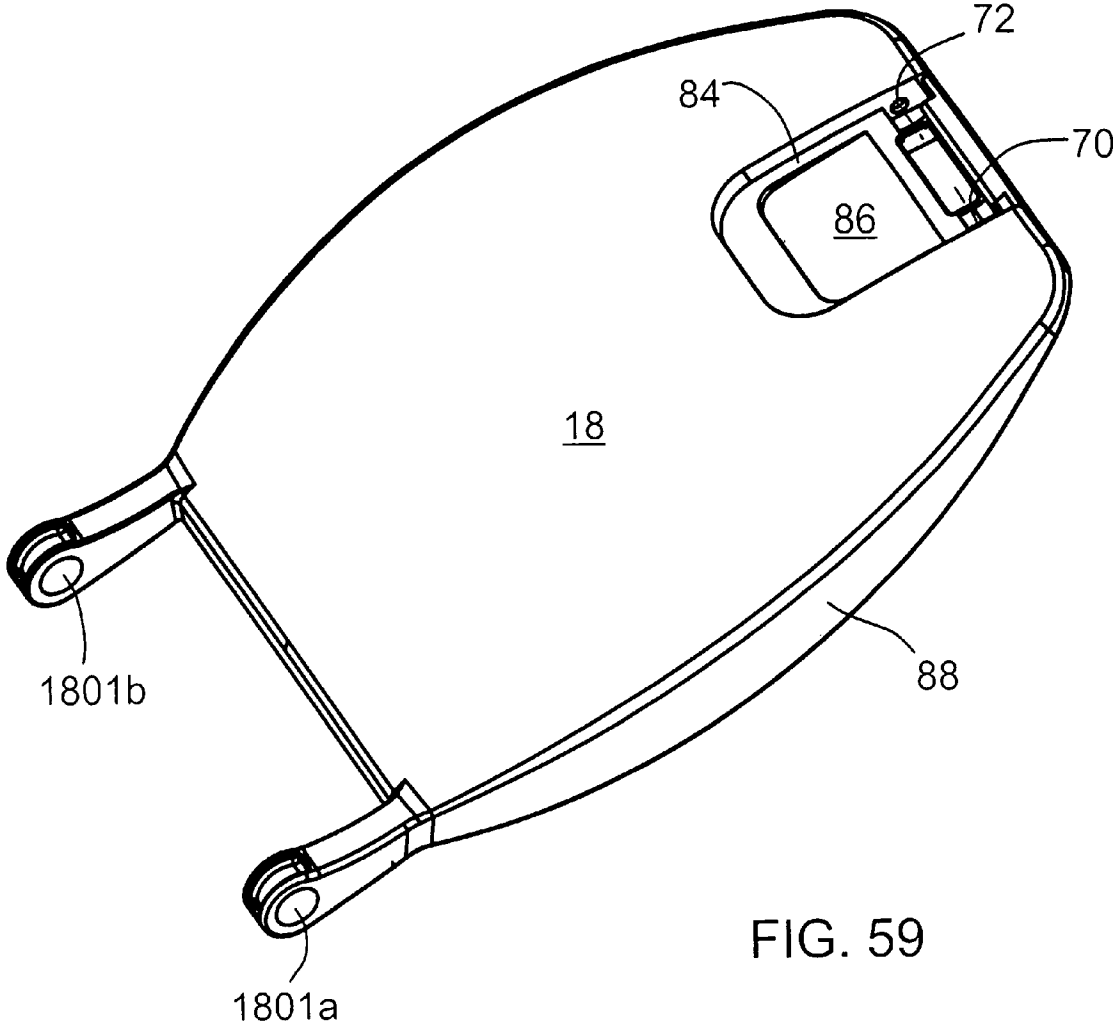
FIG. 59 is a top perspective of the lid of the container in FIG. 35, taken from the rear.
Figure 60:
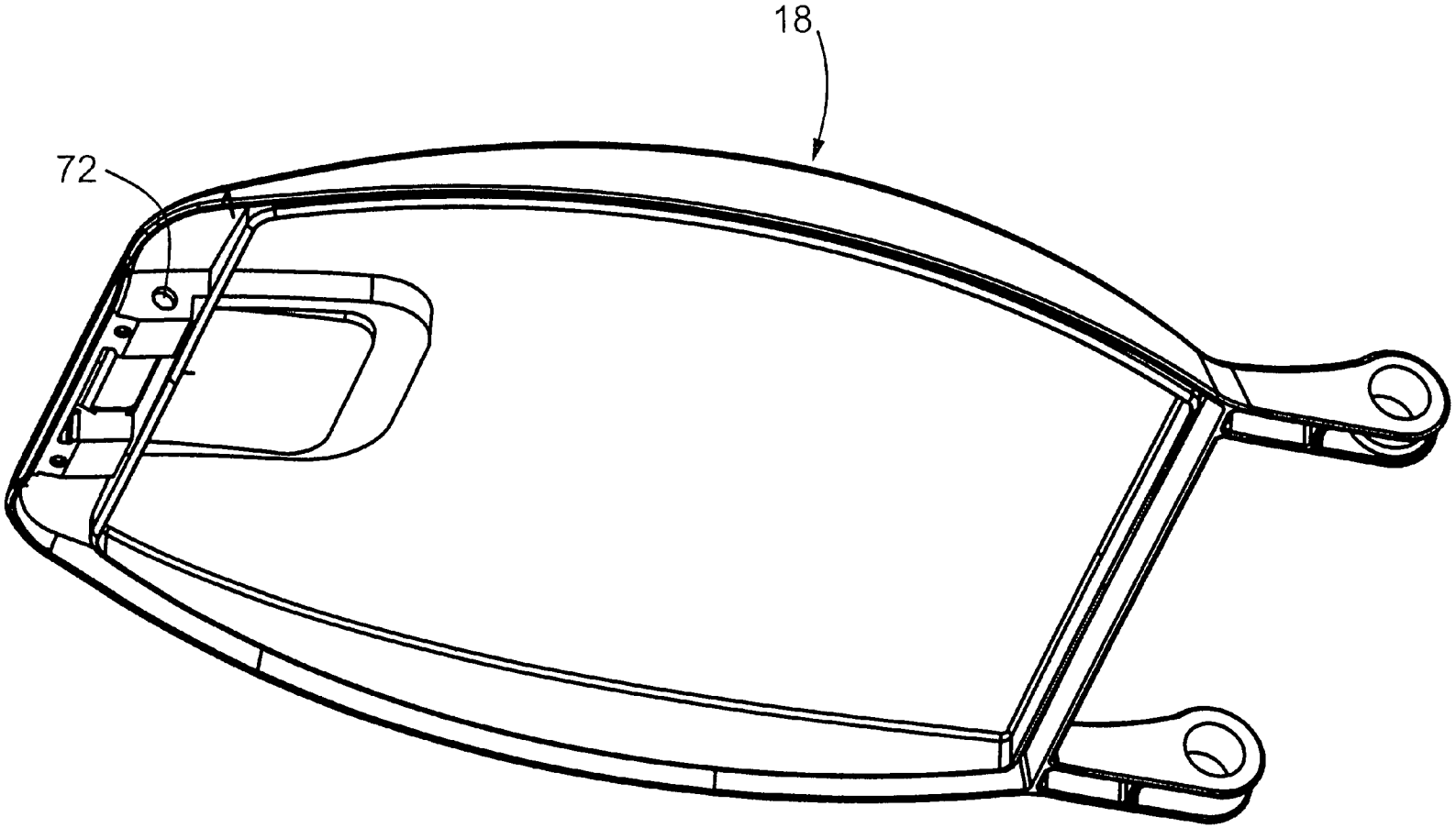
FIG. 60 is a bottom perspective view of the lid of the container in FIG. 35, taken from the rear.
Figure 62:
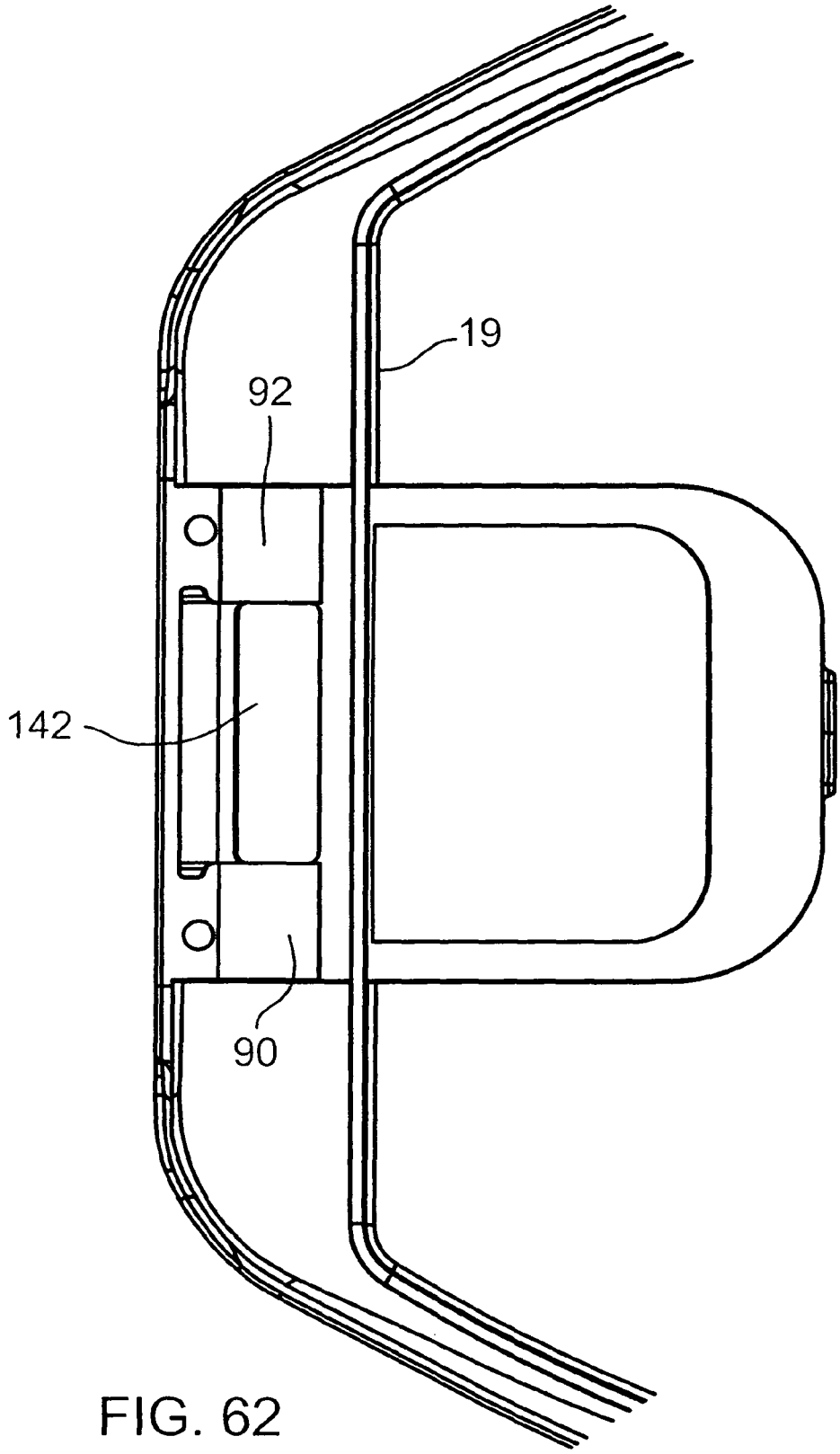
FIG. 62 is a bottom plan view of a front detail of the lid of the container in FIG. 35.
Figure 63:
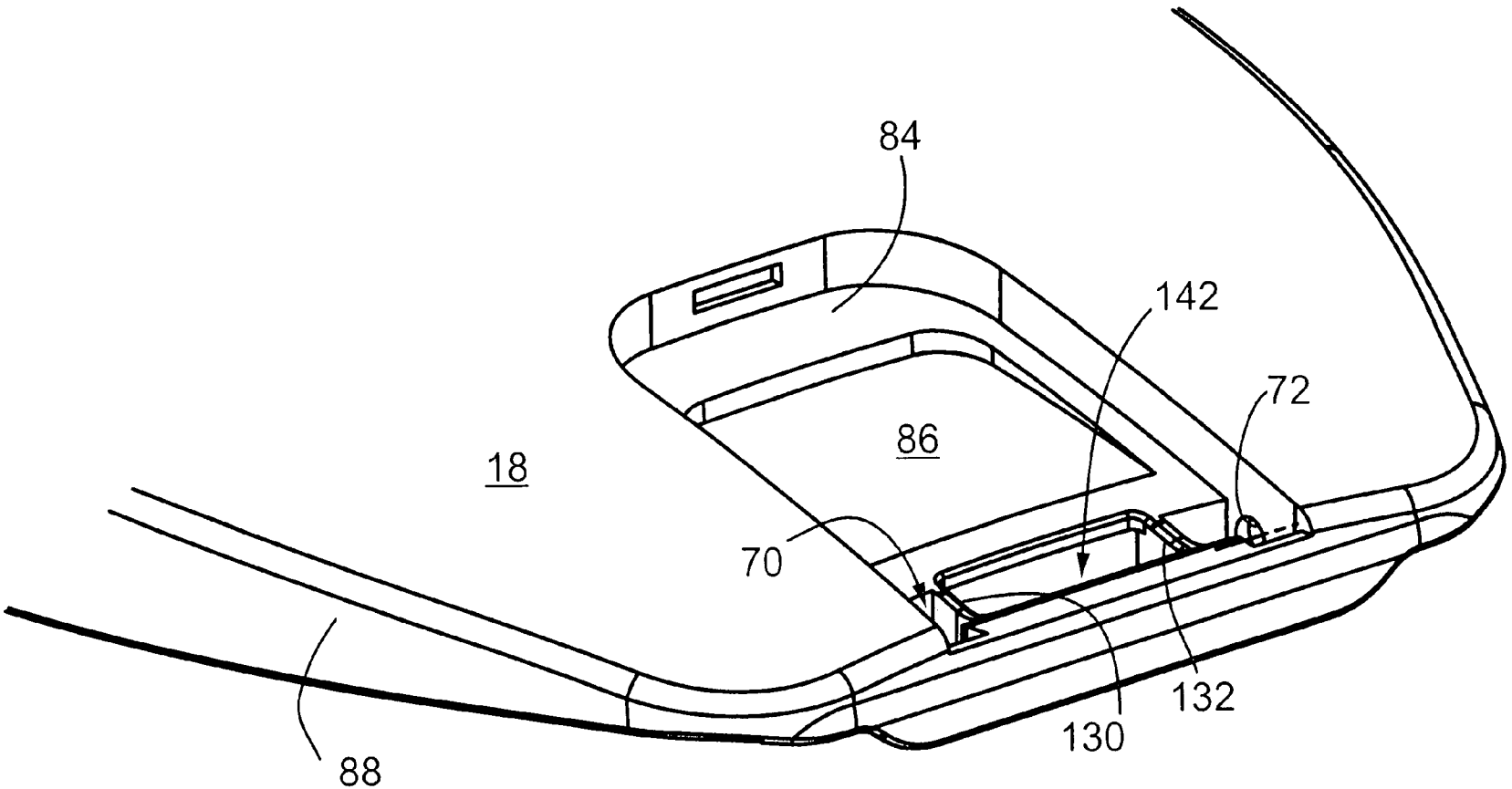
FIG. 63 is top perspective view of a front detail of the lid of the container in FIG. 35.

Referring to FIGS. 24 and 28 for the first embodiment and FIGS. 58 and 62 for the third embodiment, for example, with respect to the lid 16, the lid 16 includes a downwardly extending rib 19. For example, the rib 19 extends internally about the perimeter of the lid 16.

The rib 19 is configured to be disposed opposite to an interior surface of the lip 74 (see FIGS. 18 and 20 for the first embodiment, and FIGS. 52, 54 for the third embodiment) when the lid 16 is in the closed position. As well, the lid 16 includes a skirt 88. For example, the skirt extends peripherally about the perimeter of the lid 16. The skirt 88 is configured to be seated or supported on the seating surface 30 of the rim 28 when the lid 16 is in the closed position. The lid 16 also includes one or more impact pads (two impact pads 90, 92 are shown in FIGS. 24 and 28 for the first embodiment, and FIGS. 58 and 62 for the third embodiment) which are also configured to be seated or supported on a respective one of pad seating surfaces 94, 96 provided on the rim 28 (see FIGS. 18 and 20 for the first embodiment, and FIGS. 52 and 54 for the third embodiment). For example, each one of the seating surfaces 94, 96 is provided in a respective one of receiving wells 98, 100 also provided on the rim 28.

The locking mechanism includes a latch 22 and a detent 24. The latch 22 is coupled (for example, mounted) to one of the bin 16 and the lid 18. The detent 24 is coupled (for example, mounted) to the other one of the bin 16 and the lid 18. For example, the latch 22 is coupled (for example, mounted) to the lid 18 (see FIG. 6 for the first embodiment, and FIG. 40 for the third embodiment), and the detent is provided on the bin (see FIGS. 18, 20, 21, and 22 for the first embodiment, and FIGS. 52, 54, 55 and 56 for the third embodiment). For example, the latch 22 is made from nylon, and the detent 24 is made from the same material as the bin (e.g. high density polyethylene). For example, the latch 22 includes a pair of pins 66, 68 disposed on opposite sides of the latch 22 (see FIGS. 15, 16, and 17 for the first embodiment, and FIGS. 49, 50, and 61 for the third embodiment). Each one of the pins 66, 68 is received within a respective one of latch apertures 70, 72 provided in the surface of the lid 18. In this respect, the latch 22 is snap-fit into the latch apertures 70, 72 (see FIGS. 25 and 26 for the first embodiment, and FIGS. 59 and 61 for the third embodiment) of the lid 18.24 and the detent 24 is coupled (for example, mounted) to the bin 16.

For example, with respect to the latch 22, the latch 22 is rotatably coupled to the lid 18. For example, such rotational coupling can be accomplished by pivots incorporated in one of the lid 18 or the latch 22 and received within respective receptacles in the other one of the lid 18 or the latch 22, or through external pivots received within receptacles provided in each one of the lid 18 and the latch 22.

For example, with respect to the detent 24, the detent 24 is mounted to the rim 28 of the bin 16. For example, the detent 24 is mounted to the rim 28 at a font section 51 of the bin 16. For example, the detent 24 is mounted peripherally of the lip 74 of the rim 28.

Figure 15:
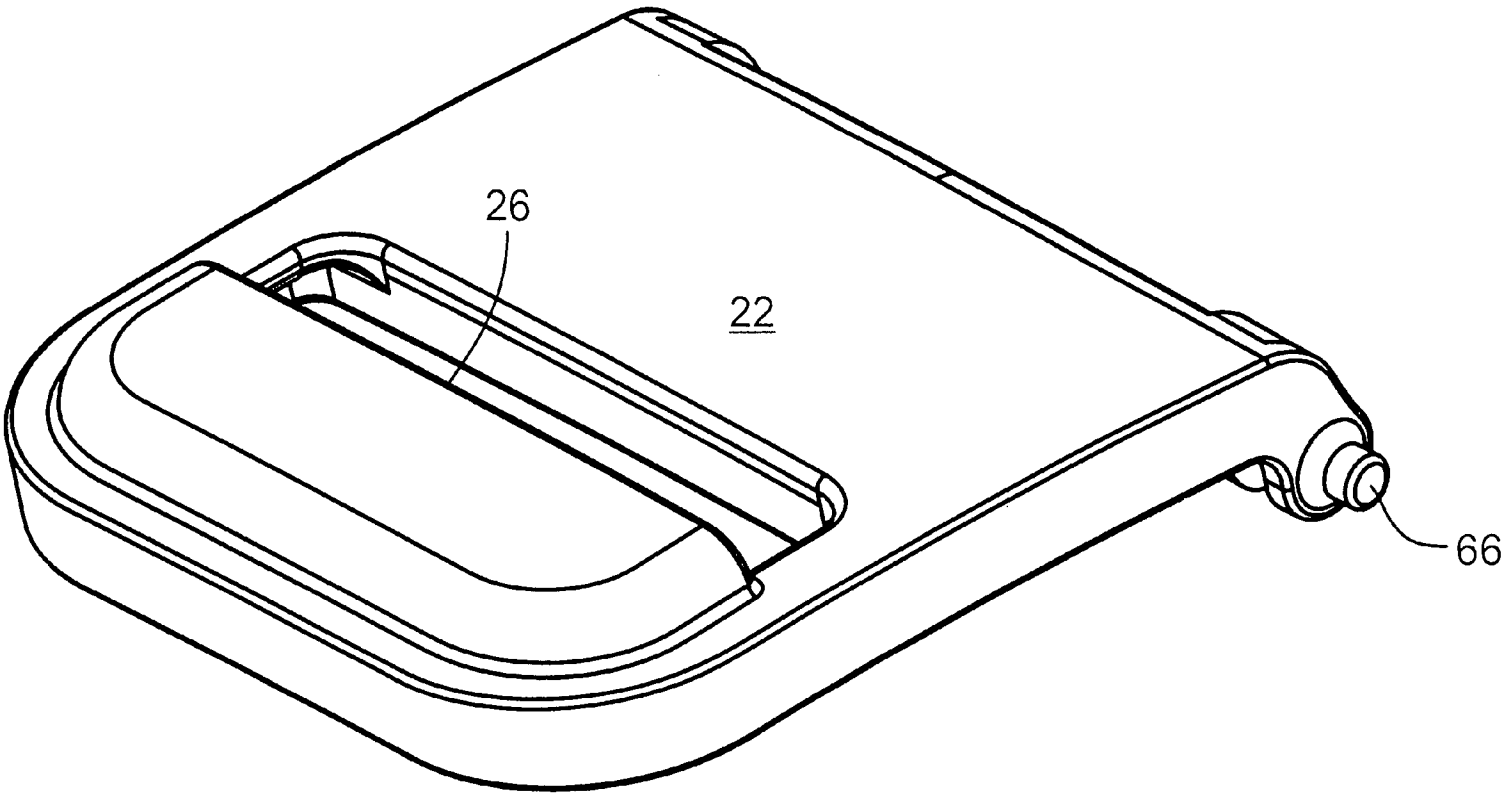
FIG. 15 is a top perspective of the latch of the container in FIG. 1 taken from the front.
Figure 16:
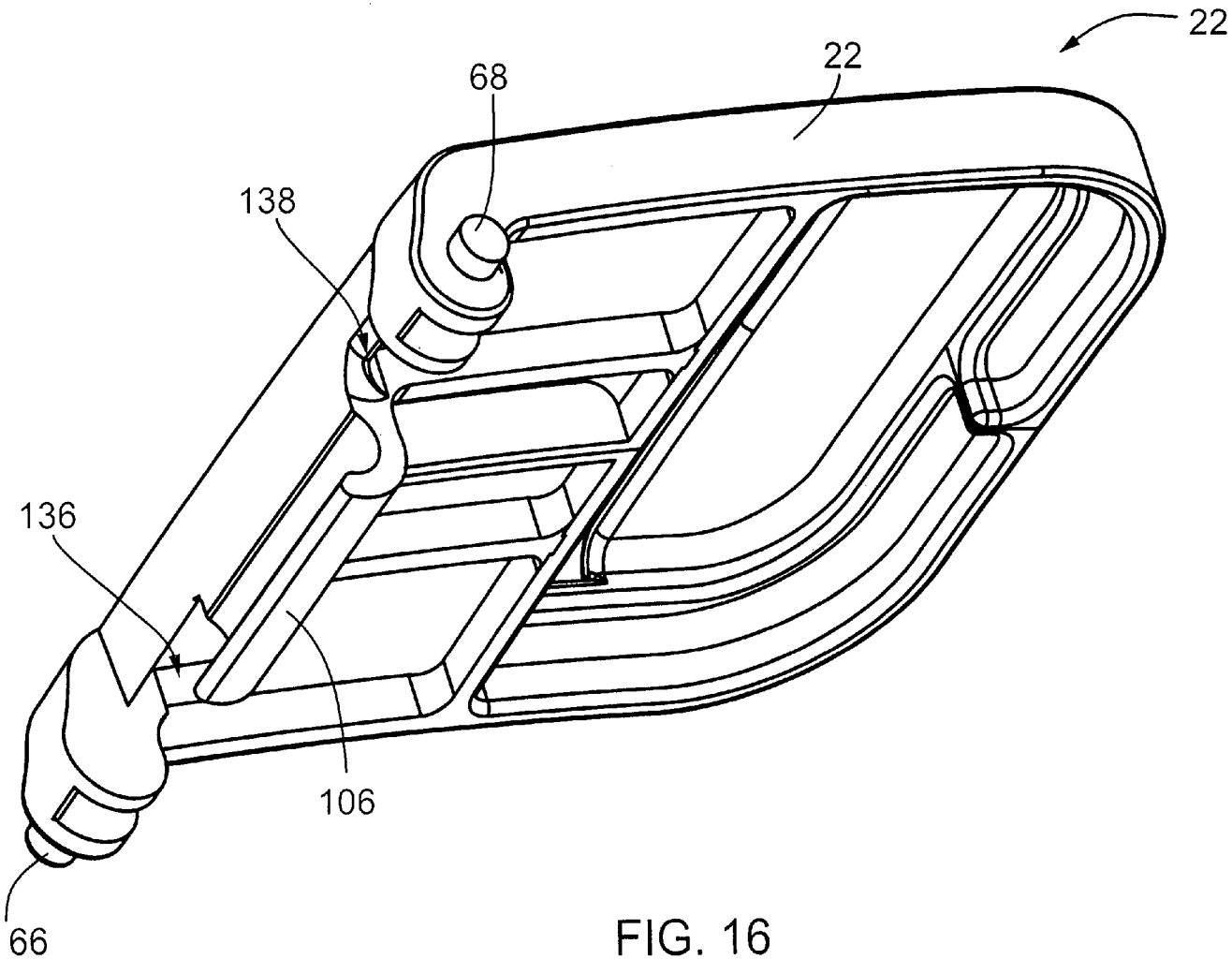
FIG. 16 is a bottom perspective view of the latch of the container in FIG. 1, taken from the rear.
Figure 17:
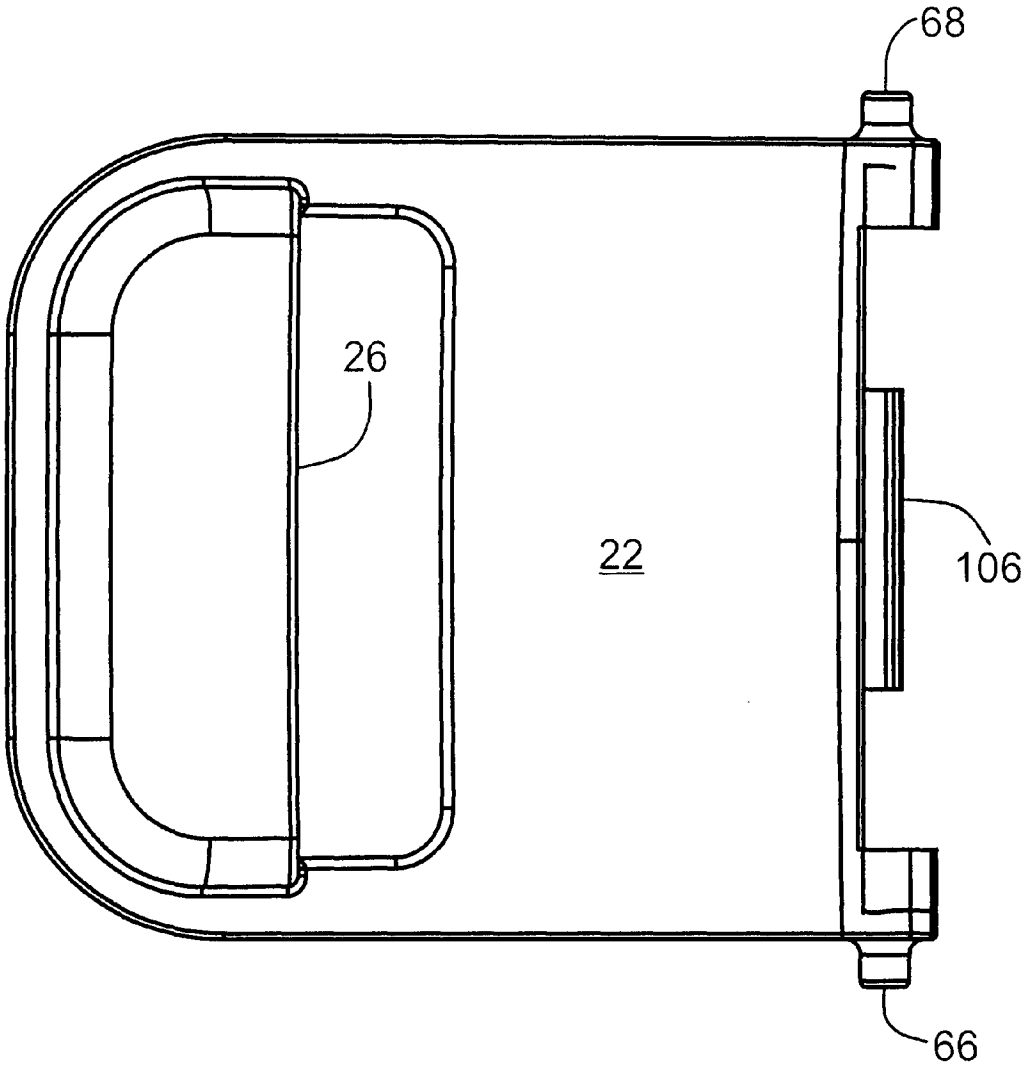
FIG. 17 is a top plan view of the latch of the container in FIG. 1.
Figure 49:
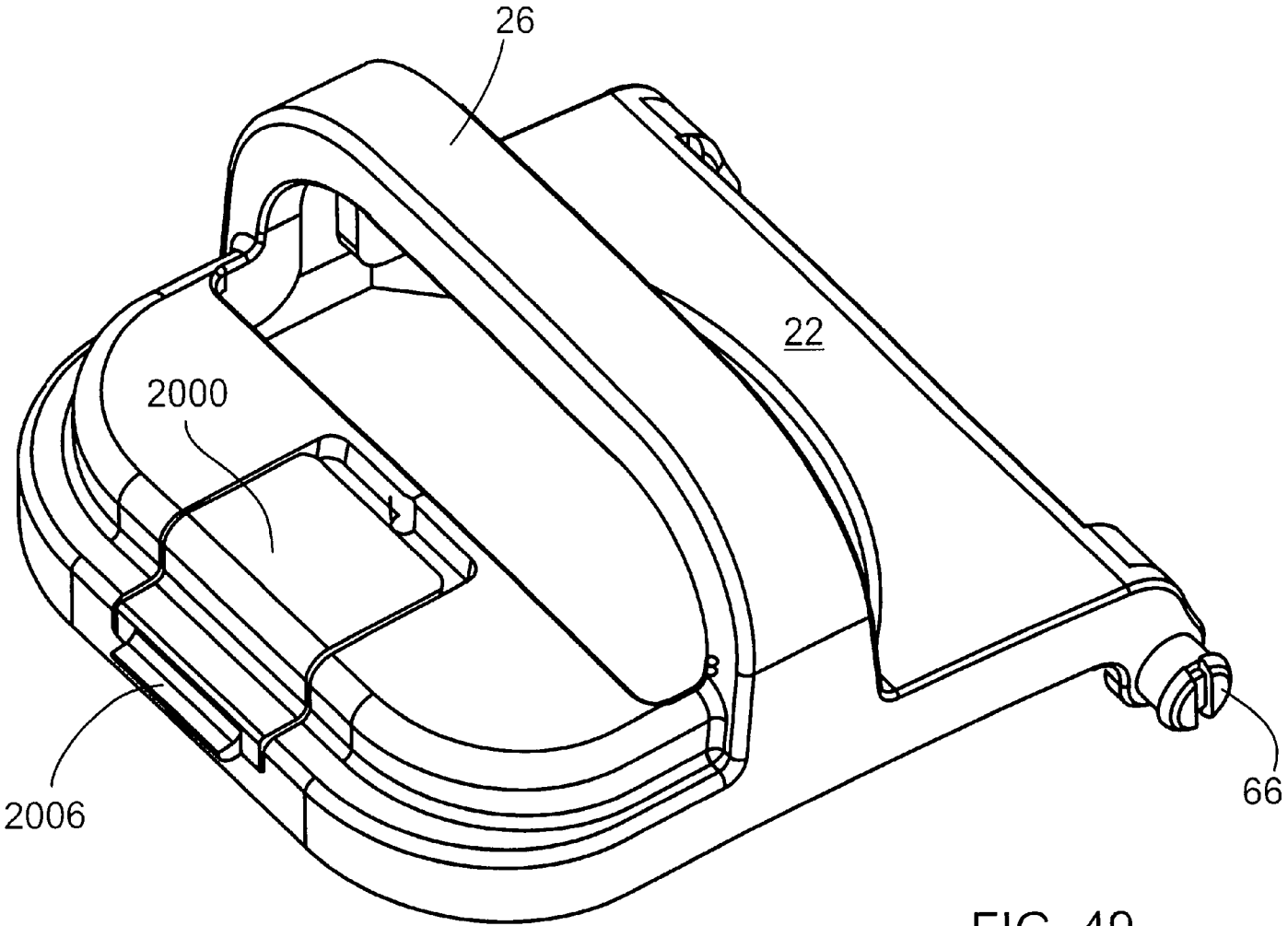
FIG. 49 is a top perspective of the latch and the latch locking mechanism of the container in FIG. 35 taken from the front.
Figure 50:
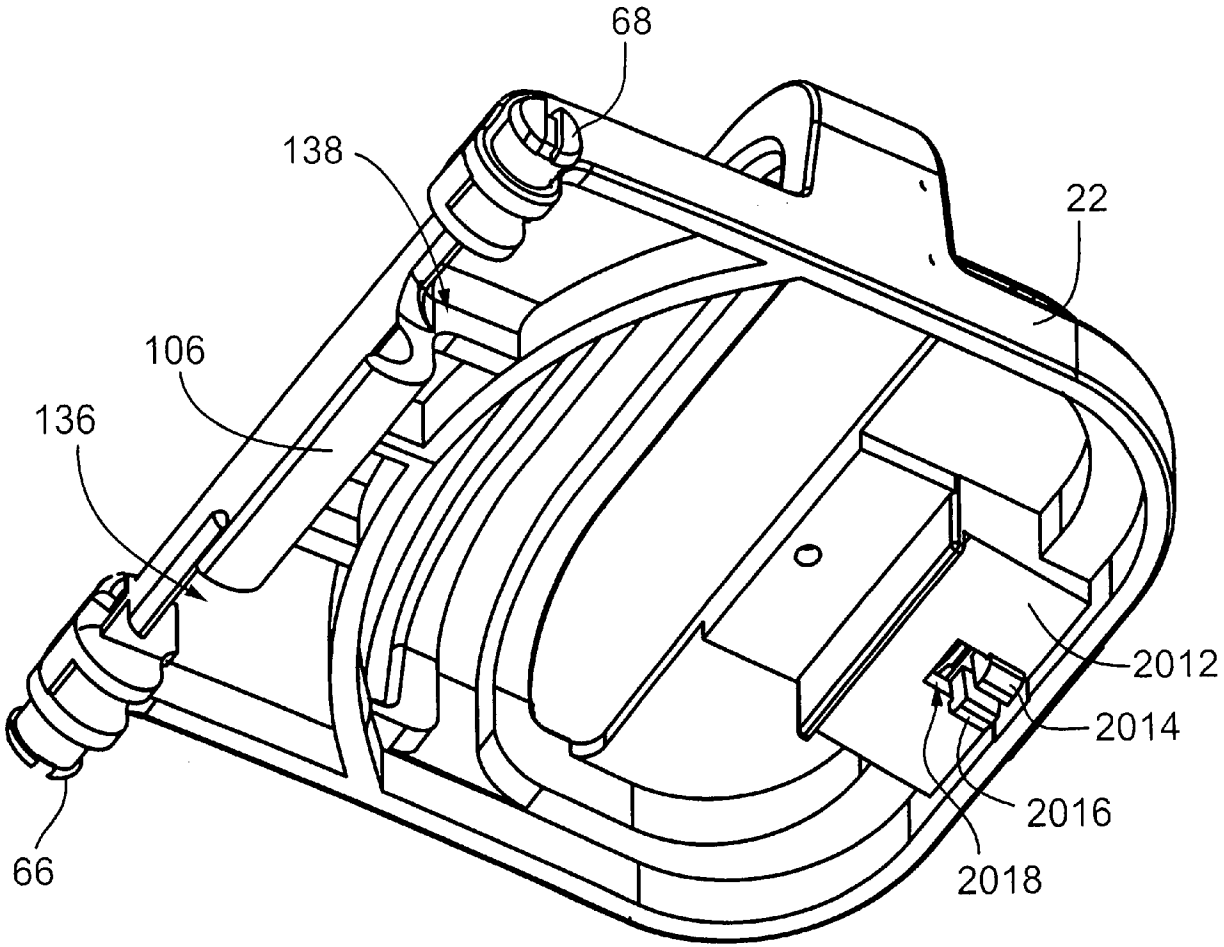
FIG. 50 is a bottom perspective view of the latch and the latch locking mechanism of the container in FIG. 35, taken from the rear.
Figure 51:
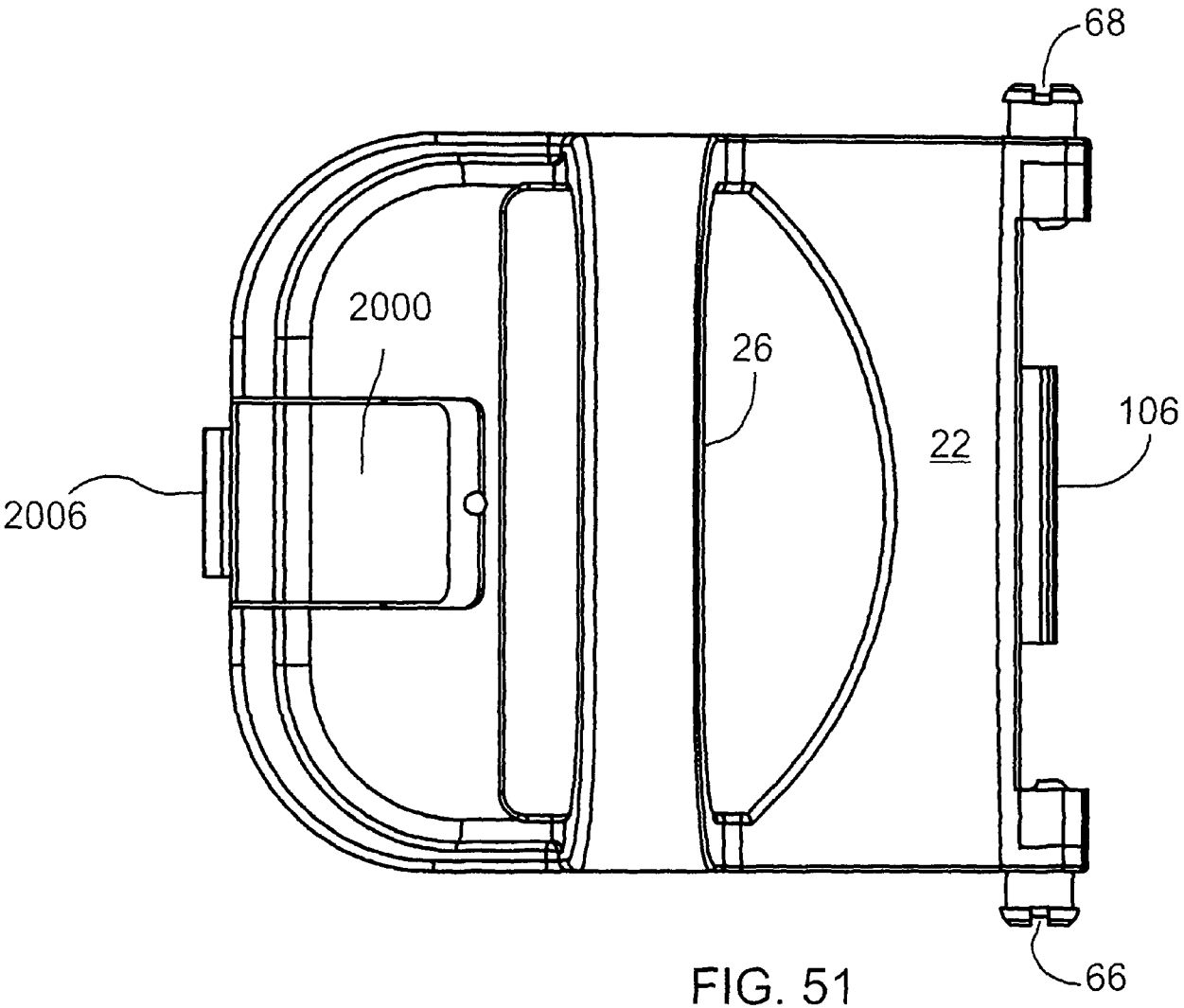
FIG. 51 is a top plan view of the latch and the latch locking mechanism of the container in FIG. 35.

Referring to FIGS. 15 to 17 for the first embodiment and FIGS. 49 to 51 for the third embodiment, the latch 22 includes a handle 26. The latch 22 is moveable between a locked lid position (see FIG. 10 for the first embodiment, and FIG. 44 for the third embodiment) and an unlocked lid position (see FIGS. 12, 13, and 14 for the first embodiment, and FIGS. 46, 47, and 51 for the third embodiment). When in the locked lid position, the latch 22 is locked to the bin 16. When in the unlocked lid position, the latch 22 is unlocked relative to the bin 16. The detent 24 acts between the bin 16 and the lid 18. Further, the detent 24 co-operates with the latch 22. In one respect, the detent 24 co-operates with the latch 22 so as to effect locking of the lid 18 to the bin 16 when the latch 22 is in the locked lid position. In another respect, the detent 24 co-operates with the latch 22 so as to permit movement of the lid 18, relative to the bin 16, from the closed position to the open position when the latch 22 is in the unlocked lid position relative to the bin.

The latch 22 is configured to move from the locked lid position (see FIG. 10 for the first embodiment, and FIG. 44 for the third embodiment) to the unlocked lid position (see FIG. 12 for the first embodiment, and FIG. 46 for the third embodiment) in response to an application of an unlocking force 500 to the handle 26. When the latch 22 is disposed in the unlocked lid position, and the lid 18 is disposed in the closed position, the lid 18 is configured to move from the closed position (see FIG. 12 for the first embodiment, and FIG. 46 for the third embodiment) to the open position (see FIG. 14 for the first embodiment, and FIG. 48 for the third embodiment) in response to an application of a lid-opening force 502 to the handle 26.

For example, with respect to the handle 26, the handle 26 is configured for grasping by a human operator and effecting translation of a force applied by the human operator into movement of the latch 22.

For example, the latch 22 includes a detent co-operator 106. When the latch 22 is disposed in the locked lid position, the detent co-operator 106 is disposed relative to the detent 24 such that the detent 24 interferes with movement of the detent co-operator 106 along a vertical axis and thereby resists movement of the lid 18 from the closed position to the open position. For example, with respect to the detent 24, the rim 28 includes a slot 202 configured to receive the detent co-operator 106 when the latch 22 is disposed in the locked lid position in order to enable the detent co-operator to be disposed relative to the detent 24 such that the detent 24 interferes with movement of the detent co-operator 106 along a vertical axis and thereby resists movement of the lid 18 from the closed position to the open position.

For example, when the latch 22 is coupled to the lid 18 and the detent 24 is disposed on the bin 16, in order to facilitate co-operation between the latch 22 and the detent 24 so as to facilitate locking and unlocking of the lid 18 relative to the bin 16, the lid 18 includes a detent receiving slot or aperture 142 through which extends the detent 24 of the bin 16 (see FIGS. 23, 24, 27, 28, and 29 for the first embodiment, and FIGS. 57, 58, 61, 62 and 63 for the third embodiment).

(A) Refuse Container with Latch Mechanism which Requires Seperate Actions to Effect Unlocking and Opening of Lid Referring in particular to FIGS. 10, 12, 13, and 14 for the first embodiment and FIGS. 44, 46, 47, and 51 for the third embodiment, in one aspect, there is provided a refuse container 10, as described above, wherein the latch 22 requires separate actions to effect unlocking and opening of lid 18.

In this respect, there is provided the refuse container 10 including a container assembly and a locking mechanism.

The container assembly includes the bin 16 and the lid 18. The bin 16 defines the cavity 20. The lid is rotatably coupled to the bin 16, and configured for movement, relative to the bin 16, between an open position providing access to the cavity 20 and a closed position inhibiting access to the cavity 20.

The locking mechanism includes the latch 22 and the detent 24. The latch 22 includes the handle 26, and is moveable between a locked lid position and an unlocked lid position. The detent 24 acts between the bin 16 and the lid 18. The detent 24 co-operates with the latch 24 so as to effect locking of the lid 18 to the bin 16 when the latch 22 is in the locked lid position, and permit movement of the lid 18, relative to the bin 16, from the closed position to the open position when the latch 22 is in the unlocked lid position.

The latch 22 is configured to move from the locked lid position to the unlocked lid position in response to application of an unlocking force to the handle 26. When the latch 22 is disposed in the unlocked lid position and the lid 18 is disposed in the closed position, the lid 18 is configured to move from the closed position to the open position in response to an application of a lid-opening force to the handle 26.

In one configuration, the unlocking force includes a horizontal component and a vertical component, and the lid-opening force includes a horizontal component and a vertical component. The direction of the horizontal component of the lid-opening force is disposed at an angle of between about 90 degrees and about 270 degrees in a clockwise direction about a vertical axis and relative to the direction of the horizontal component of the unlocking force.

In another configuration, the unlocking force includes a horizontal component and a vertical component, and the lid-opening force includes a horizontal component and a vertical component. The direction of the horizontal component of the lid-opening force is substantially opposite to the direction of the horizontal component of the unlocking force.

In yet another configuration, the unlocking force effects rotation of the latch 22 in one of a clockwise or counter clockwise direction, and the lid-opening force effects rotation of the latch 22 in the other one of a clockwise or a counter clockwise direction relative to the same frame of reference as the direction of the unlocking force.

For example, in moving from the locked lid position to the unlocked lid position, the latch 22 rotates, relative to the container assembly, about a latch rotation axis 80. The latch rotation axis 80 and the longitudinal axis 82 of the detent 24 are substantially co-located (see FIGS. 11, 12, and 13 for the first embodiment, and FIGS. 45, 46, and 47 for the third embodiment). For example, the latch 22 includes the pair of pins 66, 68 disposed on opposite sides of the latch 22, wherein the axis joining the pins 66, 68 is substantially co-located with the axis 82 of the detent. Each one of the pins 66, 68 is received within a respective one of latch apertures 70, 72 provided in the surface of the container assembly 12. In this respect, the latch 22 is snap-fit into the latch apertures 70, 72.

For example, when the latch 22 is disposed in the locked lid position, the latch 22 is disposed in a cavity 84 provided in the container assembly. For example, the latch 22 is coupled to the lid 18, and the cavity 84 is provided in the lid 18, and the detent is disposed on the bin 16 (see FIGS. 23, 25, 27, and 29 for the first embodiment, and FIGS. 57, 59, 61, and 63 for the third embodiment).

For example, the cavity 84 includes a recessed surface which functions as a seating surface 86, and when the latch 22 is disposed in the locked lid position, the latch 22 is seated or supported on the seating surface 86. For example, with respect to the coupling of the latch 22 to the lid 18, the latch 22 includes the pair of pins 66, 68 disposed on opposite sides of the latch 22. Each one of the pins 66, 68 is received within a respective one of the latch apertures 70, 72 provided in a surface of the cavity 84. In this respect, the latch 22 is snap-fit into the latch apertures 70, 72 of the cavity 84, and thereby effecting rotatable coupling of the latch 22 to the lid 18. To assist in retaining coupling of the latch 22 within the cavity 84, the lid 18 includes latch retainer 129. The latch retainer 129 co-operates with the latch 22 for limiting or interfering with displacement of the latch 22 along the axis 134 extending through the latch apertures 70, 72.

In this respect, the latch 22 is slotted such that the latch 99 receives the latch retainer 129 (see FIGS. 23 and 27 for the first embodiment, and FIGS. 57 and 61 for the third embodiment) and the latch retainer 129 thereby limits or interferes with displacement of the latch 22 along the axis 134 extending through the latch apertures 70, 72.

Referring to FIGS. 16, 27, 29, and 31 for the first embodiment and FIGS. 50, 61, 63, and 65 for the third embodiment, for example, the latch retainer 129 includes latch retainer tabs 130, 132, and the latch 22 includes slots 136, 138, wherein each of the slots 136, 138 receives a respect one of the latch retainer tabs 130, 132 for limiting or interfering with displacement of the latch 22 along the axis 134 extending through the latch apertures 70, 72. To spatially accommodate the latch retainer tabs 130, 132, the detent receiving aperture 142 is disposed between the latch retainer tabs 130, 132, and the detent co-operator 106 is also disposed between the latch retainer tabs 130, 132, thereby permitting assumption of the locked and the unlocked lid positions by the latch 22.

Referring to FIGS. 11, 12, 13, 16, and 17 for the first embodiment and FIGS. 45, 46, 47, 50, and 51 for the third embodiment, for example, the latch 22 includes the detent co-operator 106. When the latch 22 is disposed in the locked lid position, the detent co-operator 106 is disposed relative to the detent 24 such that the detent 24 interferes with movement of the detent co-operator 106 along a vertical axis and thereby resists movement of the lid 18 from the closed position to the open position.

For example, when the latch 22 is coupled to the lid 18 and the detent 24 is disposed on the bin 16, in order to facilitate co-operation between the latch 22 and the detent 24 so as to facilitate locking and unlocking of the lid 18 relative to the bin 16, the lid 18 includes the detent receiving slot or aperture 142 through which extends the detent 24 of the bin 16 (see FIGS. 23, 24, 27, 28, and 29 for the first embodiment, and FIGS. 57, 58, 61, 62, and 63 for the third embodiment).

For example, when the latch 22 is disposed in the unlocked lid position and the lid 18 is disposed in the closed position, the latch 22 is moveable to an unlocked indication position (see FIG. 13 for the first embodiment, and FIG. 47 for the third embodiment) wherein the latch 22 is locked to the container assembly 12 such that the latch 22 extends peripherally of the container assembly 12 and thereby provides a visual indication that the latch 22 is in the unlocked lid position.

For example, the latch 22 extends vertically above the container assembly 12 when disposed in the unlocked indication position. For example, when disposed in the unlocked indication position, the latch 22 extends beyond the perimeter of the container assembly 12 by at least two (2) inches.

For example, when disposed in the unlocked indication position, the latch 22 extends beyond the perimeter of the container assembly 12 by at least foul (4) inches.

For example, when disposed in the unlocked indication position, the latch 22 presents a side surface area of at least four (4) square inches.

For example, the presented side surface area is eight (8) square inches.

For example, the container assembly 12 is configured to define a latch receiving slotted surface 102 configured for receiving the latch 22 in an interference fit relationship when the latch 22 assumes the unlocked indication position.

For example, the latch 22 is coupled to the lid 18, and the lid is configured to define the latch receiving slotted surface 102.

Figure 27:
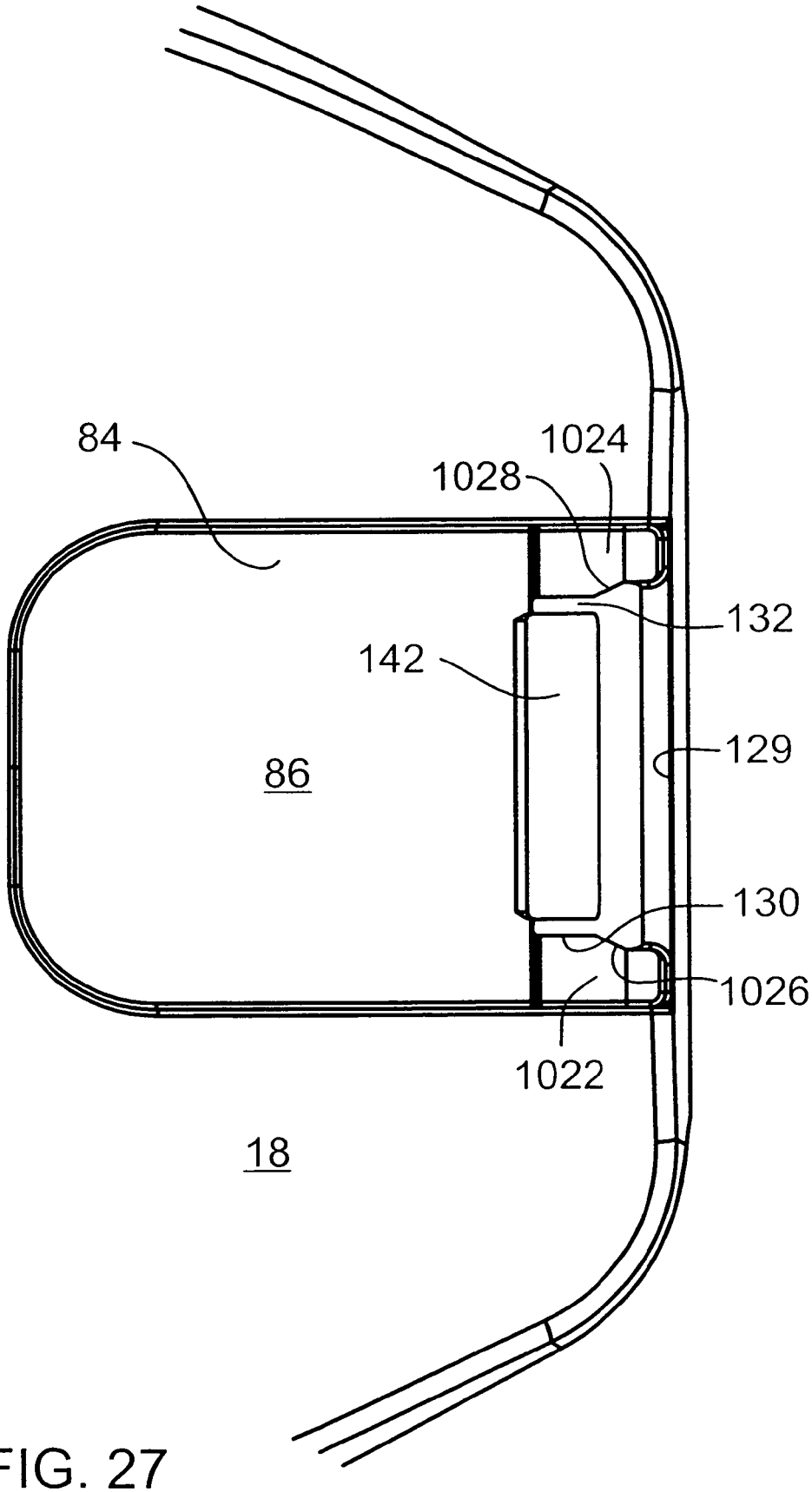
FIG. 27 is a top plan view of a front detail of the lid of the container in FIG. 1.
Figure 61:
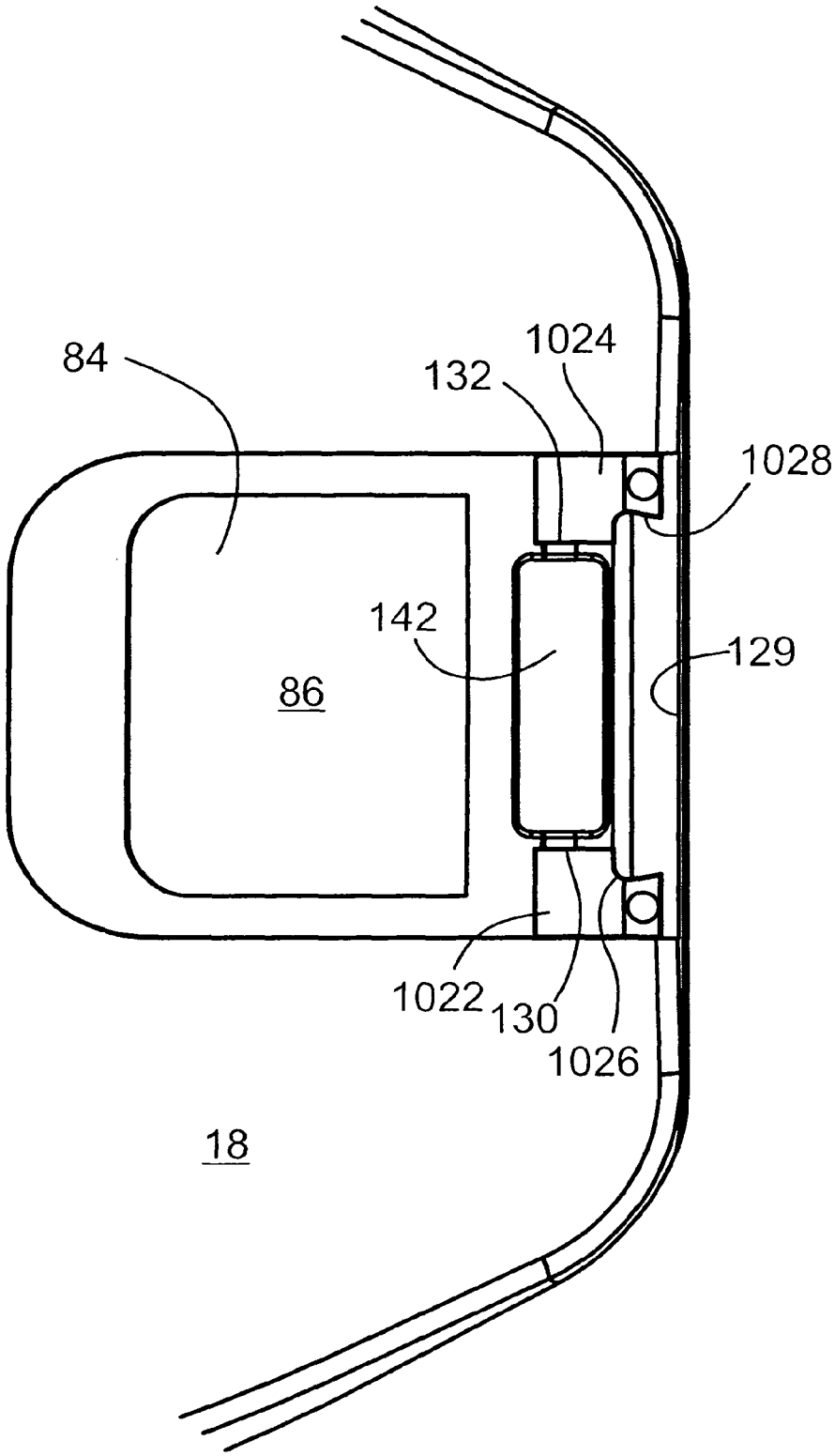
FIG. 61 is a top plan view of a front detail of the lid of the container in FIG. 35.

Referring to FIG. 27 for the first embodiment and FIG. 61 for the third embodiment, for example, the latch receiving slotted surface 102 includes a pair of latch receiving slots 1022, 1024. Each one of the slots 1022, 1024 is defined in part by a respective one of leading wedges 1026, 1028. As the latch 22 enters each one of the slots 1022, 1024, the latch 22 engages each one of the leading wedges 1026, 1028 which urge the latch 22 into all interference fit relationship with a respective one of narrow channels 1030, 1032.

Figure 11:
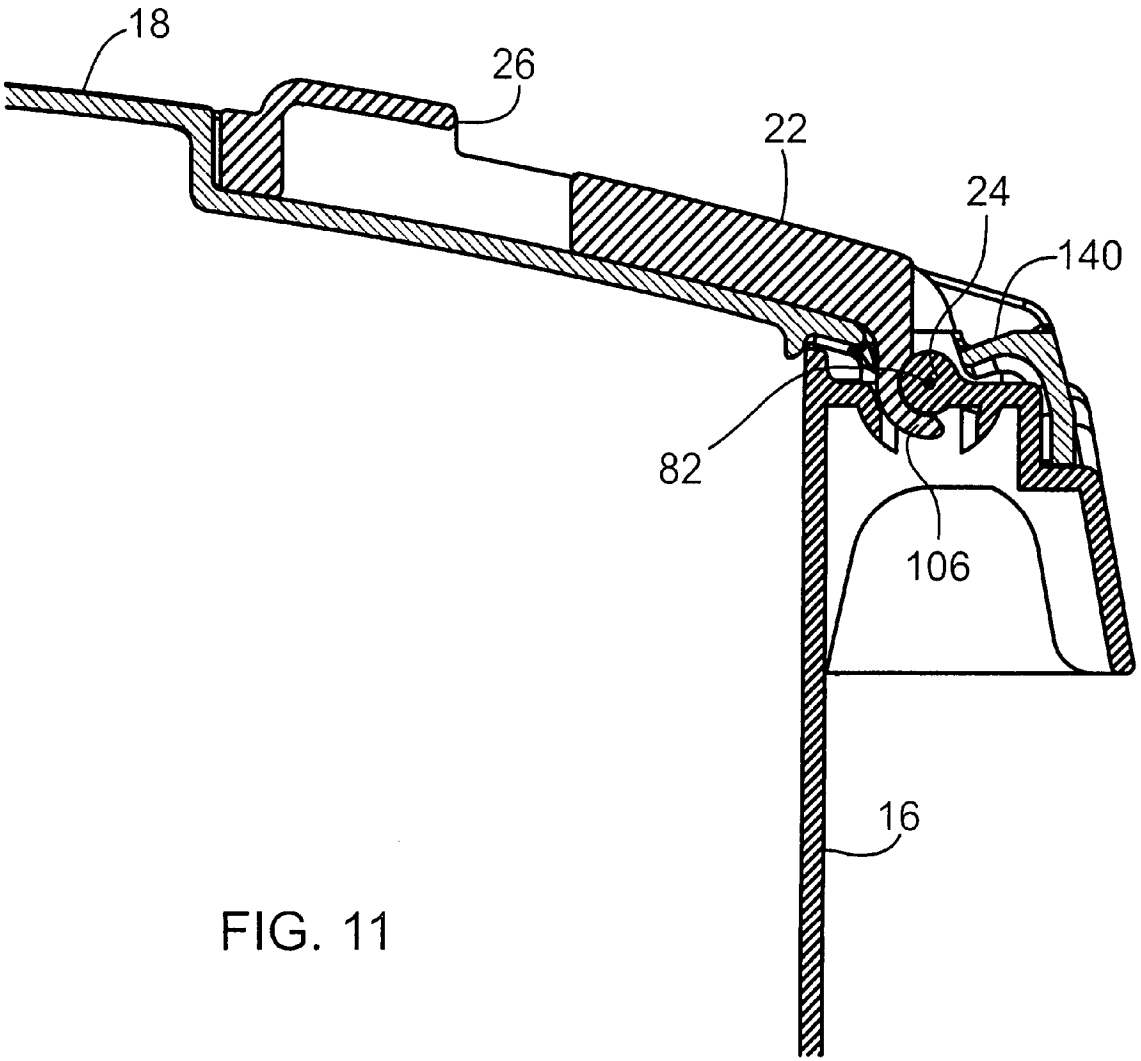
FIG. 11 is front detail of the sectional side elevation view in FIG. 10.
Figure 45:
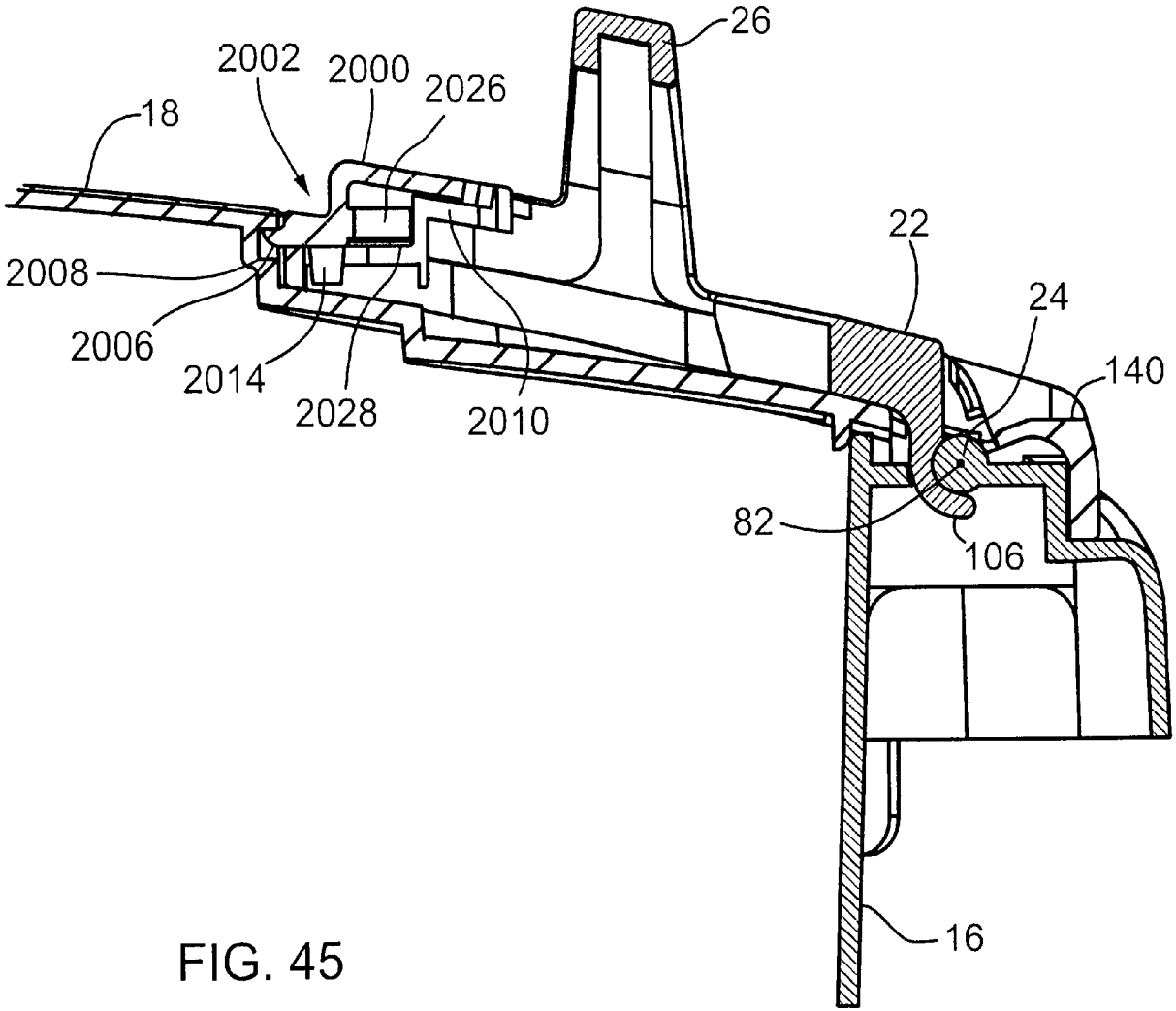
FIG. 45 is front detail of the sectional side elevation view in FIG. 44.

For example, the lid 18 includes a stop 140 to interfere with movement of the latch 22 further past the receiving slots 1022, 1024 (see FIGS. 11, 12, and 13 for the first embodiment, and FIGS. 45, 46, and 47 for the third embodiment).

For example, each one of the latch retainer tabs 130, 132 assists in defining a respective one of the slots 1022, 1024.

(B) Refuse Container with Latch Which Rotates About an Axis Which is Substantially Co-located with Detent Axis Referring to FIGS. 11, 12, and 13 for the first embodiment and FIGS. 45, 46, and 47 for the third embodiment, in another aspect, there is provided a refuse container 10, as described above, wherein the latch 22 is configured to rotate about an axis 80 which is substantially co-located with the longitudinal axis 82 of the detent 24.

In this respect, there is provided the refuse container 10 including a container assembly and a locking mechanism.

The container assembly includes the bin 16 and the lid 18. the bin 16 defines the cavity 20. The lid is rotatably coupled to the bin 16, and configured for movement, relative to the bin 16, between an open position providing access to the cavity 20 and a closed position inhibiting access to the cavity 20.

The locking mechanism includes the latch 22 and the detent 24. The latch 22 includes the handle 26, and is moveable between a locked lid position and an unlocked lid position. The detent 24 acts between the bin 16 and the lid 18. The detent 24 co-operates with the latch 24 so as to effect locking of the lid 18 to the bin 16 when the latch 22 is in the locked lid position, and permit movement of the lid 18, relative to the bin 16, from the closed position to the open position when the latch 22 is in the unlocked lid position.

The latch 22 is configured to move from the locked lid position to the unlocked lid position in response to application of an unlocking force to the handle 26. When the latch 22 is disposed in the unlocked lid position and the lid 18 is disposed in the closed position, the lid 18 is configured to move from the closed position to the open position in response to an application of a lid-opening force to the handle 26.

In moving from the locked lid position to the unlocked lid position, the latch 22 rotates, relative to the container assembly, about the latch rotation axis 80. The latch rotation axis 80 and the longitudinal axis 82 of the detent 24 are substantially co-located. For example, the latch 22 includes the pair of pins 66, 68 disposed on opposite sides of the latch 22, wherein the axis joining the pins 66, 68 is substantially co-located with the axis 82 of the detent. Each one of the pins 66, 68 is received within a respective one of latch apertures 70, 72 provided in the surface of the container assembly 12. In this respect, the latch 22 is snap-fit into the latch apertures 70, 72.

(C) Refuse Container with Latch Seated in a Cavity when the Latch is in the Locked Lid Position Referring to FIGS. 1, 5, 6, 7, 8, 23, 25, 27, and 29 for the first embodiment and FIGS. 35, 39, 40, 41, 42, 57, 59, and 63 for the third embodiment, in another aspect, there is provided a refuse container 10, as described above, wherein, when the latch 22 is in the locked lid position, the latch 22 is seated in a cavity 84 provided within the container assembly 12.

In this respect, there is provided the refuse container 10 including a container assembly and a locking mechanism.

The container assembly includes the bin 16 and the lid 18. The bin 16 defines the cavity 20. The lid is rotatably coupled to the bin 16, and configured for movement, relative to the bin 16, between an open position providing access to the cavity 20 and a closed position inhibiting access to the cavity 20.

The locking mechanism includes the latch 22 and the detent 24. The latch 22 includes the handle 26, and is moveable between a locked lid position and an unlocked lid position. The detent 24 acts between the bin 16 and the lid 18. The detent 24 co-operates with the latch 24 so as to effect locking of the lid 18 to the bin 16 when the latch 22 is in the locked lid position, and permit movement of the lid 18, relative to the bin 16, from the closed position to the open position when the latch 22 is in the unlocked lid position.

The latch 22 is configured to move from the locked lid position to the unlocked lid position in response to application of an unlocking force to the handle 26. When the latch 22 is disposed in the unlocked lid position and the lid 18 is disposed in the closed position, the lid 18 is configured to move from the closed position to the open position in response to an application of a lid-opening force to the handle 26.

When the latch 22 is disposed in the locked lid position, the latch 22 is disposed in the cavity 84 provided in the container assembly 12. For example, when the latch 22 is disposed in the locked lid position, at least a portion of the latch 22 is substantially flush with respect to adjacent surfaces of the container assembly 12.

For example, the latch 22 is coupled to the lid 18, and the cavity 84 is provided in the lid 18, and the detent 24 is disposed on the bin 16. For example, the cavity 84 includes the recessed surface which functions as the seating surface 86, and when the latch 22 is disposed in the locked lid position, the latch 22 is seated or supported on the seating surface 86. In order to effect co-operation between the latch 22 and the detent 24 to facilitate locking and unlocking of the lid 18 relative to the bin 16, the lid 18 includes the detent receiving aperture 142 through which extends the detent 24 of the bin 16. For example, the latch 22 includes the detent co-operator 106. When the latch 22 is disposed in the locked lid position, the detent co-operator 106 is disposed relative to the detent 24 such that the detent 24 interferes with movement of the detent co-operator 106 along a vertical axis and thereby resists movement of the lid 18 from the closed position to the open position.

Referring to FIGS. 15, 16, 17, 23, 27, 29 and 31 for the first embodiment and FIGS. 49, 50, 51, 57, 61, 63, and 65 for the third embodiment, to assist in retaining coupling of the latch 22 within the cavity 84, the lid 18 includes the latch retainer 129. The latch retainer 129 co-operates with the latch 22 for limiting or interfering with displacement of the latch 22 along the axis 134 extending through the latch apertures 70, 72. In this respect, the latch 22 is slotted such that the latch 22 receives the latch retainer 129 and the latch retainer 129 thereby limits or interferes with displacement of the latch 22 along the axis 134 extending through the latch apertures 70, 72. For example, the latch retainer 129 includes the latch retainer tabs 130, 132, and the latch 22 includes the slots 136, 138, wherein each of the slots 136, 138 receives a respect one of the latch retainer tabs 130, 132 for limiting or interfering with displacement of the latch 22 along the axis 134 extending through the latch apertures 70, 72. To spatially accommodate the latch retainer tabs 130, 132, the detent receiving aperture 142 is disposed between the latch retainer tabs 130, 132, and the detent co-operator 106 is also disposed between the latch retainer tabs 130, 132, thereby permitting assumption of the locked and the unlocked lid positions by the latch 22.

(D) Refuse Container with Latch which is Moveable into an Unlocked Indication Position Referring to FIG. 13 in the first embodiment and FIG. 47 for the third embodiment, in another aspect, there is provided a refuse container 10, as described above, wherein the latch 22 is moveable into an unlocked indication position.

In this respect, there is provided the refuse container 10 including a container assembly and a locking mechanism.

The container assembly includes the bin 16 and the lid 18. The bin 16 defines the cavity 20. The lid is rotatably coupled to the bin 16, and configured for movement, relative to the bin 16, between an open position providing access to the cavity 20 and a closed position inhibiting access to the cavity 20.

The locking mechanism includes the latch 22 and the detent 24. The latch 22 includes the handle 26, and is moveable between a locked lid position and an unlocked lid position. The detent 24 acts between the bin 16 and the lid 18. The detent 24 co-operates with the latch 24 so as to effect locking of the lid 18 to the bin 16 when the latch 22 is in the locked lid position, and permit movement of the lid 18, relative to the bin 16, from the closed position to the open position when the latch 22 is in the unlocked lid position.

The latch 22 is configured to move from the locked lid position to the unlocked lid position in response to application of an unlocking force to the handle 26. When the latch 22 is disposed in the unlocked lid position and the lid 18 is disposed in the closed position, the lid 18 is configured to move from the closed position to the open position in response to an application of a lid-opening force to the handle 26.

When the latch 22 is disposed in the unlocked lid position and the lid 18 is disposed in the closed position, the latch 22 is moveable to the unlocked indication position wherein the latch 22 is locked to the container assembly 12 such that the latch 22 extends peripherally of the container assembly 12 and thereby provides a visual indication that the latch 22 is in the unlocked lid position. For example, the latch 22 extends vertically above the container assembly 12 when disposed in the unlocked indication position. For example, when disposed in the unlocked indication position, the latch 22 extends beyond the perimeter of the container assembly 12 by at least two (2) inches. For example, when disposed in the unlocked indication position, the latch 22 extends beyond the perimeter of the container assembly 12 by at least four (4) inches. For example, when disposed in the unlocked indication position, the latch 22 presents a side surface area of at least four (4) square inches. For example, the presented side surface area is eight (8) square inches.

For example, the container assembly 12 is configured to define the latch receiving slotted surface 102 configured for receiving the latch 22 in an interference fit relationship when the latch 22 assumes the unlocked indication position.

Referring to FIG. 27 in the first embodiment and FIG. 61 for the third embodiment, for example, the latch 22 is coupled to the lid 18, and the lid is configured to define the latch receiving slotted surface 102. For example, the latch receiving slotted surface 102 includes the pair of latch receiving slots 1022, 1024. Each one of the slots 1022, 1024 is defined in part by the respective one of leading wedges 1026, 1028. As the latch 22 enters each one of the slots 1022, 1024, the latch 22 engages each one of the leading wedges 1026, 1028 which urge the latch 22 into an interference fit relationship with a respective one of narrow channels 1030, 1032. The lid includes the stop 140 to interfere with movement of the latch further past the receiving slots 1022, 1024. For example, each one of the latch retainer tabs 130, 132 assists in defining a respective one of the slots 1022, 1024.

(E) Refuse Container with Detent Disposed so as to Mitigate Interference with Discharge of Contents from Cavity In another aspect, there is provided a refuse container 10, as described above, wherein the detent is disposed so as to mitigate interference with the discharge of contents from the cavity 20.

In this respect, there is provided the refuse container 10 including the container assembly 12 and the locking mechanism 14.

Figure 18:
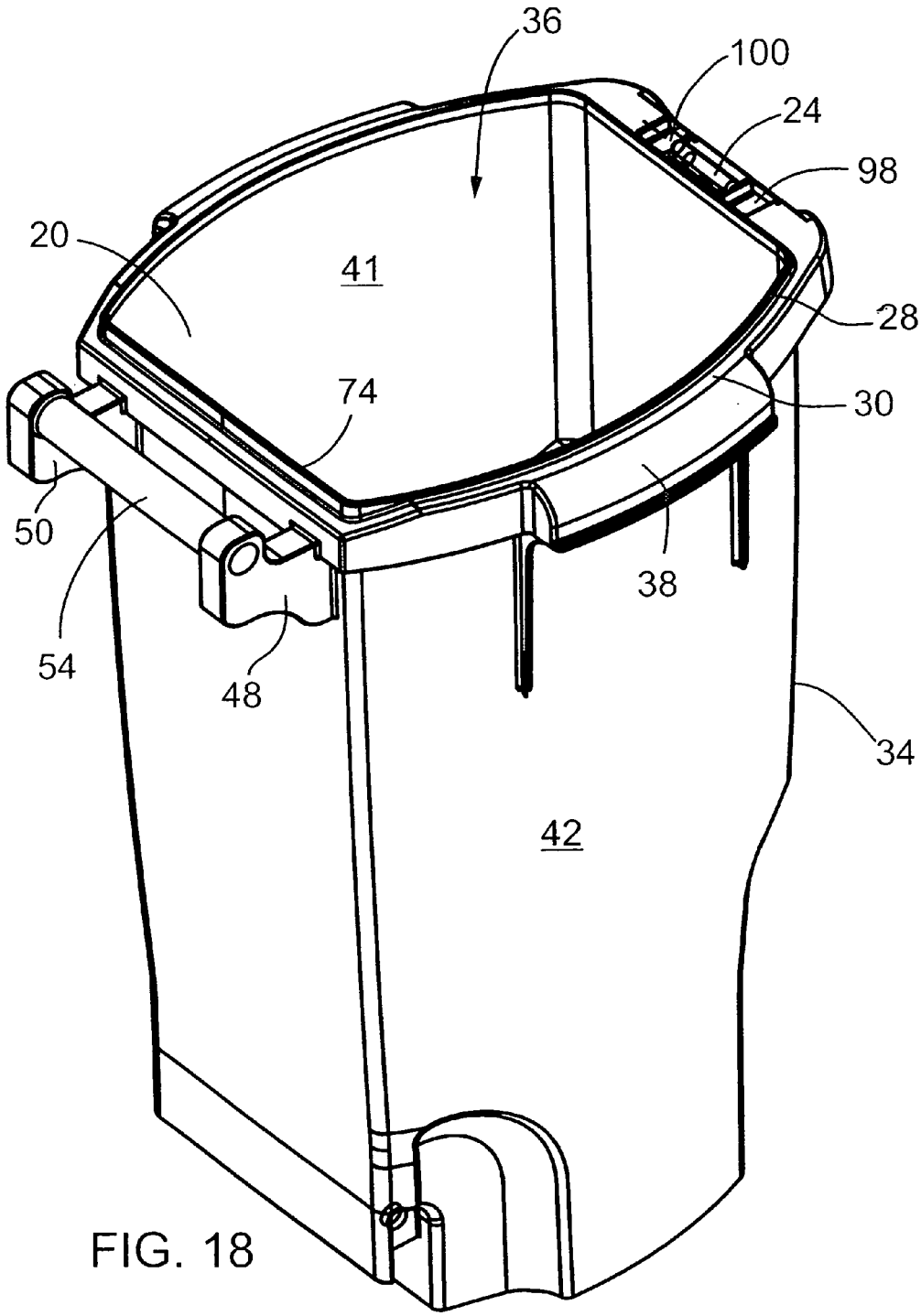
FIG. 18 is a top perspective view of the bin of the container in FIG. 1, taken from the rear.
Figure 20:
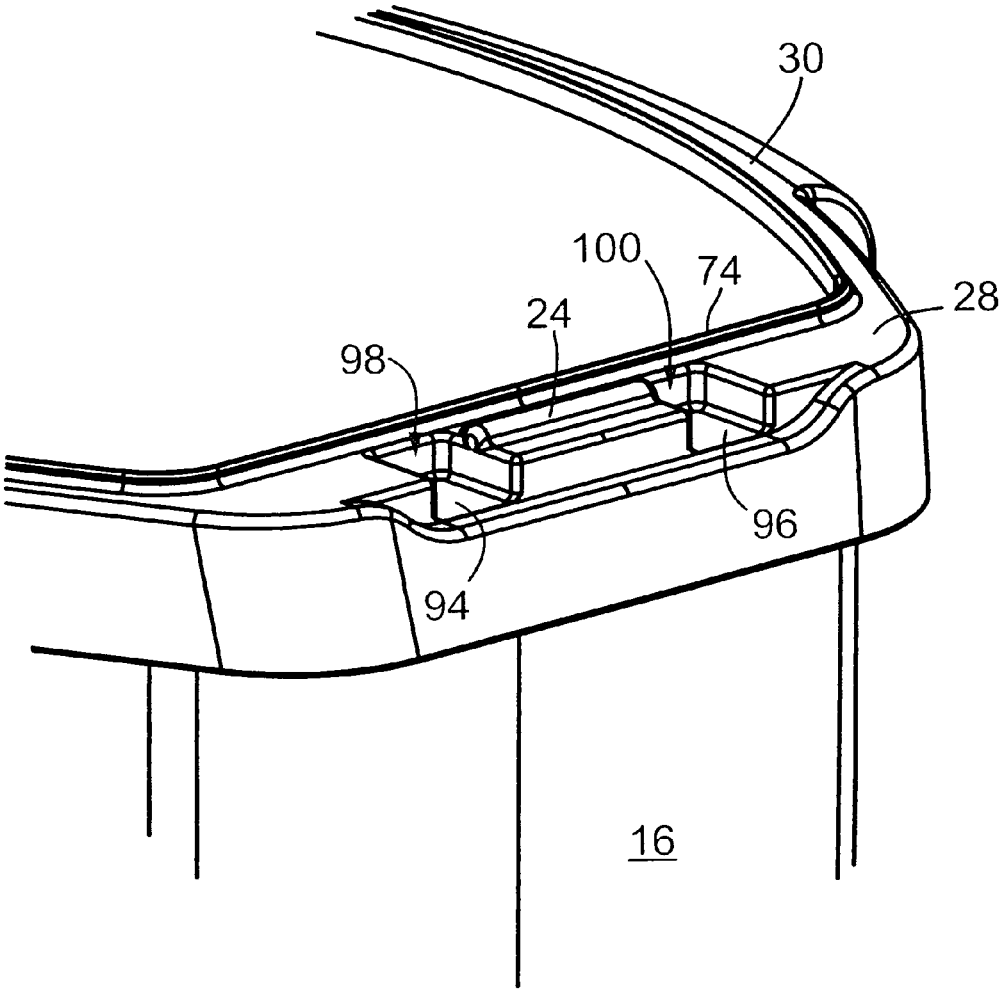
FIG. 20 is a top perspective view of a front detail of the bin of the container in FIG. 1, taken from the front.
Figure 52:
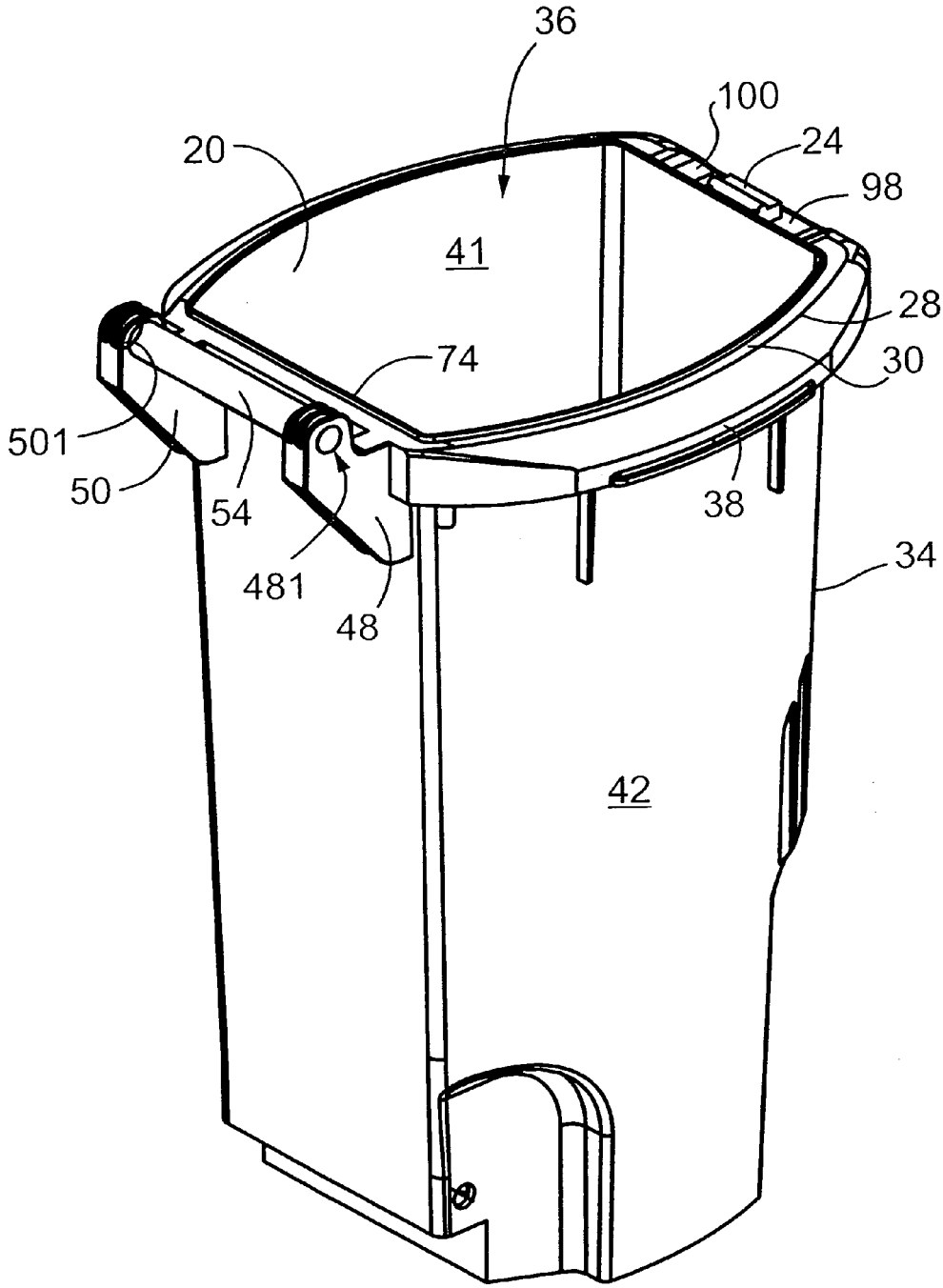
FIG. 52 is a top perspective view of the bin of the container in FIG. 35, taken from the rear.
Figure 54:
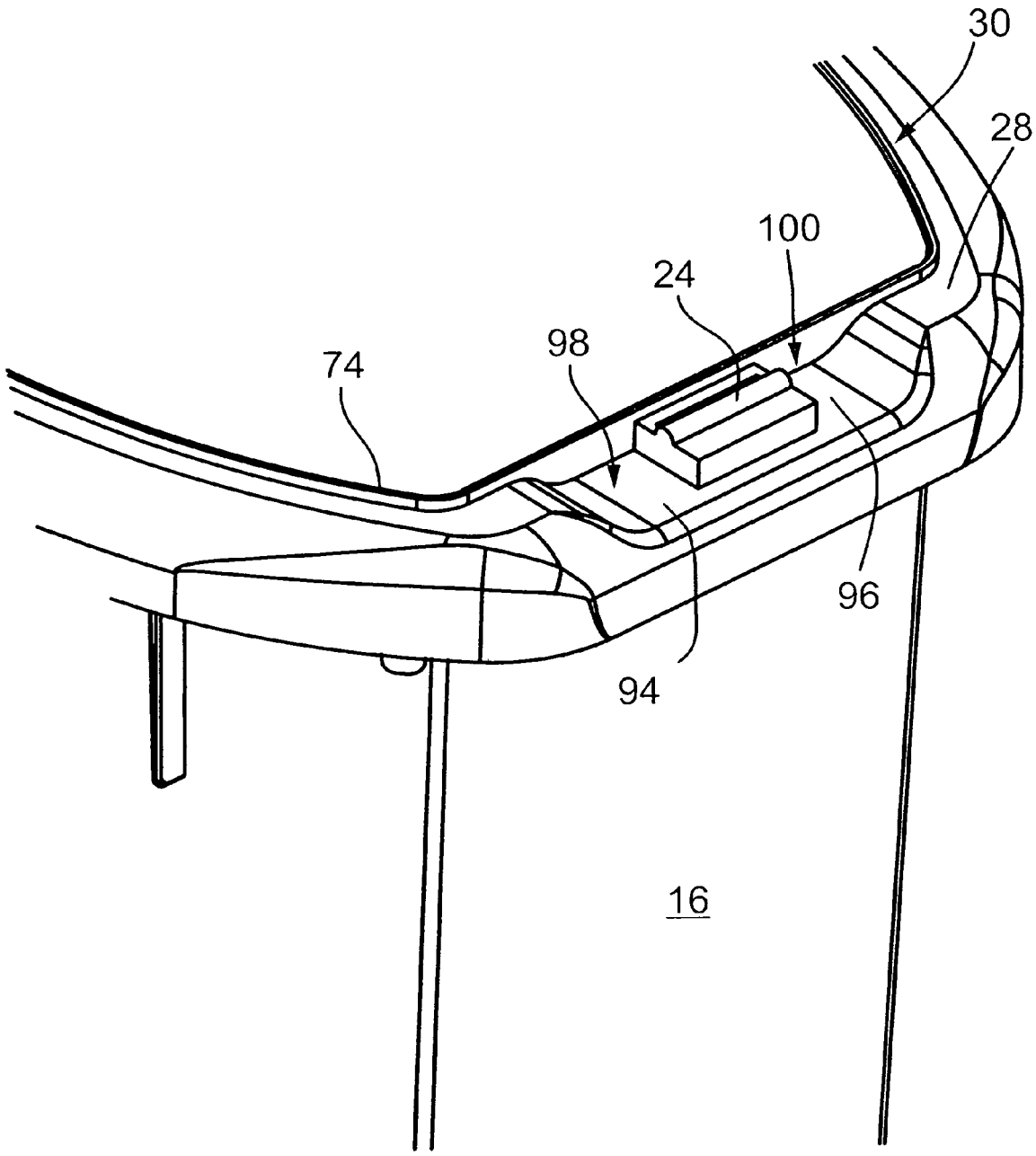
FIG. 54 is a top perspective view of a front detail of the bin of the container in FIG. 35, taken from the front.

Referring to FIGS. 18 and 20 for the first embodiment and FIGS. 52 and 54 for the third embodiment, the container assembly 12 includes the bin 16 and the lid 18. The bin 16 defines the cavity 20. The bin 16 also includes the lip 74 defining an opening to the cavity 20, and a rime 28 extending peripherally about tile lip 74. The lid 18 is rotatably coupled to the bin 16, and configured for movement, relative to the bin 16, between an open position providing access to the cavity 20 and a closed position inhibiting access to the cavity 20.

The locking mechanism 14 includes the latch 22 and the detent 24. The latch 22 is coupled to the lid 18. The latch 22 includes the handle 26, and is moveable between a locked lid position and an unlocked lid position. The detent 24 acts between the bin 16 and the lid 18. The detent 24 co-operates with the latch 24 so as to effect locking of the lid 18 to the bin 16 when the latch 22 is in the locked lid position, and permit movement of the lid 18, relative to the bin 16, from the closed position to the open position when the latch 22 is in the unlocked lid position. The detent 24 extends upwardly from the rim 28 and is disposed below the lip 74. For example, the detent 24 is disposed below the lip 74.

The latch 22 is configured to move from the locked lid position to the unlocked lid position in response to application of an unlocking force to the handle 26. When the latch 22 is disposed in the unlocked lid position and the lid 18 is disposed in the closed position, the lid 18 is configured to move from the closed position to the open position in response to an application of a lid-opening force to the handle 26.

(F) Refuse Container with Guard for Reducing Fouling of Locking Mechanism

In another aspect, there is provided a refuse container 10, as described above, wherein a fouling guard 104 is provided for reducing fouling of the locking mechanism 14.

In this respect, there is provided the refuse container 10 including a container assembly and a locking mechanism.

The container assembly includes the bin 16 and the lid 18. The bin 16 defines the cavity 20. The bin 16 also includes the lip 74 defining an opening to the cavity 20, and a rim 28 extending peripherally about the lip 74. The lid 18 is rotatably coupled to the bin 16, and configured for movement, relative to the bin 16, between an open position providing access to the cavity 20 and a closed position inhibiting access to the cavity 20.

The locking mechanism includes the latch 22 and the detent 24. The latch 22 includes the handle 26 and a detent co-operator 106, and is moveable between a locked lid position and an unlocked lid position. The latch 22 is coupled to the lid 18 The detent 24 acts between the bin 16 and the lid 18. The detent 24 co-operates with the latch 24 so as to effect locking of the lid 18 to the bin 16 when the latch 22 is in the locked lid position, and permit movement of the lid 18, relative to the bin 16, from the closed position to the open position when the latch 22 is in the unlocked lid position. The detent 24 extends upwardly from the rim 28.

The latch 22 is configured to move from the locked lid position to the unlocked lid position in response to application of an unlocking force to the handle 26. When the latch 22 is disposed in the unlocked lid position and the lid 18 is disposed in the closed position, the lid 18 is configured to move from the closed position to the open position in response to an application of a lid-opening force to the handle 26.

Figure 7:
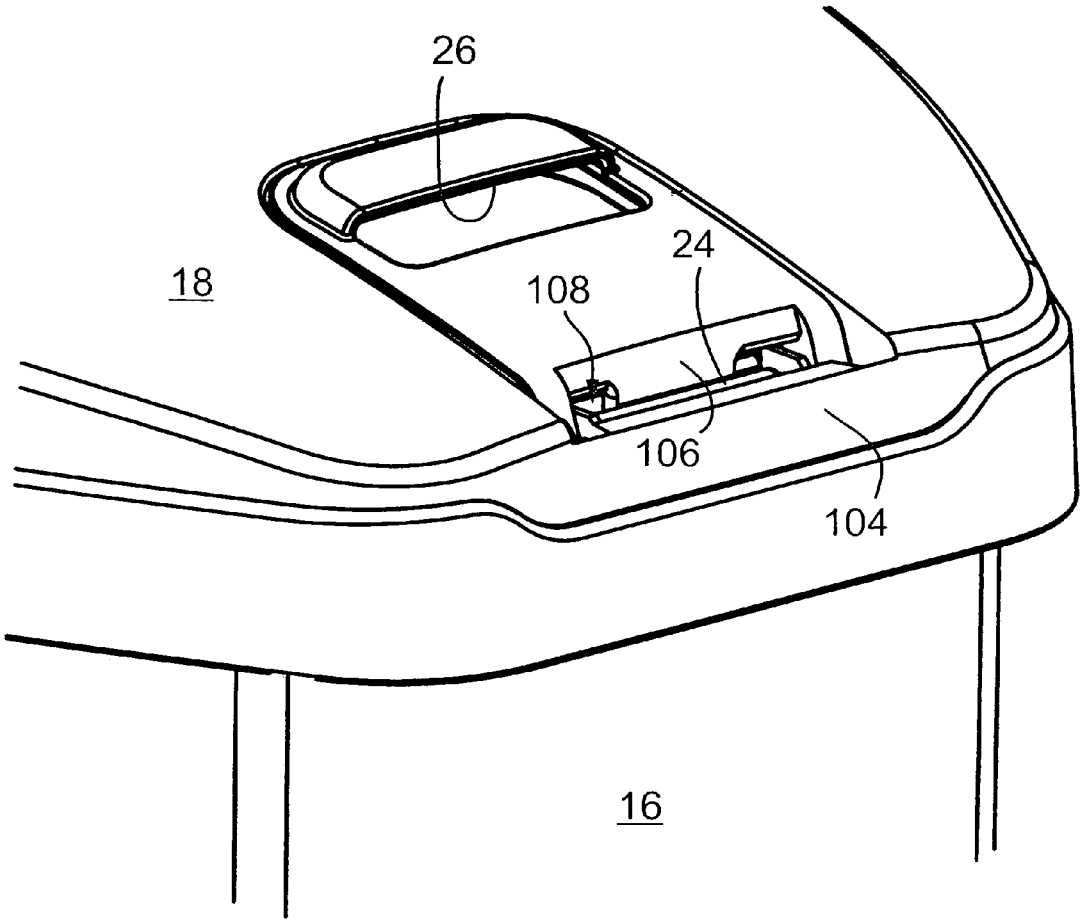
FIG. 7 is a top perspective view of a front detail of the container in FIG. 1, illustrating the latch in the locked lid position.
Figure 8:
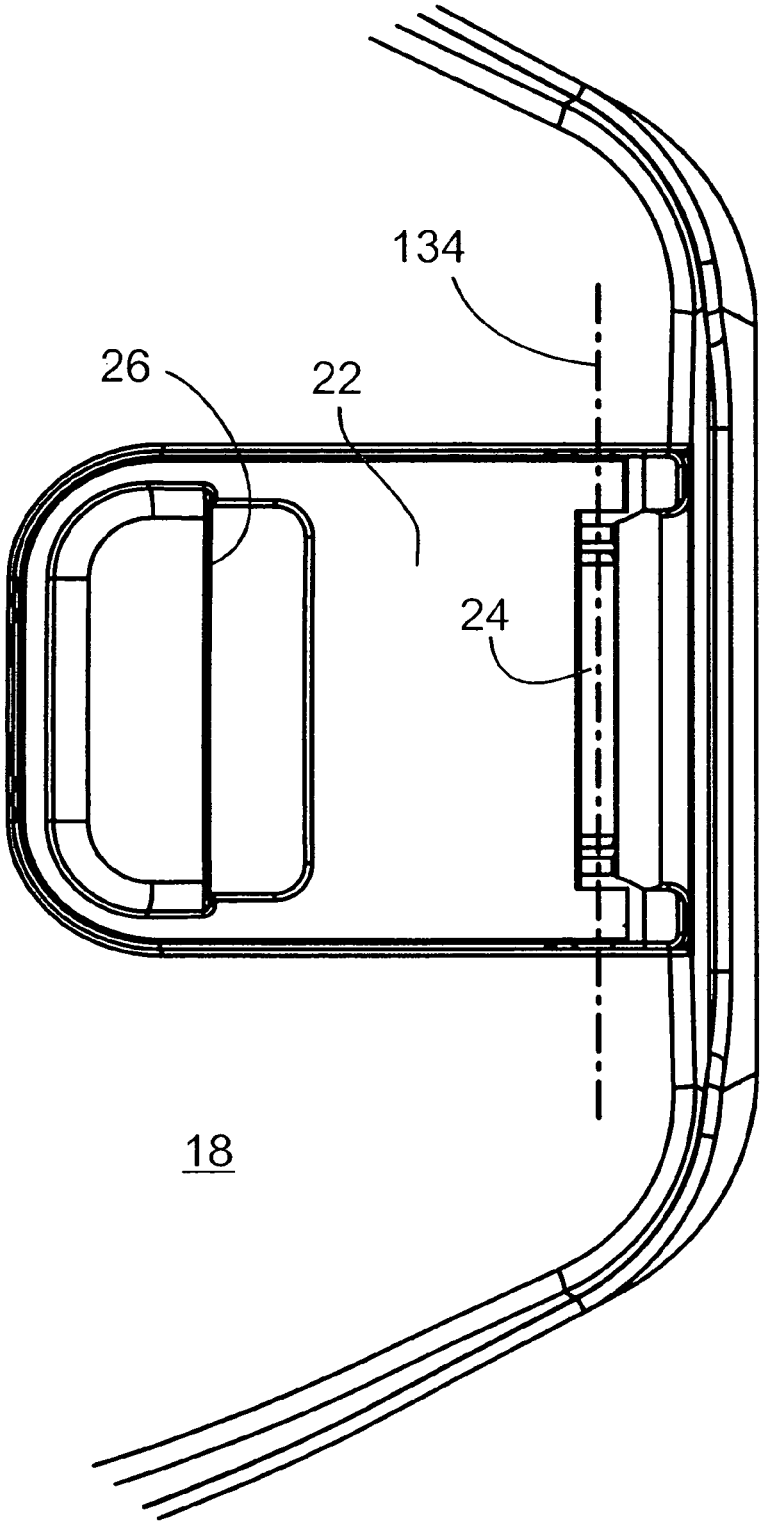
FIG. 8 is a top plan view of a front detail of the container in FIG. 1, illustrating the latch in the locked lid position.
Figure 9:
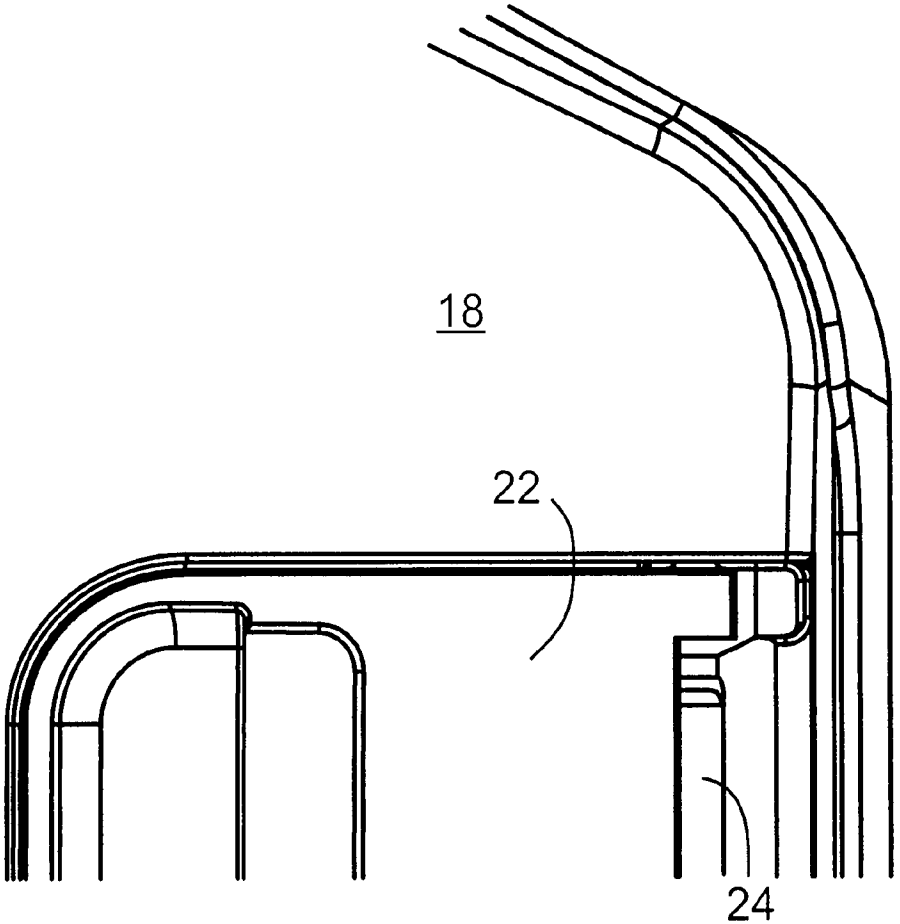
FIG. 9 is a further detail of the top plan view in FIG. 8.

When the latch 22 is disposed in the locked lid position, the detent co-operator 106 is disposed relative to the detent 24 such that the detent 24 interferes with movement of the detent co-operator 106 along a vertical axis and thereby resists movement of the lid 18 from the closed position to the open position. Referring to FIG. 7 in the first embodiment and FIG. 41 for the third embodiment, a potential fouling space 108 is defined between the detent co-operator 106 and the detent 24. The container assembly 12 includes a fouling guard 104 extending from the lid 18 and disposed between the detent 24 and the peripheral edge 1202 of the container assembly 12 and configured for reducing ingress of materials into the potential fouling space 108. The fouling guard 104 extends vertically above the detent 24.

(G) Refuse Container with Impact Guard for Blocking Physical Contact with the Locking Mechanism In another aspect, there is provided a refuse container 10, as described above, and including an impact guard 110 for blocking physical contact with the locking mechanism 114.

In this respect, there is provided the refuse container 10 including a container assembly and a locking mechanism.

The container assembly includes the bin 16 and the lid 18. The bin 16 defines the cavity 20. The lid is rotatably coupled to the bin 16, and configured for movement, relative to the bin 16, between an open position providing access to the cavity 20 and a closed position inhibiting access to the cavity 20.

The locking mechanism includes the latch 22 and the detent 24. The latch 22 includes the handle 26, and is moveable between a locked lid position and an unlocked lid position. The detent 24 acts between the bin 16 and the lid 18. The detent 24 co-operates with the latch 24 so as to effect locking of the lid 18 to the bin 16 when the latch 22 is in the locked lid position, and permit movement of the lid 18, relative to the bin 16, from the closed position to the open position when the latch 22 is in the unlocked lid position.

The latch 22 is configured to move from the locked lid position to the unlocked lid position in response to application of an unlocking force to the handle 26. When the latch 22 is disposed in the unlocked lid position and the lid 18 is disposed in the closed position, the lid 18 is configured to move from the closed position to the open position in response to an application of a lid-opening force to the handle 26.

Figure 19:
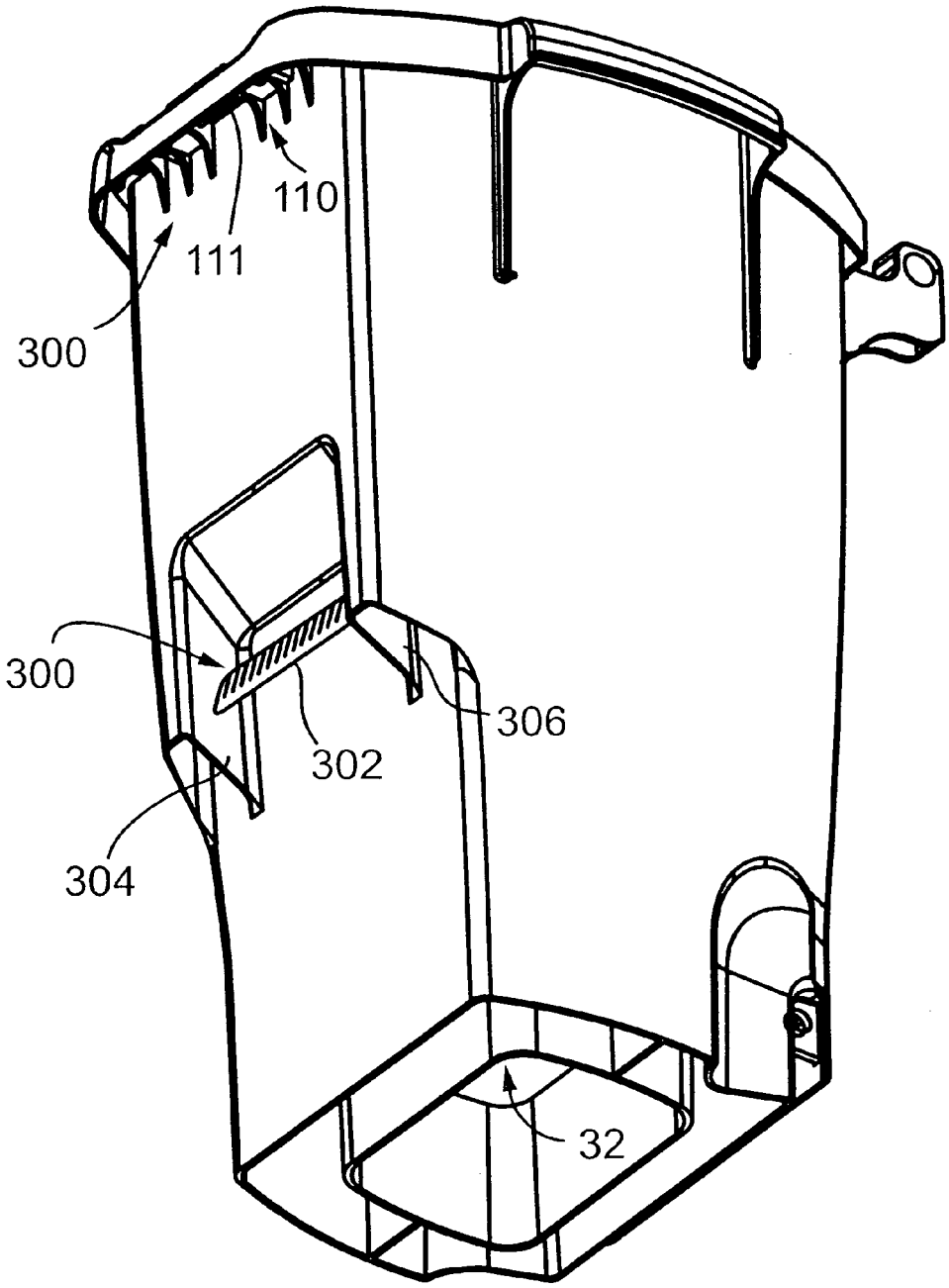
FIG. 19 is a bottom perspective view of the bin of the container in FIG. 1, taken from the front.

Referring to FIG. 19 for the first embodiment and FIG. 53 for the third embodiment, the container assembly 12 includes the impact guard 110 disposed below the locking mechanism 14 for blocking physical contact between the locking mechanism 14 an external object when the latch 22 is disposed in the locked lid position.

For example, the detent 24 extends from the rim 28 of the bin 16. Co-operatively, the latch 22 is coupled to the lid 18. In this respect, the impact guard 110 is disposed on the exterior surface 42 of the bin 16.

For example, the impact guard includes a lower surface 29 of the rim 28, and also includes a plurality of ribs 111 extending between and connecting the external surface 42 and the lower surface 29.

(H) Refuse Container with Lid Configured to Distribute Impact Force

In another aspect, there is provided a refuse container 10 with the lid 18 configured to distribute impact forces.

In this respect, there is provided the refuse container 10 including the bin 16 and the lid 18.

Figure 21:
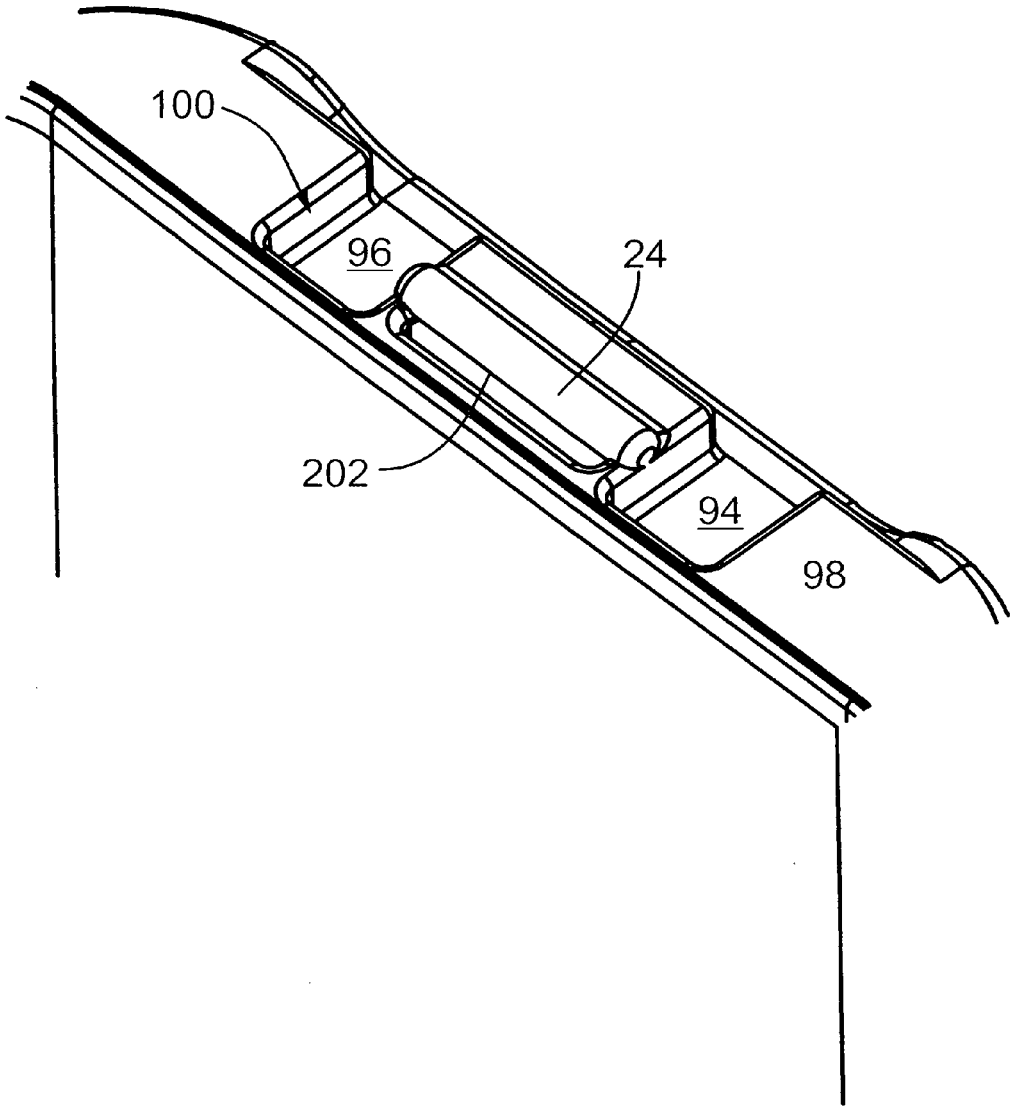
FIG. 21 is a top perspective view of a front detail of the bin of the container in FIG. 1, taken from the rear.
Figure 22:
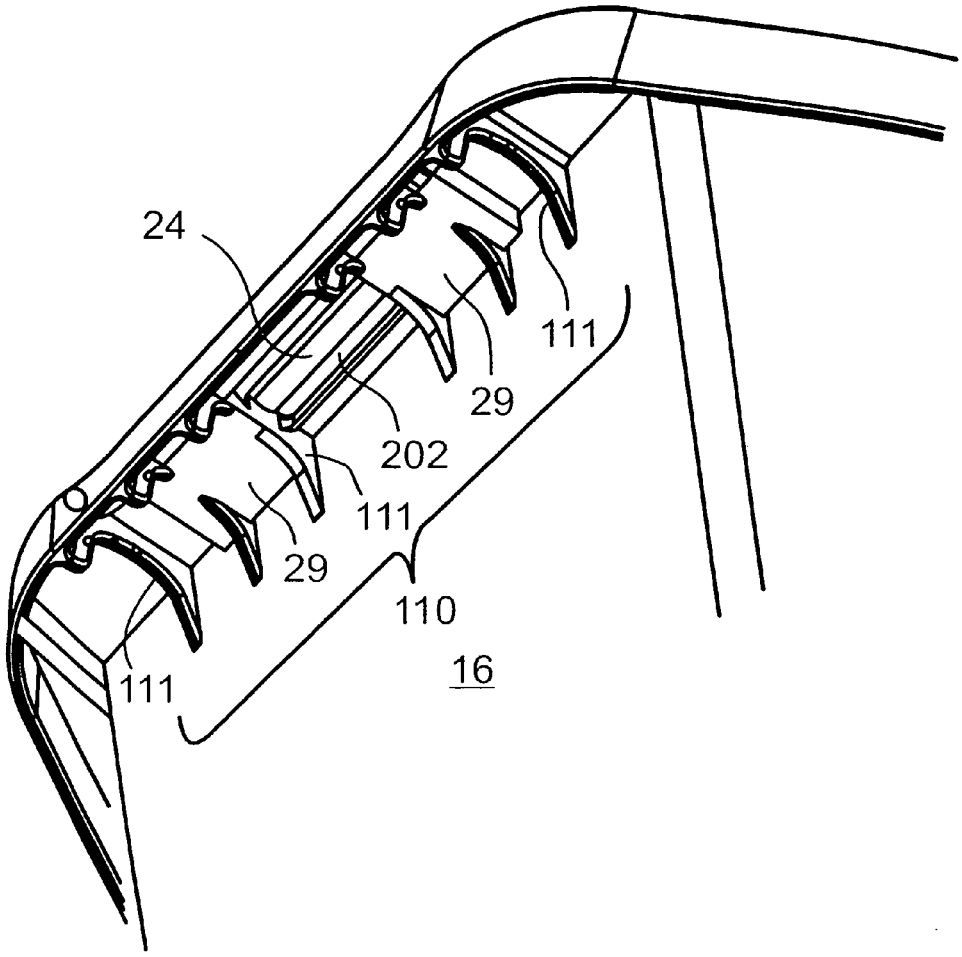
FIG. 22 is a bottom perspective view of a front detail of the bin of the container in FIG. 1, taken from the front.
Figure 23:
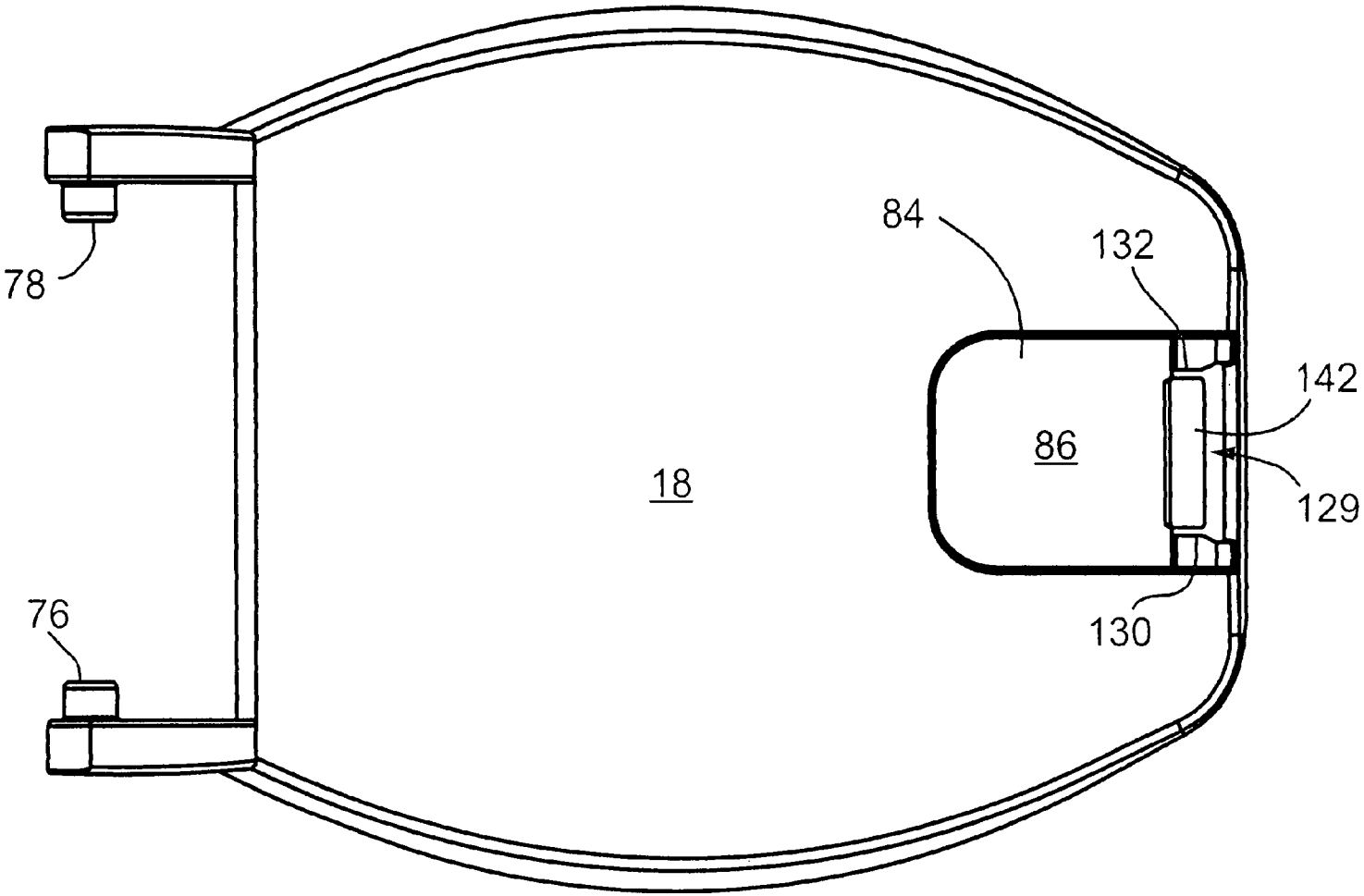
FIG. 23 is a top plan view of a lid of the container in FIG. 1.
Figure 55:
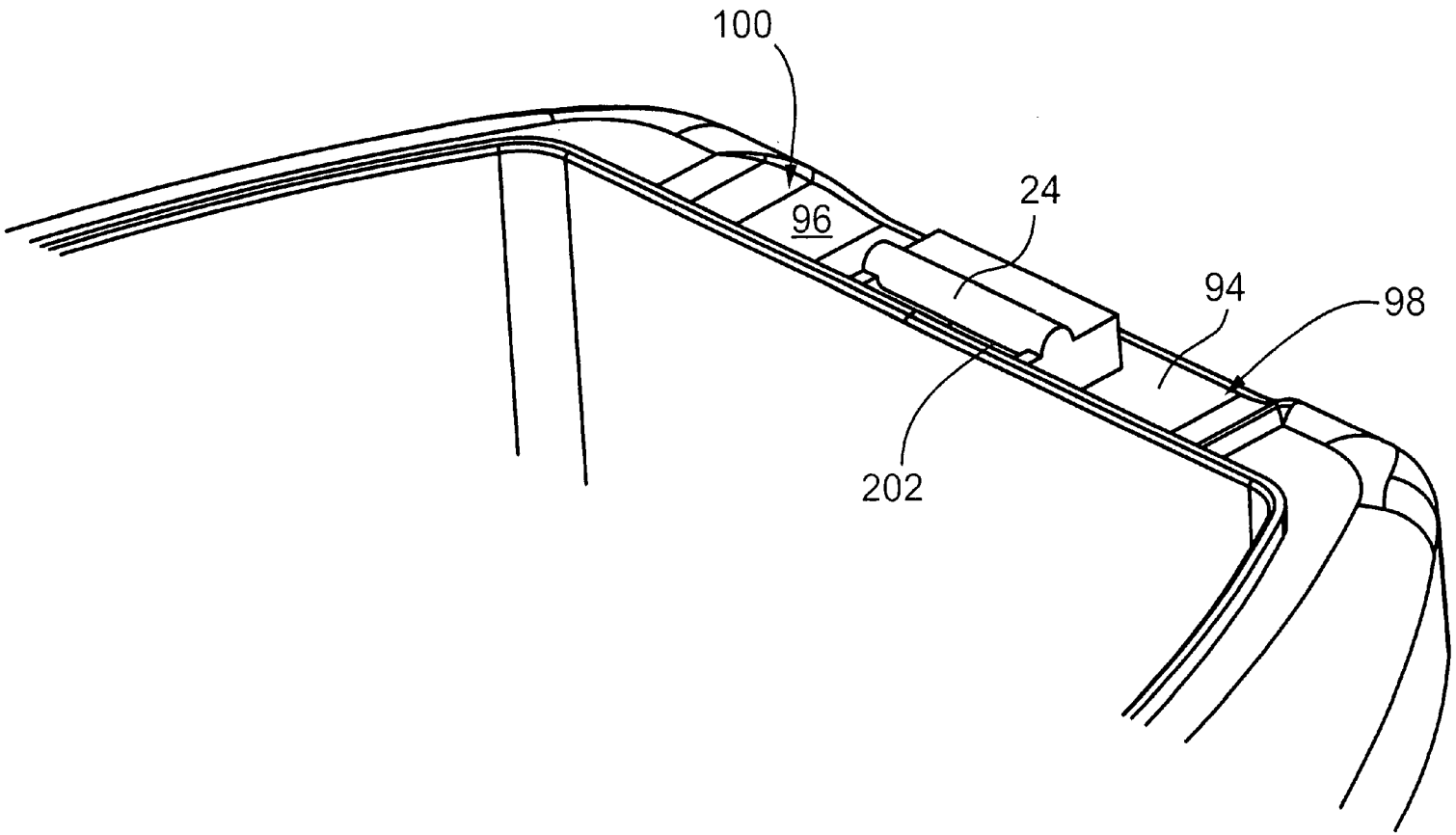
FIG. 55 is a top perspective view of a front detail of the bin of the container in FIG. 35, taken from the rear.
Figure 56:
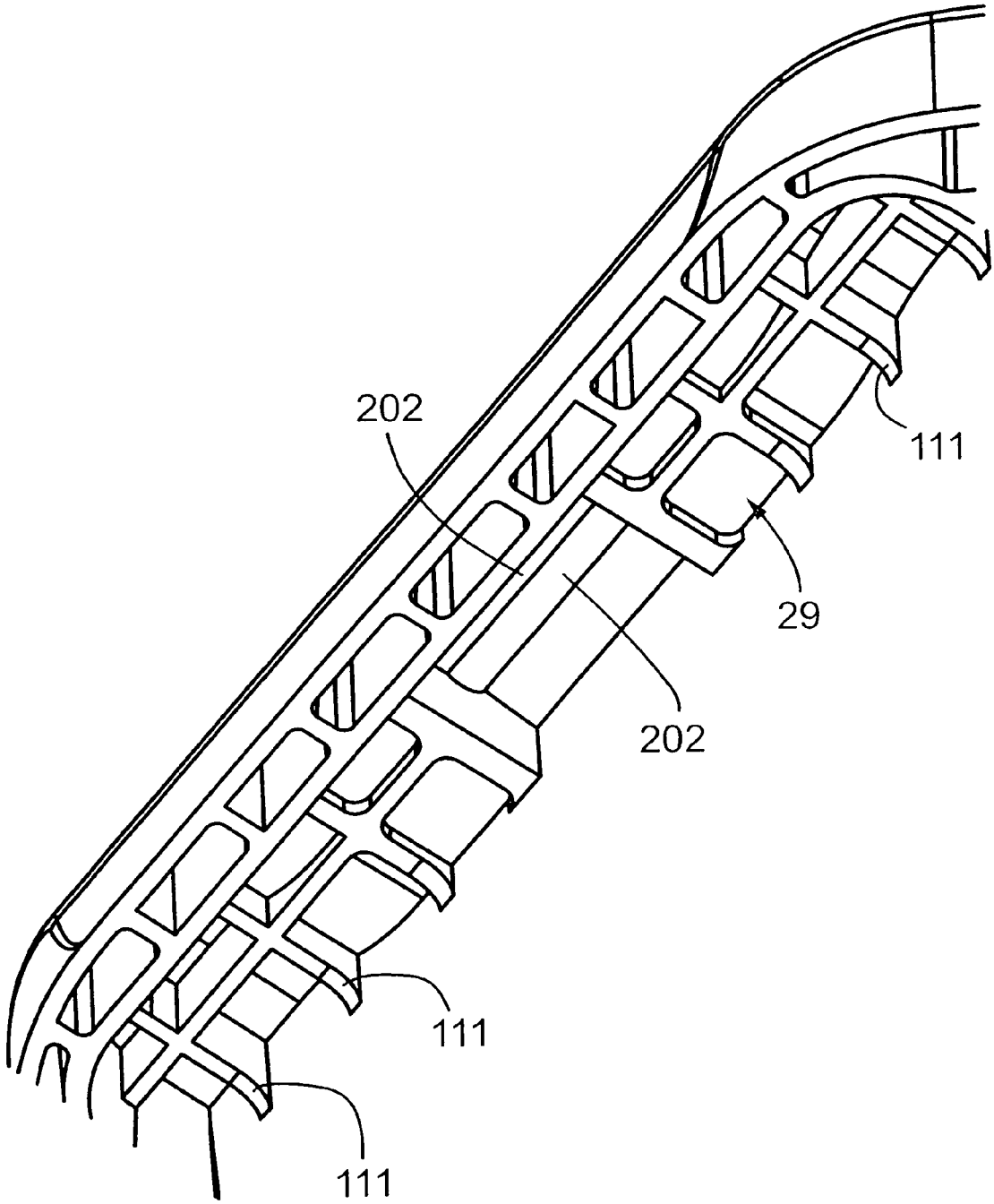
FIG. 56 is a bottom perspective view of a front detail of the bin of the container in FIG. 35, taken from the front.
Figure 57:
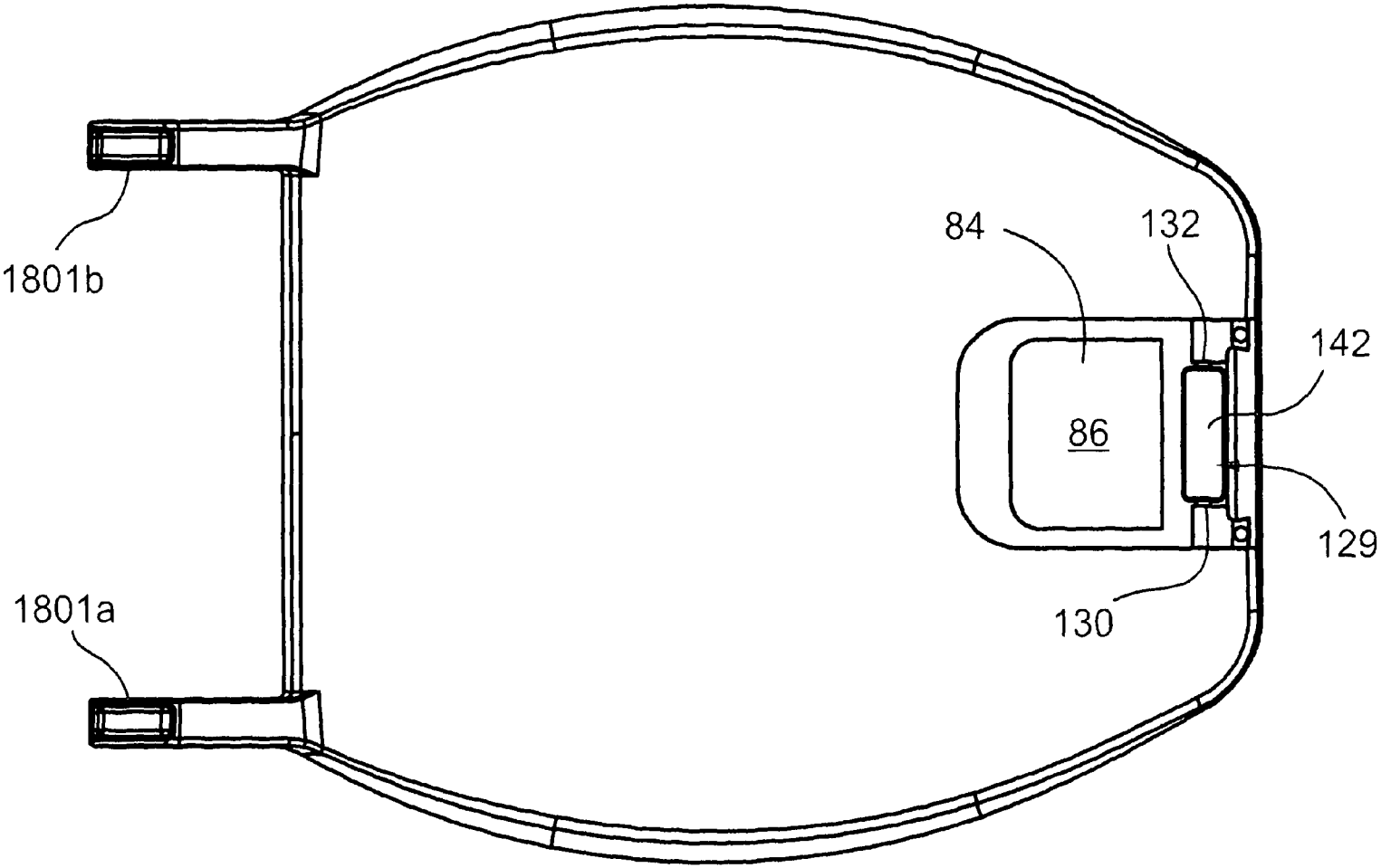
FIG. 57 is a top plan view of a lid of the container in FIG. 35.

Referring to FIGS. 18, 20, and 21 for the first embodiment and FIGS. 52, 54, and 55 for the third embodiment, the bin 16 defines the cavity 20. The bin 16 includes the lip 74 and the rim 28. The lip 74 defines an opening to the cavity 20. The rim 28 extends peripherally about the lip 74. The rim 28 includes a skirt seating surface 30 and one or more impact pad seating surfaces. For example, the impact pad seating surface is a impact pad receiving well.

The lid 18 is rotatably coupled to the bin 16. The lid 18 is configured for movement, relative to the bin 16, between an open position providing access to the cavity 20, and a closed position inhibiting access to the cavity 20. Referring to FIGS. 24 and 28 for the first embodiment and FIGS. 48 and 62 for the third embodiment, the lid 18 includes the skirt 88 and an impact pad assembly 116 including at least one impact pad (two impact pads 90, 92 are shown). The skirt 88 extends peripherally of and downwardly from the lid 18 and includes a skirt contact surface 122 configured to be seated upon the skirt seating surface 30. Each one of the impact pads 90, 92 includes a respective one of the contact surfaces 124, 125, and each one of the contact surfaces 124, 125 is configured to be seated upon a respective one of two impact pad seating surfaces 94, 96 (in the illustrated embodiment, a respective one of impact pad wells 98, 100 is provided for each one of the pads 90, 92). The skirt contact surface 122 includes a respective surface area. As well, each one of the contact surfaces 124, 125 includes a respective surface area to define two surface areas (in this case, two surface areas). The sum of the two surface areas defines an operative impact surface area. The ratio of tile operative impact surface area to the surface area of contact surface 122 of the skirt 88 is at least 0.1 . For example, this ratio is 0.2.

Figure 30:
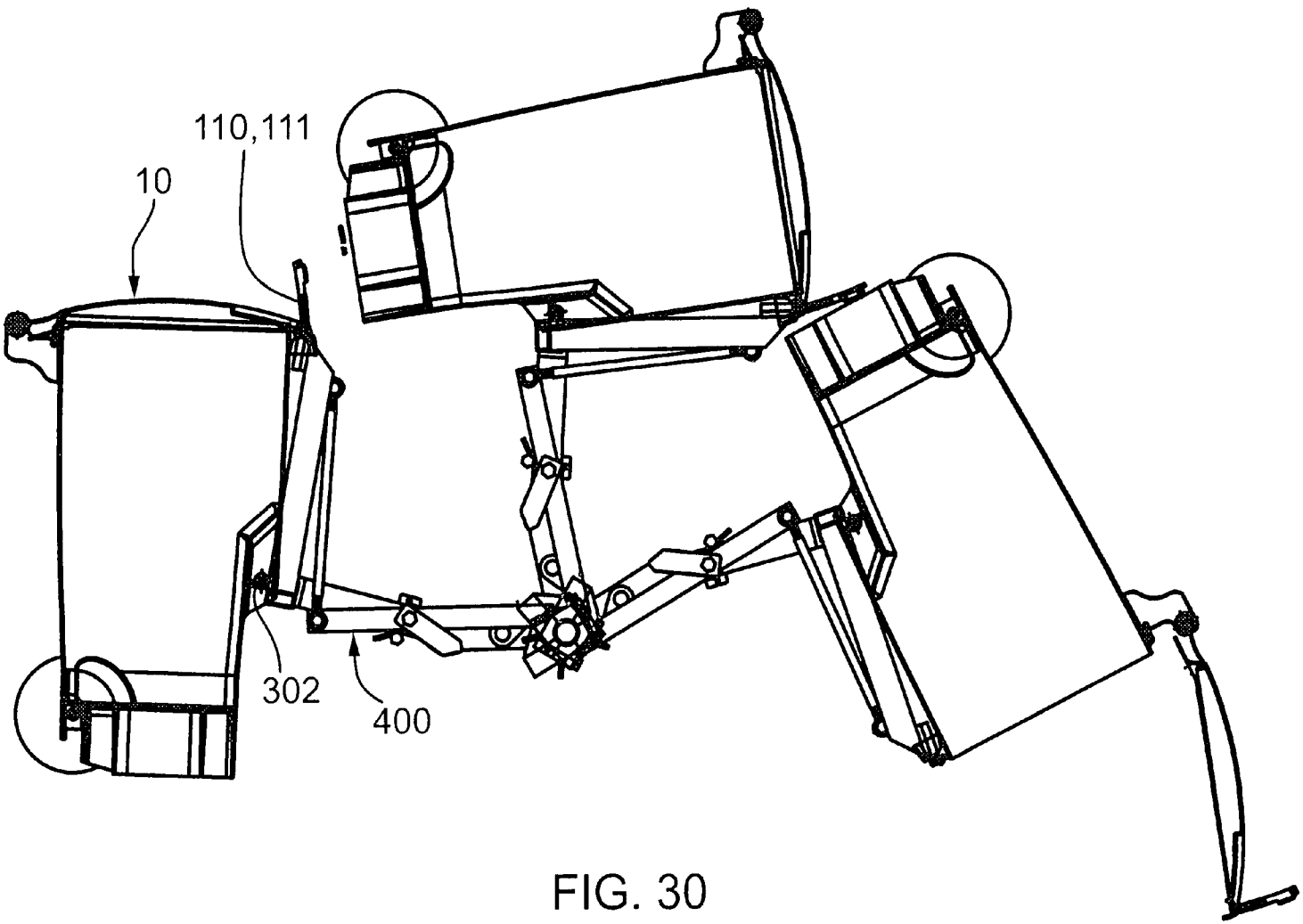
FIG. 30 is a schematic illustration of the stages of lifting and moving of the refuse container by a lifting mechanism engagement system.
Figure 31:
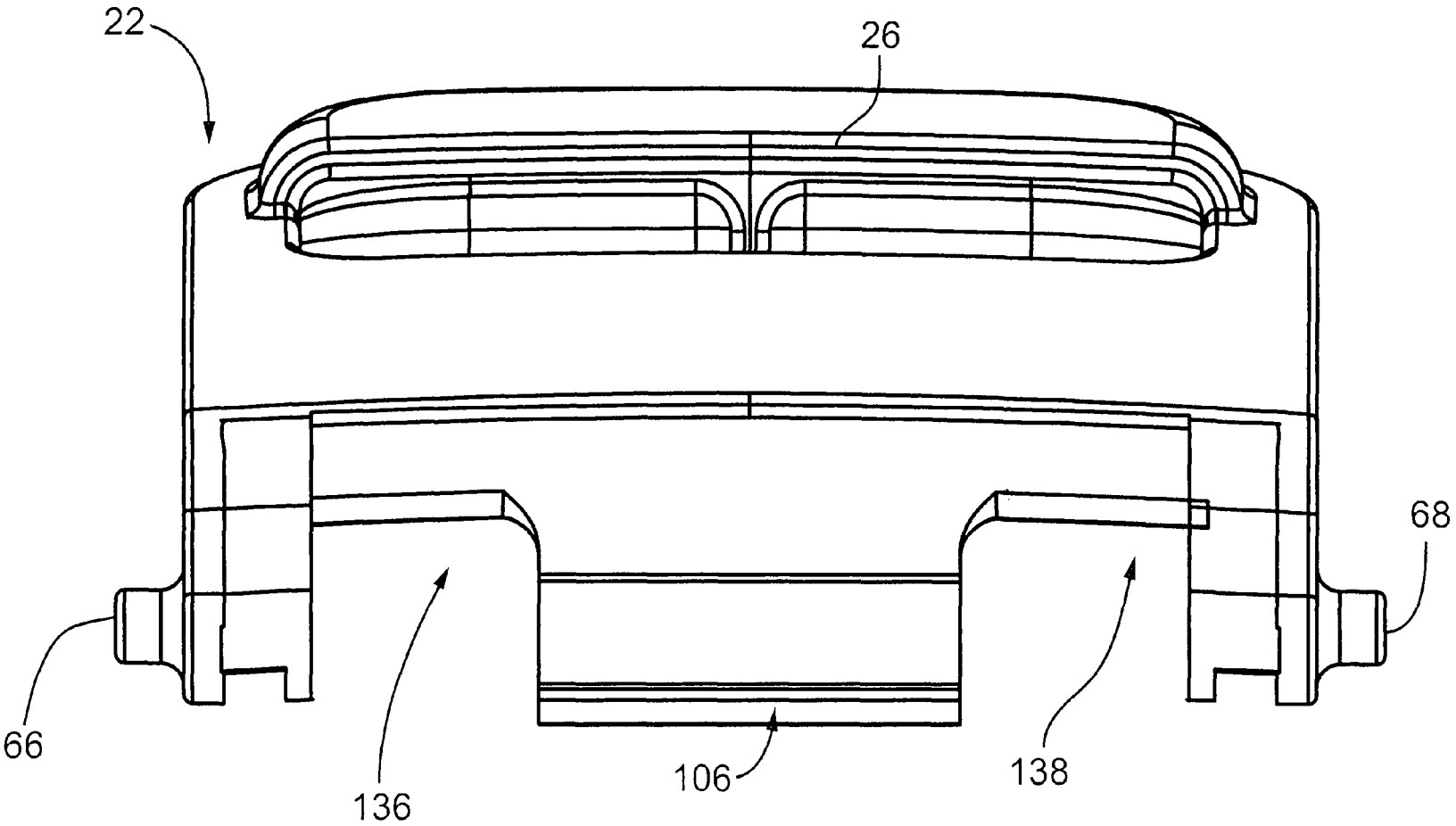
FIG. 31 is a front plan view of the latch of the refuse container of FIG. 1.
Figure 53:
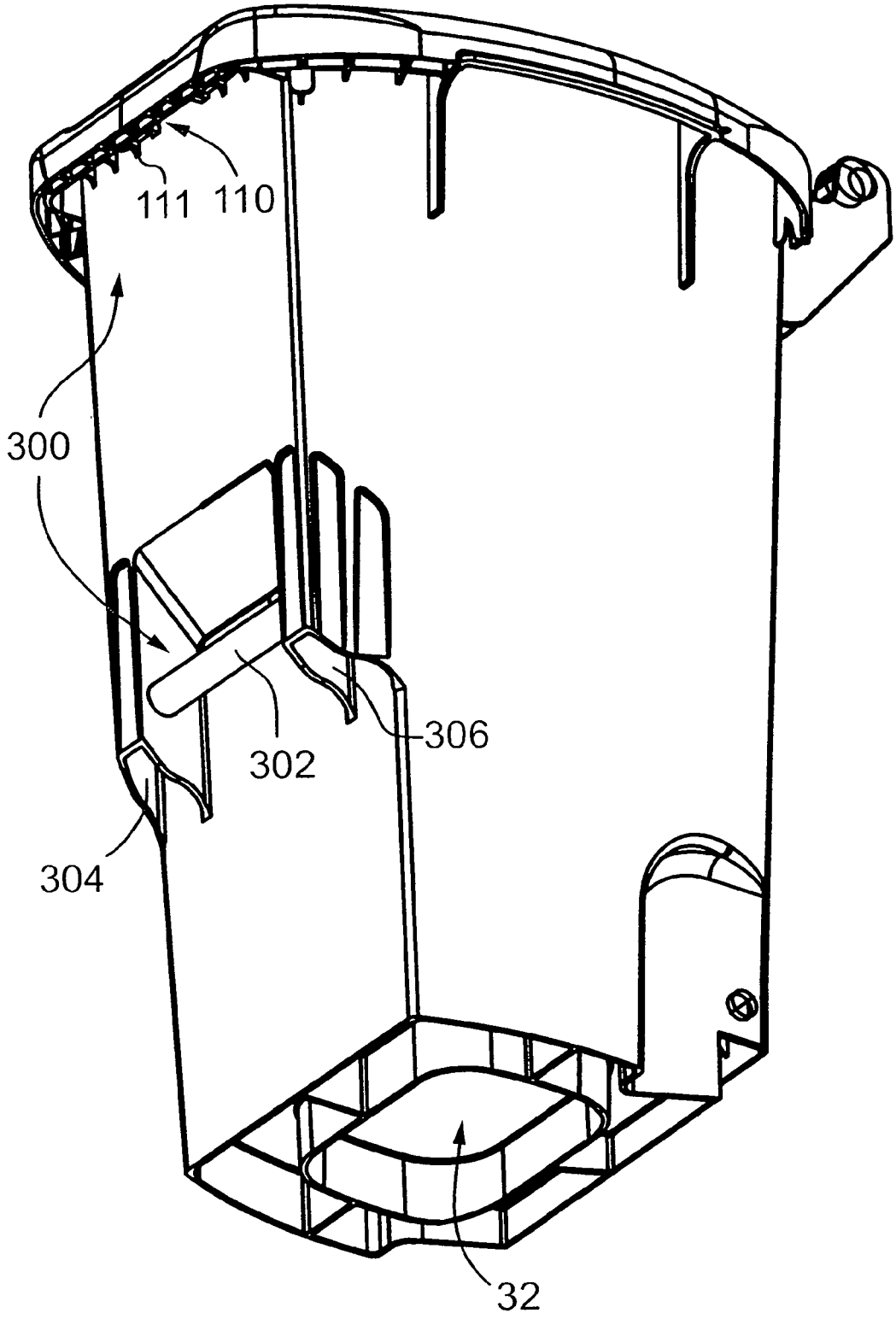
FIG. 53 is a bottom perspective view of the bin of the container in FIG. 35, taken from the front.
Figure 64:
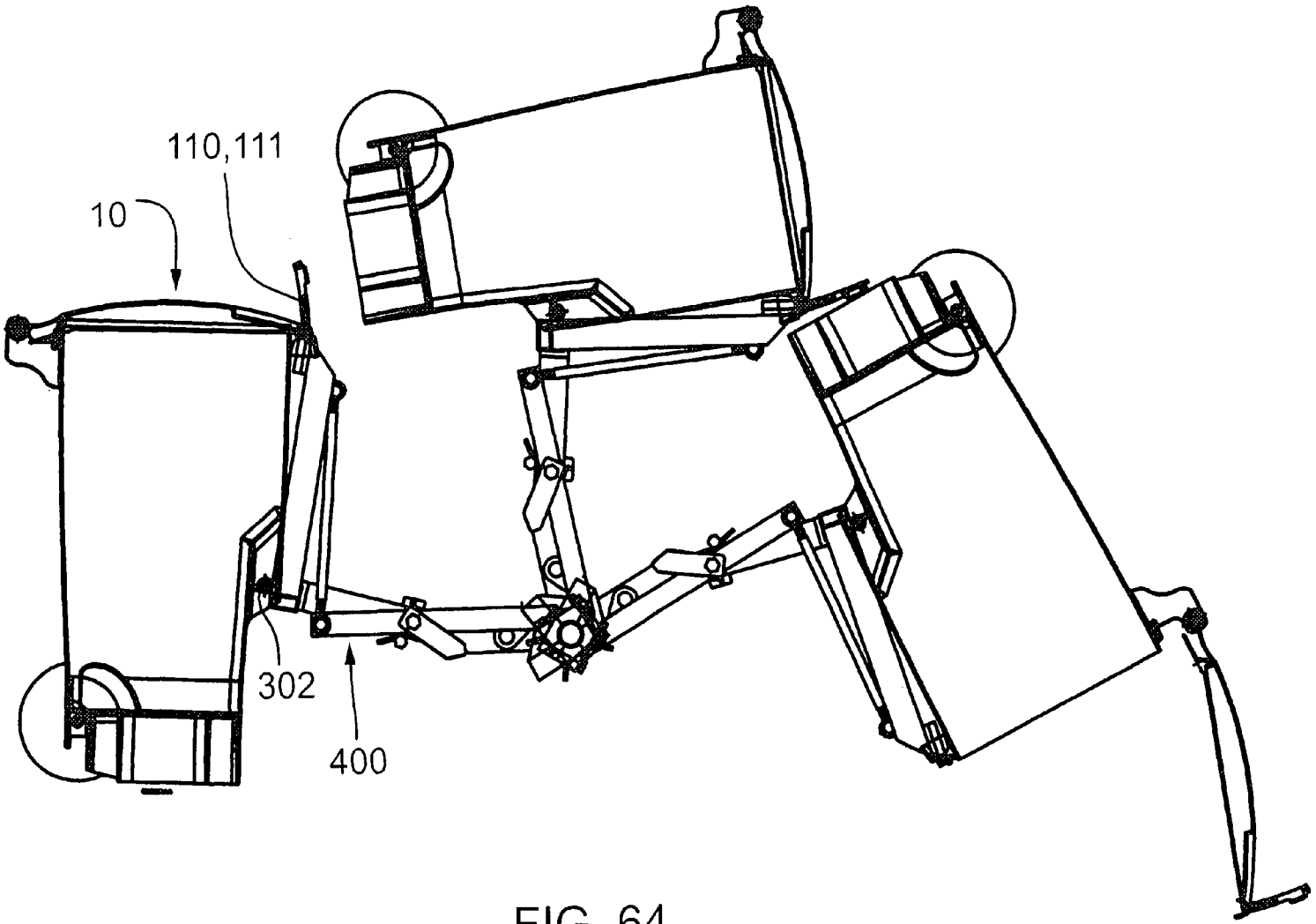
FIG. 64 is a schematic illustration of the stages of lifting and moving of the refuse container in FIG. 35 by a lifting mechanism engagement system.
Figure 65:
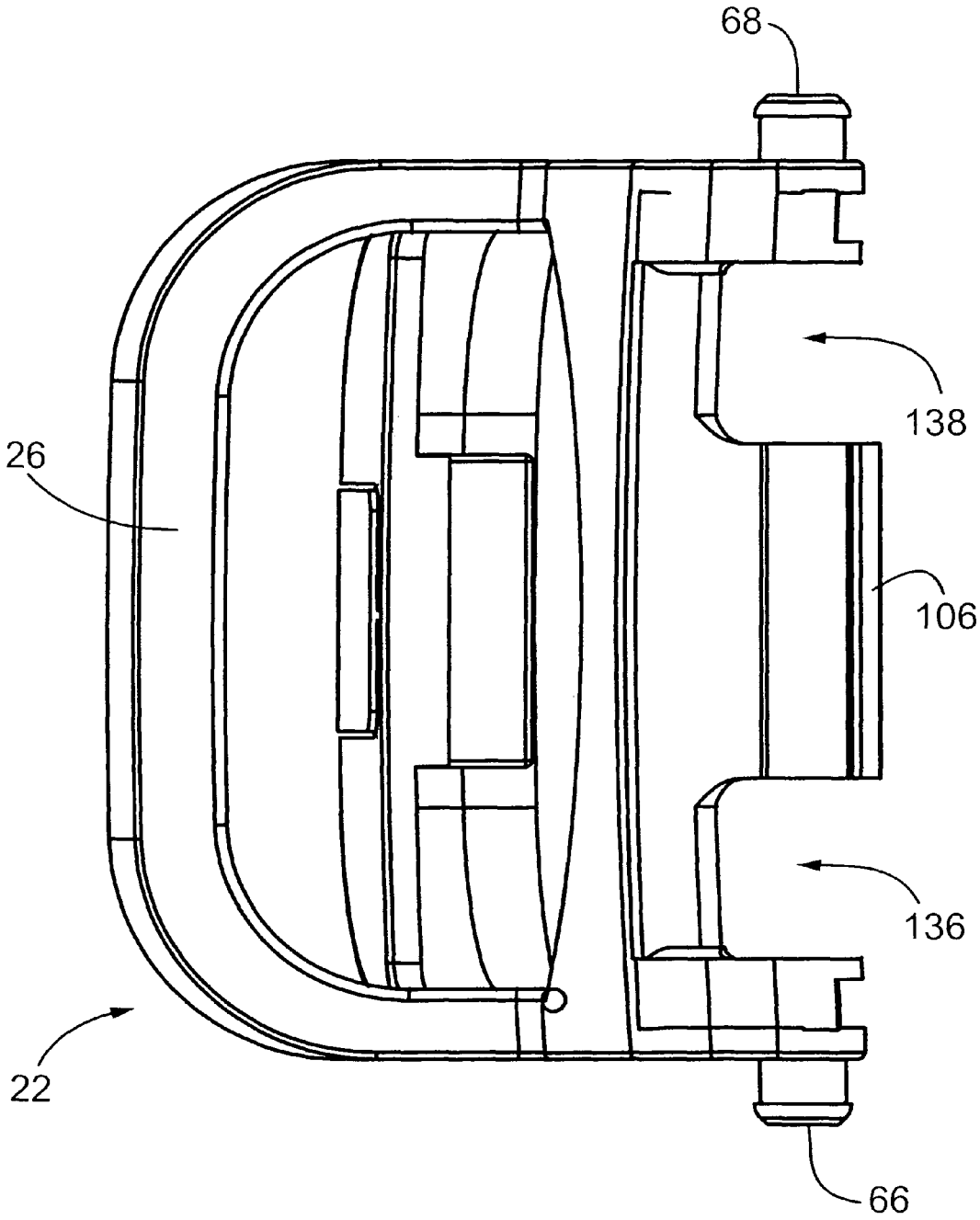
FIG. 65 is a front plan view of the latch of the refuse container of FIG. 35.

(J) Refuse Container with Lifting Mechanism Engagement System Including Retention Bar In another aspect and referring particularly to FIGS. 19 and 30 for the first embodiment and FIGS. 53 and 64 for the third embodiment, there is provided a refuse container 10 including a lifting mechanism engagement system 300 for engaging a lifting mechanism 400.

In this respect, there is provided the refuse container 10 including the bin 16 and the lid 18. The bin 16 defines the cavity 20. For example, the lid 18 is rotatably coupled to the bin 16. The lid 18 is configured for movement, relative to the bin 16, between an open position providing access to the cavity 20, and a closed position inhibiting access to the cavity 20.

The refuse container 10 includes a lifting mechanism engagement system 300. The lifting mechanism engagement system 300 includes a retention bar 302. The retention bar 302 is coupled to the sidewall 34 and is disposed externally of the cavity 20. For example, brackets 304, 306 are mounted to external surface 42 of the sidewall 34. Each one of the brackets 304, 306 includes a respective aperture for receiving a respective end of the retention bar 302. For example, the retention bar 302 is snap-fitted within the apertures. The retention bar 302 is configured to be hooked bad the lifting mechanism 400.

For example, the lifting mechanism engagement system 300 includes the ribs 111 of the impact guard 110 which is configured to engage and become supported by the lifting mechanism 400.

(K) Refuse Container with Bag Hook

Figure 66:
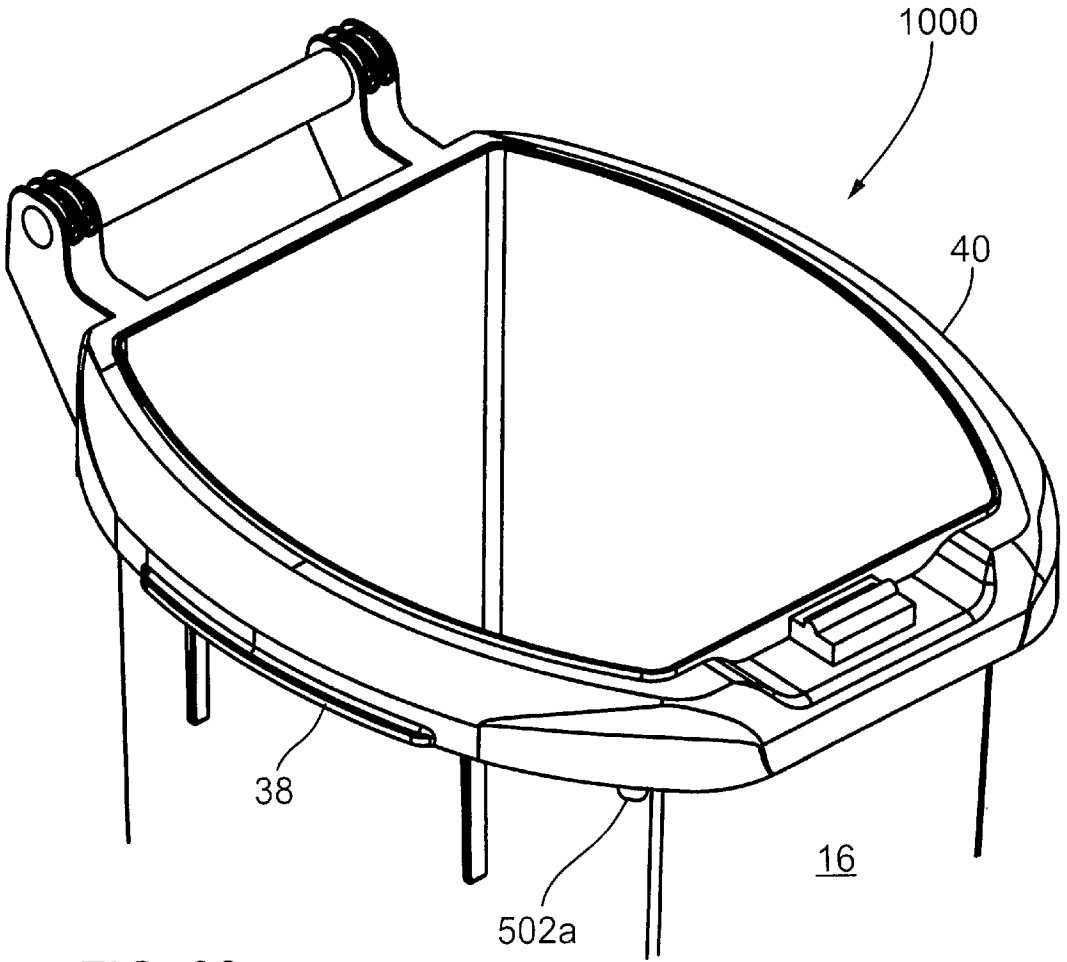
FIG. 66 is a top perspective view of one side of the refuse container, taken from the front.
Figure 67:
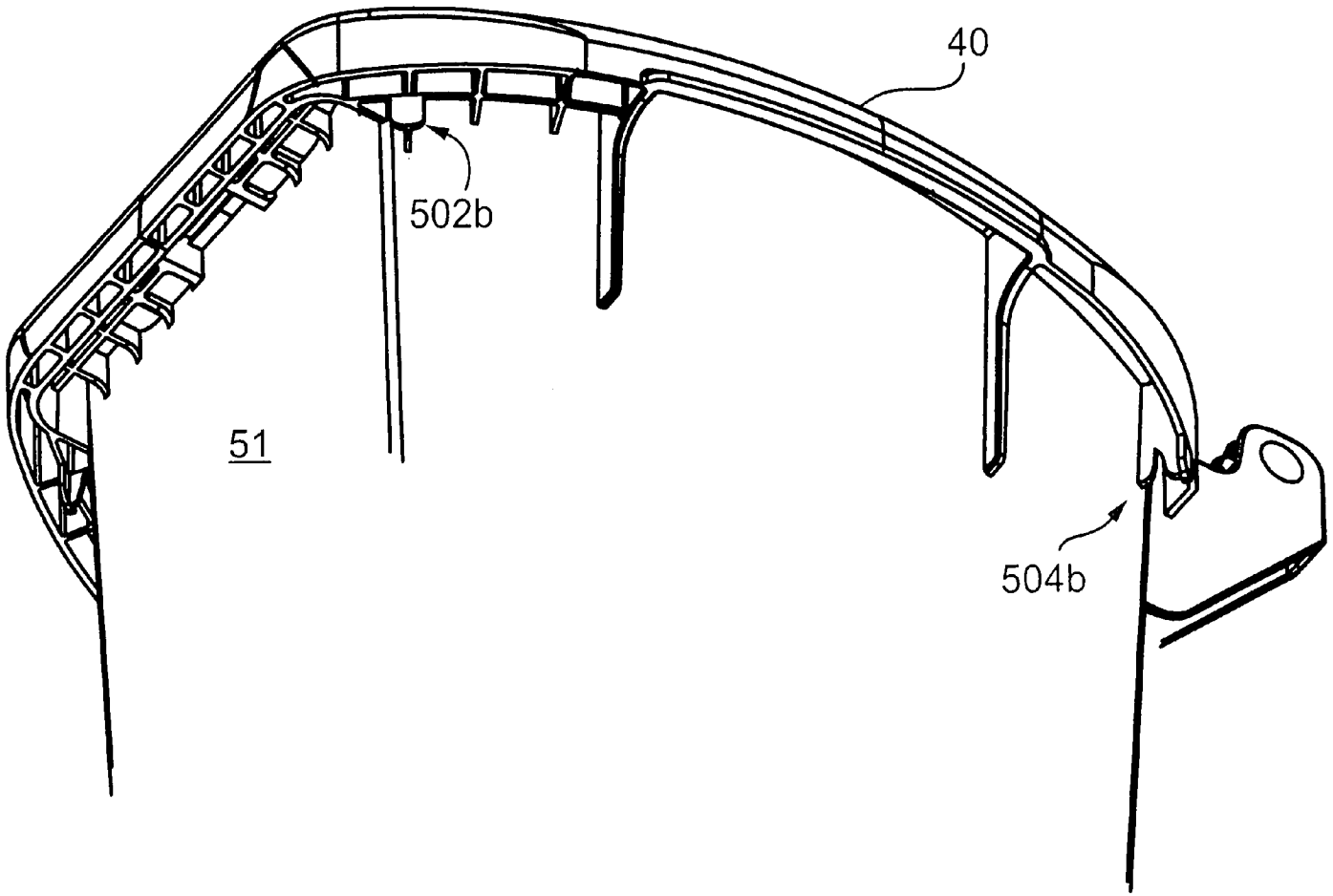
FIG. 67 is a bottom perspective view of the other side of the refuse container of FIG. 35, taken from the front.
Figure 68:
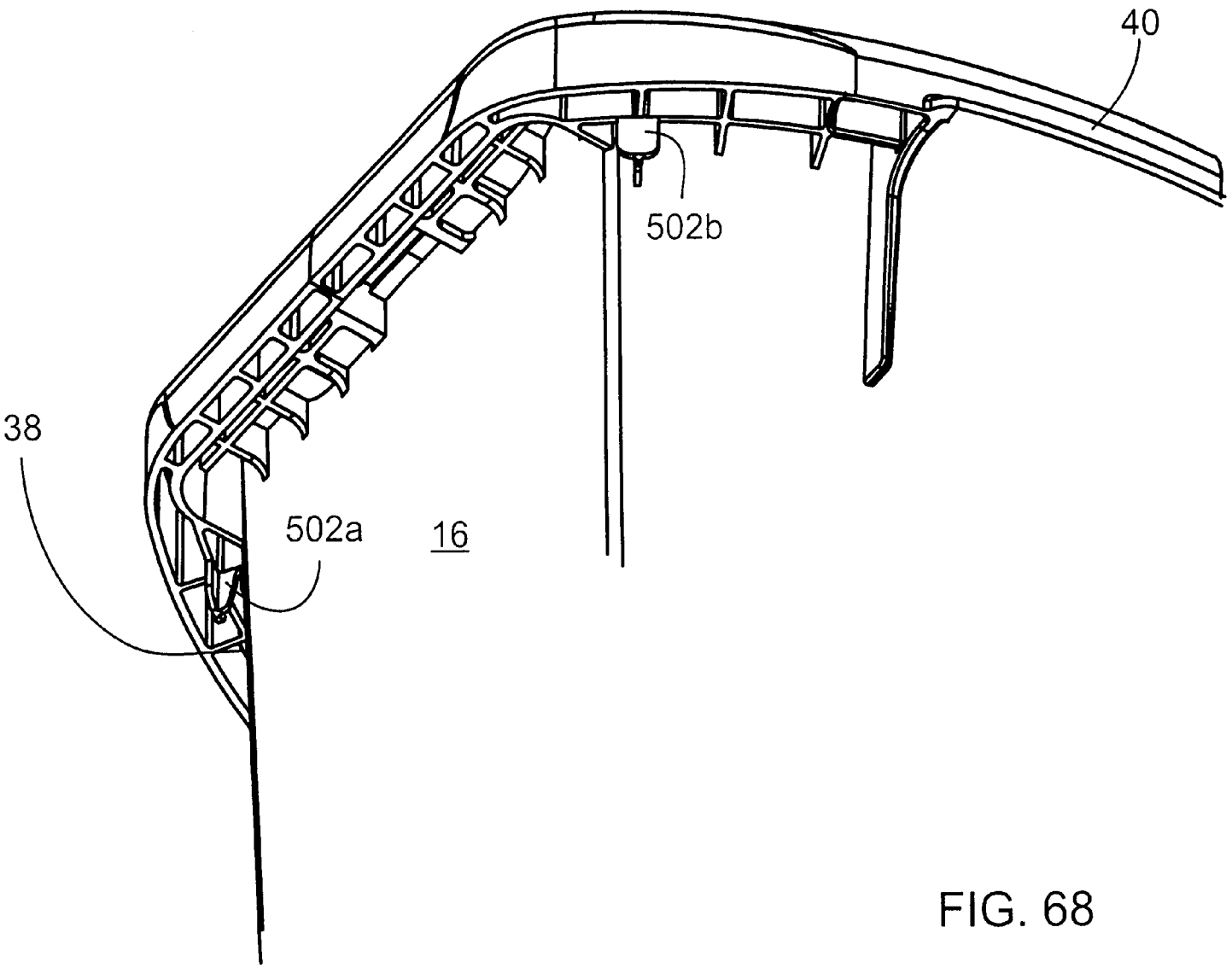
FIG. 68 is a bottom perspective view of the refuse container of FIG. 35, taken from the front and from a perspective where the leading edges of each one of the sides of the container is visible.

In another aspect, and referring specifically to FIGS. 32, 33 and 34 for the first embodiment and FIGS. 66, 67, and 68 for the third embodiment, there is provided another embodiment of a refuse container 500, identical to the refuse container 10, with the exception that each side of refuse container 500 includes a respective one of two pairs of spaced-apart liner retainer or hooks 502*a*, 504*a* and 502*b*, 504*b* extending downwardly from the rile 28 of the bin 16. Each one of the spaced-apart liner retainers 502, 504 is provided and configured for supporting liners which are inserted within the cavity 20 to line the cavity 20 and function as a container liner for containing the refuse. For example, the liner is a plastic bag.

Each one of the liner retainers 502, 504 present an inverted "V" shaped shaped retainer surface configured for receiving and retaining a liner.

(L) Refuse Container Including Latch Locking Mechanism

Figure 69:
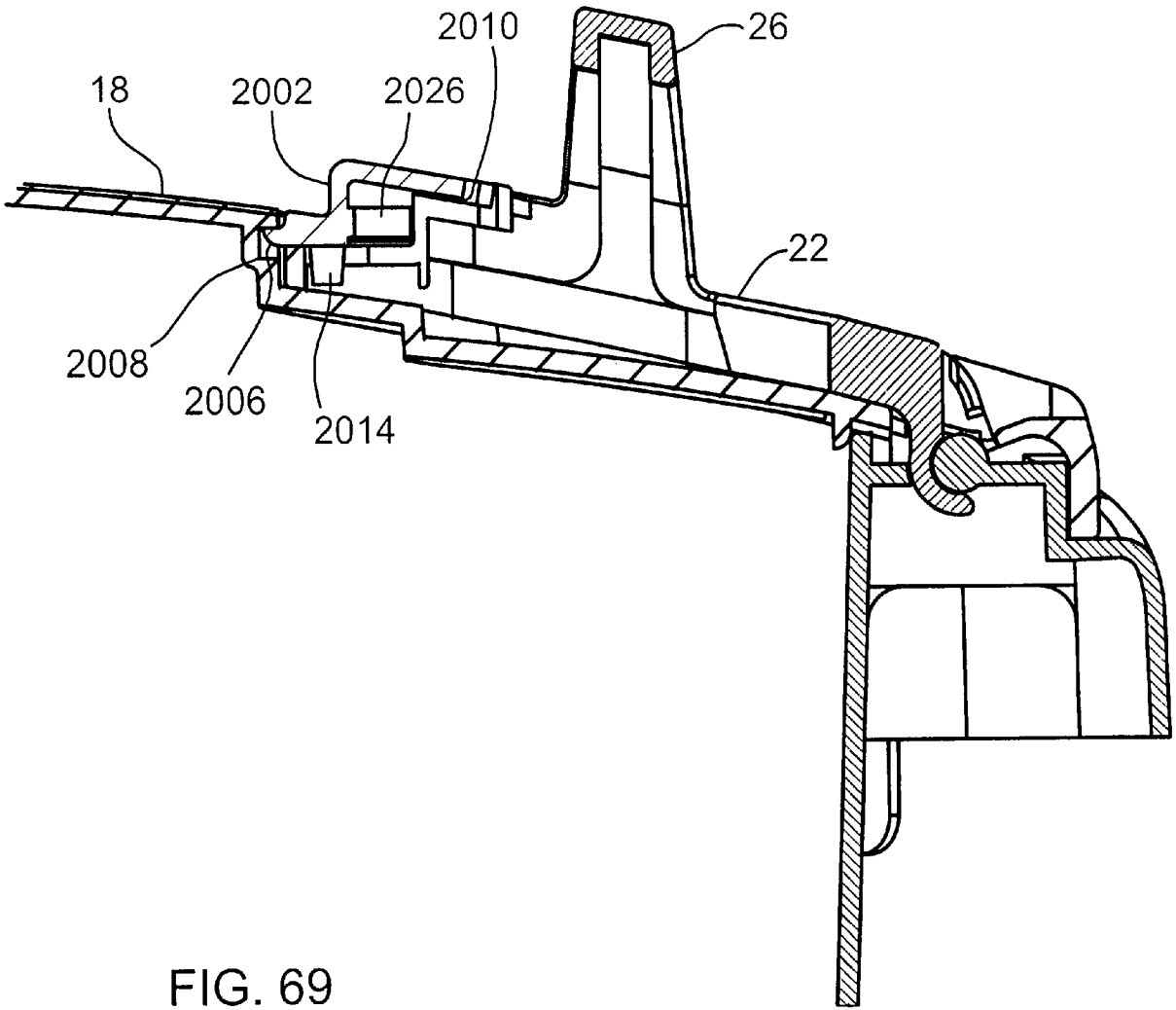
FIG. 69 is a sectional side elevation view of the container, taken along the lines A-A in FIG. 39, illustrating the latch in the locked lid position and the latch locking mechanism in the locked latch position.
Figure 70:
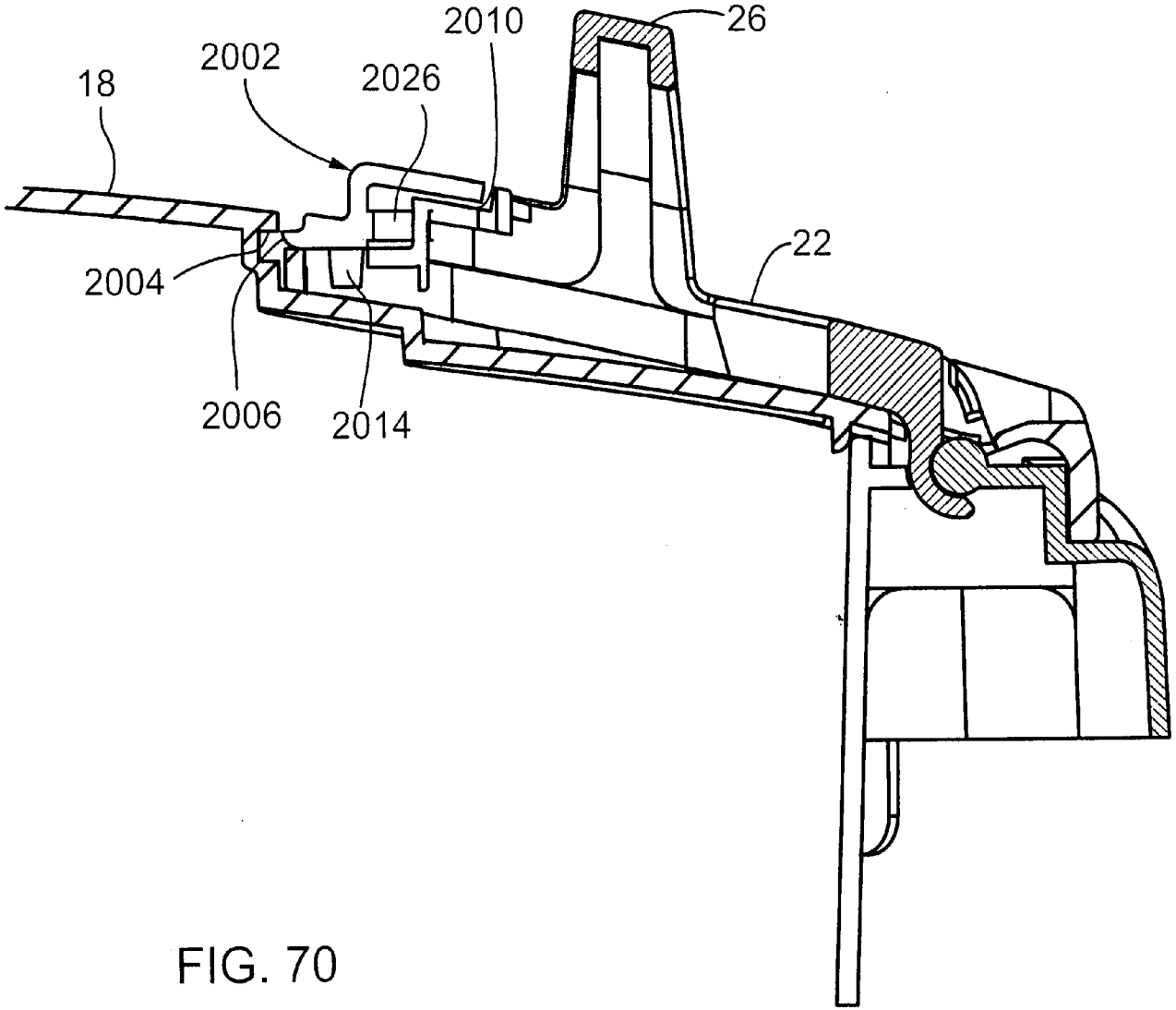
FIG. 70 is a sectional side elevation view of the container, taken along the lines A-A of FIG. 39, illustrating the latch in the locked lid position and the latch locking mechanism in the unlocked latch position.
Figure 71:
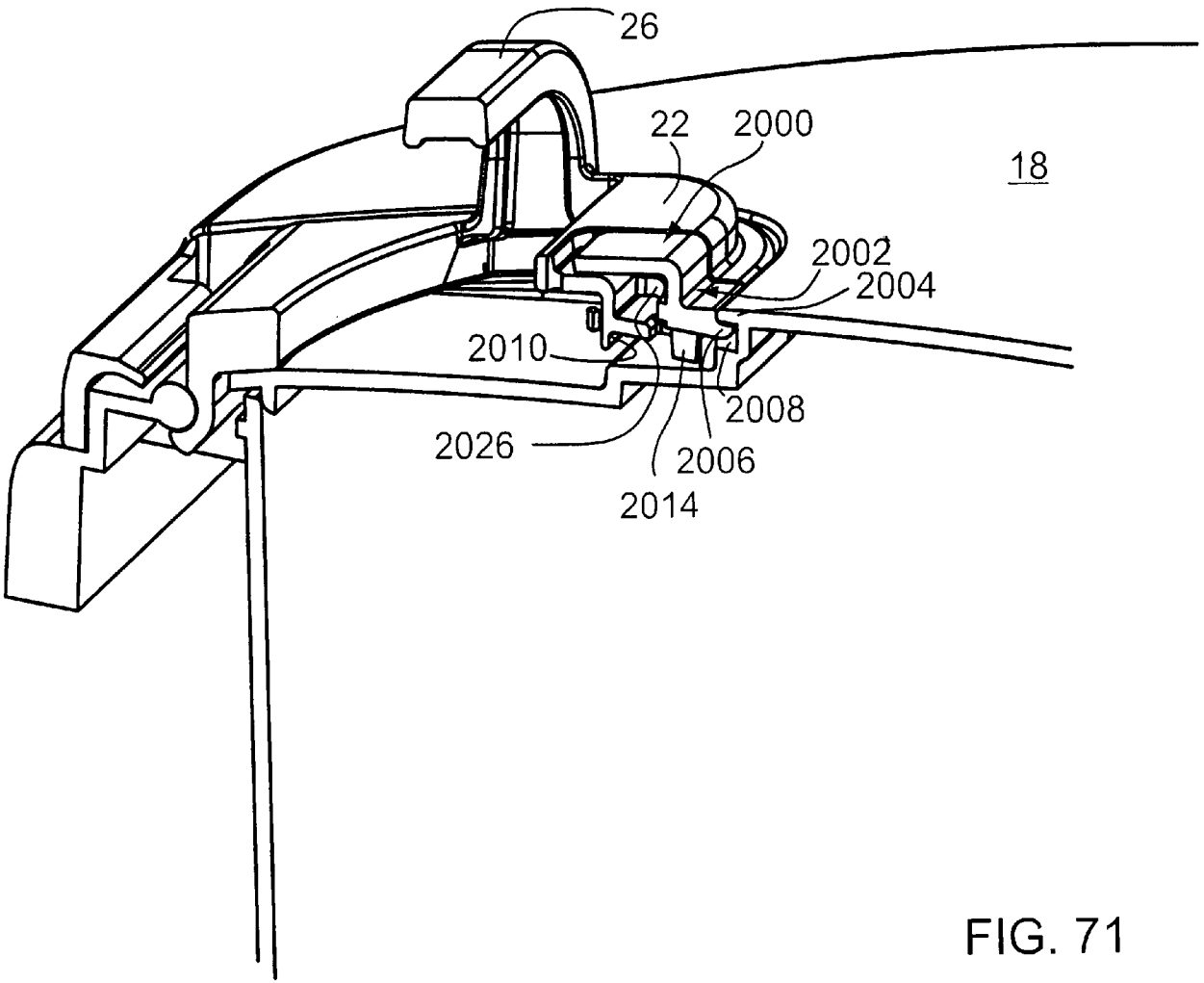
FIG. 71 is a sectional rear perspective view of the container, taken along the lines A-A in FIG. 39, illustrating the latch in the locked lid position and the latch locking mechanism in the locked latch position.

In a further aspect, and referring to the embodiment illustrated in FIGS. 35 to 77, the refuse container 10 is further provided with a latch locking mechanism 2000 (see FIGS. 73 to 76) configured to assume a locked latch position (see FIGS. 69 and 71) and an unlocked latch position (see FIG. 70). When disposed in the locked latch position, the latch locking mechanism 2000 acts between the latch 22 and the lid 18 to prevent the latch 22 from assuming an operative condition whereby the latch is capable of moving between the locked lid position and the unlocked lid position. When the latch locking mechanism 2000 is disposed in the unlocked latch position, the latch is disposed in the operative condition whereby the latch is capable of moving between the locked lid position and the unlocked lid position.

The latch locking mechanism 2000 is moveable from the locked latch position to the unlocked latch position in response to an application of an unlocking force, wherein the unlocking force includes a horizontal component directed towards the front of the bin 16.

For example, the unlocking force is applied by a human hand.

For example, the latch locking mechanism 2000 includes a force receiving surface 2002 for receiving application of the unlocking force.

For example, the lid 18 includes a lock retainer surface 2004 configured to limit or oppose upwardly movement of the latch locking mechanism 2000 relative to the lid 18 when the latch locking mechanism 2000 is disposed in the locked latch position. In this respect, when the latch locking mechanism 2000 is disposed in the locked latch position, upwardly movement of the latch locking mechanism 2000 relative to the lid 18 is limited or opposed by the lock retainer surface 2004 of the lid 18 such that the latch 22 is not able to assume the above-described operative condition. When the latch locking mechanism 2000 is disposed in the unlocked latch position, the latch locking mechanism 2000 is able to move upwardly relative to the lid 18 such that the latch 22 is disposed in the operative condition.

For example, the latch locking mechanism 2000 includes a lock projection 2006 configured to co-operate with the lock retainer surface 2004 to limit or oppose upwardly movement of the latch locking mechanism 2000 relative to the lid 18 when the latch locking mechanism 2000 is disposed in the locked latch position. When the latch locking mechanism 2000 is disposed in the locked latch position, the lock projection 2006 is disposed relative to the lock retainer surface 2004 such that the lock retainer surface 2004 limits or opposes upwardly movement of the lock projection 2006 relative to the lid 18 such that the latch 22 is not able to assume the operative condition. When the latch locking mechanism 2000 is disposed in the unlocked latch position, the lock projection 2006 is retracted from the lock retainer surface 2004 such that the lock retainer surface 2004 is not able to limit or oppose upwardly movement of the lock projection 2006 relative to the lid 18, and the lock projection 2000 is, therefore, able to move upwardly relative to the lid 18 such that the latch 22 is disposed in the operative condition.

For example, the lid 18 includes a receiving notch 2008 for receiving latch locking mechanism 2000. The lock projection 2006 is configured to co-operate with the receiving notch 2008 to limit or oppose upwardly movement of the latch locking mechanism 2000 relative to the lid 18 when the latch locking mechanism 2000 is disposed in the locked latch position. When the latch locking mechanism 2000 is disposed in the locked latch position, the lock projection 2006 is disposed within the receiving notch 2008, and upwardly movement of the lock projection relative 2006 to the lid 18 is limited or opposed by the receiving notch 2008 such that the latch 22 is not able to assume the operative condition. When the latch locking mechanism 2000 is disposed in the unlocked latch position, the lock projection 2006 is retracted from the receiving notch 2008 such that the lock projection 2006 is able to move upwardly relative to the lid 18 such that the latch 22 is disposed in the operative condition.

For example, the latch locking mechanism 2000 is coupled to and moveable relative to the latch 22 for movement relative to the latch 22 between the locked latch position and the unlocked latch position. As a further example, the latch locking mechanism 2000 is slideably coupled to the latch 22 for movement relative to the latch 22 between the locked latch position and the unlocked latch position For example, the latch locking mechanism 2000 is supported by the latch 22. For example, the latch 22 includes a latch support surface 2010 for supporting the latch locking mechanism 2000.

Figure 72A:
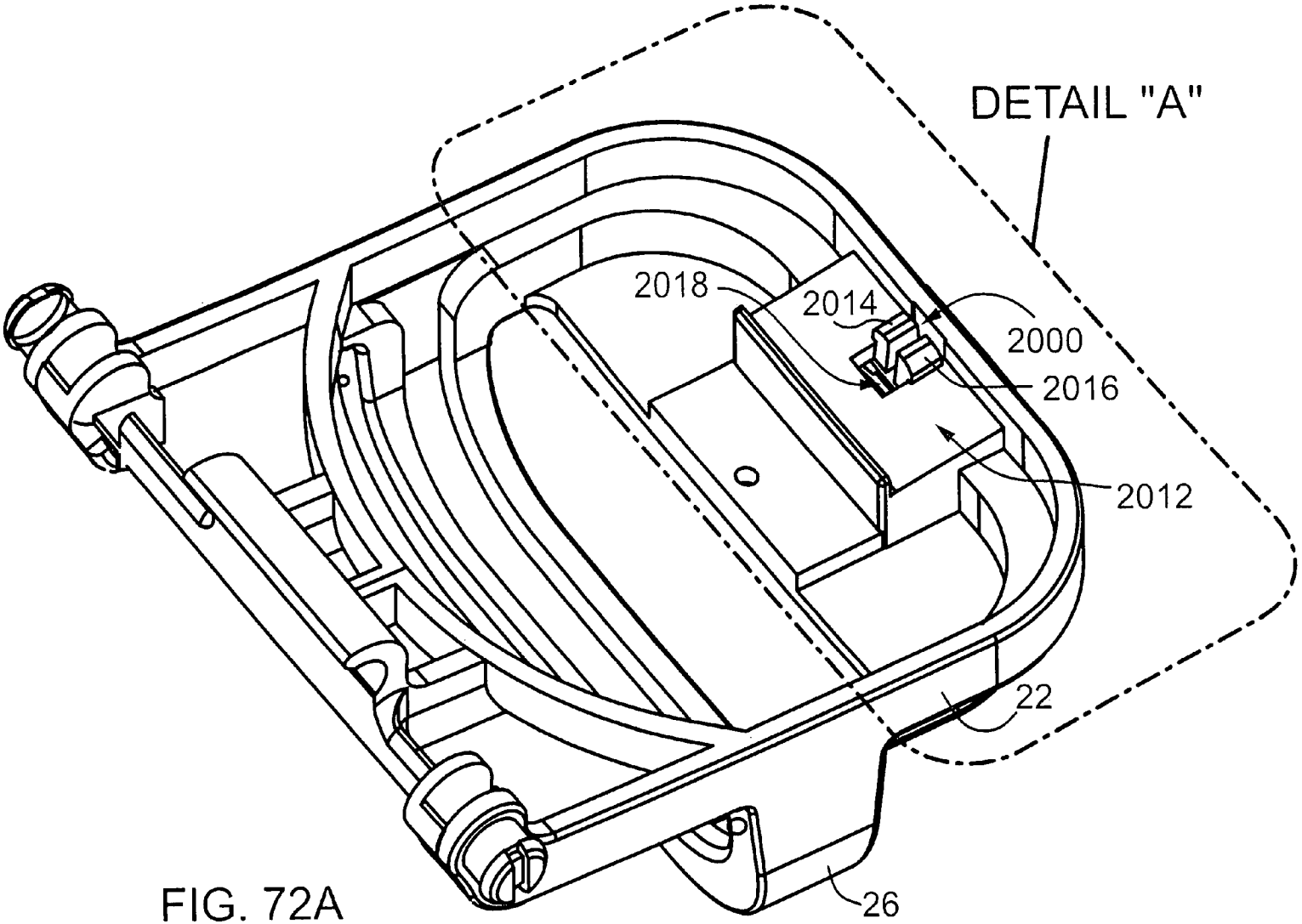
FIG. 72A is another bottom perspective view of the latch and the latch locking mechanism of the container in FIG. 35.
Figure 72B:
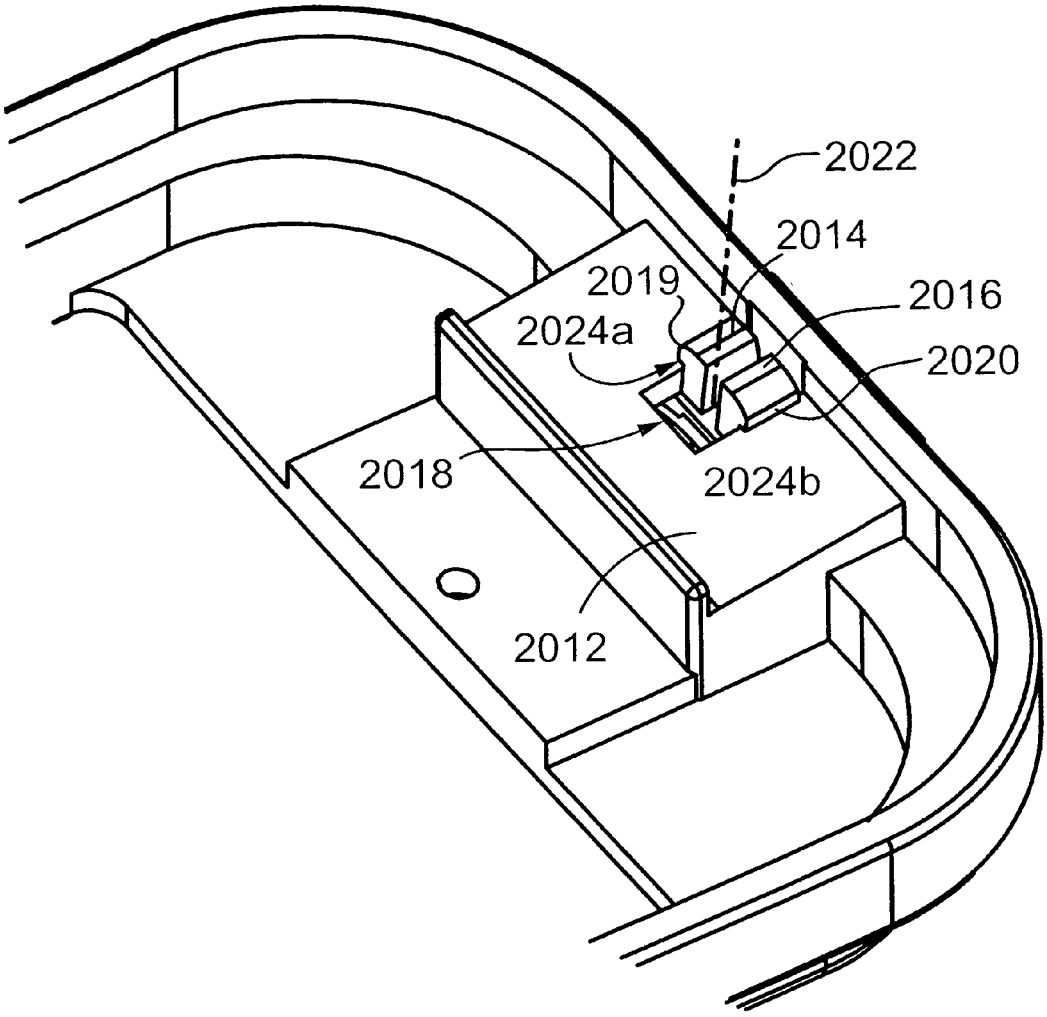
FIG. 72B is an enlarged view of Detail "A" of FIG. 72A.
Figure 73:
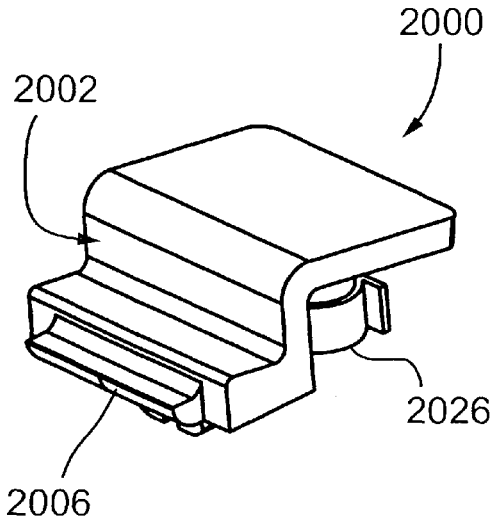
FIG. 73 is a front perspective view of the latch locking mechanism.
Figure 74:
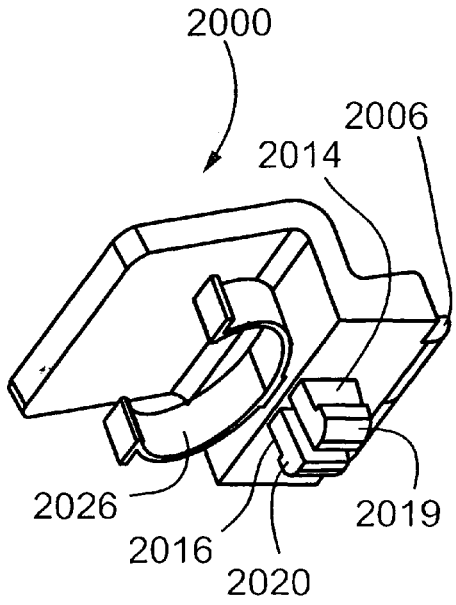
FIG. 74 is a first rear perspective view of the latch locking mechanism.
Figure 75:
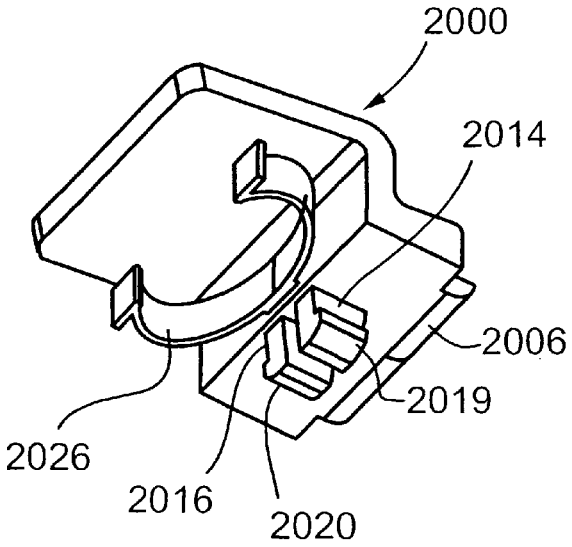
FIG. 75 is a second rear perspective view of the latch locking mechanism.
Figure 76:
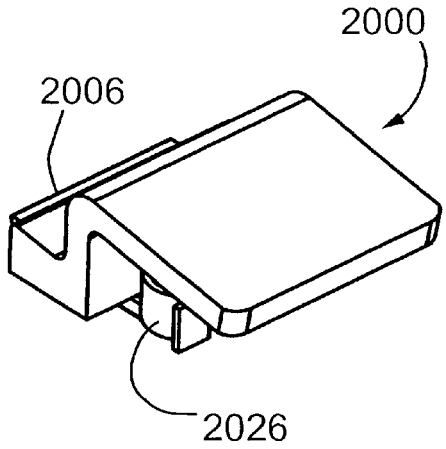
FIG. 76 is a top perspective view of the latch locking mechanism.
Figure 77:
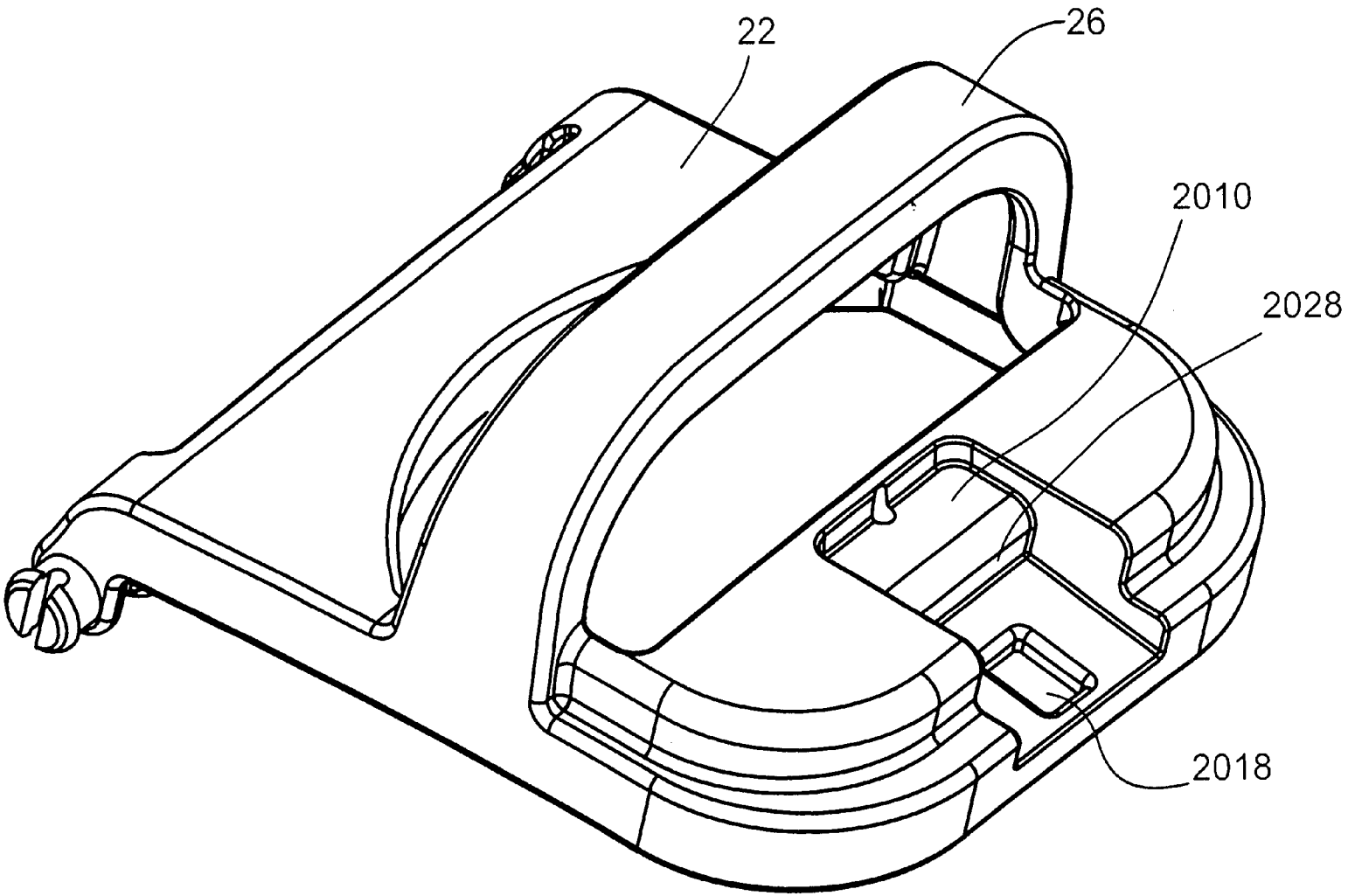
FIG. 77 is a top perspective view of the latch with the latch locking mechanism removed for clarity.

Referring to FIGS. 50, 72A, and 72B, for example, the latch 22 includes a retainer surface 2012, and the latch locking mechanism 2000 includes retainer tabs 2014, 2016, and the retainer surface 2012 co-operates with the retainer tabs 2014, 2106 for retaining the latch locking mechanism 2000 in a coupled relationship with the latch 22.

For example, the latch locking mechanism 2000 is supported by the latch support surface 2010 and includes the retainer tabs 2014, 2016, and the latch 22 includes a latch locking mechanism receiving slot 2018. In this respect, the retainer tabs 2014, 2016 extend through the receiving slot 2018 and the latch 22 co-operates with the retainer tabs 2014, 2016 such that the retainer surface 2012 opposes upwardly movement of the retainer tabs 2014, 2016 relative to the latch 22, and thereby opposes upwardly movement of the latch locking mechanism 2000 relative to the latch 22, and thereby retains the latch locking mechanism 2000 in a coupled relationship with the latch 22. For example, the slot 2018 also functions as guide for facilitating guided movement of the latch locking mechanism between the locked position and the unlocked position.

For example, the retainer tabs 2014, 2016 are a pair of spaced apart retainer tabs 2014, 2016 extending through the slot 2018 (see FIG. 77), and each one of the retainer tabs 2014, 2016 including a respective one of tab projections 2019, 2020 extending orthogonally relative to the axis 2022 of the slot 2019 and being disposed in opposition to the retainer surface 2012 provided on a lower surface 2024 of the latch 22, one tab projection 2019 being opposed by a retainer surface 2012*a* provided on a lower surface portion 2024*a* extending from a side of the slot 2019 opposite to that of a side from which a lower surface portion 2024*b* extends and provides a retainer surface 2012*b* for opposing the other tab projection 2020.

For example, the retainer tabs 2014, 2016 are sufficiently resilient such that, during assembly, the retainer tabs 2014, 2016 are pressed through the slot 2018, causing the retainer tabs 2014, 2016 to approach one another (or, become squeezed together) so as to enable the retainer tabs 2014, 2016 to become fitted through the slot 2018. Once fitted through the slot 2018, the resiliency of the retainer tabs 2014, 2016 forces the retainer tabs 2014, 2016 to move apart relative to one another such that the tab projections 2019, 2020 become disposed in opposition to a respective one of the lower surface portions 2024*a*, 2024*b*.

For example, a biasing element 2026 is provided for acting between latch locking mechanism 2000 and tile latch 22 for biasing the latch locking mechanism 2000 towards the locked latch position. For example, the biasing element 2026 is attached to the latch locking mechanism 2000. As a further example, the biasing element 2006 is a thin sheet of arcuate-shaped material, such as a sheet of arcuate-shaped nylon material having a thickness of about $^{60}/_{1000}$ of an inch. As a further example, the latch 22 includes a biasing element retainer surface 2028 for exerting a reaction force to oppose force being applied to the biasing element 2026 in a direction which effects movement of the latch locking mechanism 2000 from the locked latch position. When the latch 22 is disposed in the locked lid position and is seated within the cavity 84, and no unlocking force is being applied to the latch locking mechanism 2000, the biasing element 2026 biases the latch locking mechanism 2000 into the locked latch position.

Although the disclosure describes and illustrates various embodiments of the invention, it is to be understood that the invention is not limited to these particular embodiments. Many variations and modifications will now occur to those skilled in the art of headwear. For full definition of the scope of the invention, reference is to be made to the appended claims.

The invention claimed is:

1. A refuse container comprising:

a container assembly comprising:

a bin defining a cavity; and a lid rotatably coupled to the bin, and rotatable in a first direction relative to the bin to effect an open position providing access to the cavity, and rotatable in a second direction to effect a closed position inhibiting access to the cavity; and a locking mechanism including:

a latch pivotally attached to the lid and comprising a handle, and rotatable in the first direction to effect a locked lid position and rotatable in the second direction to effect unlocked lid position;

a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position;

wherein the latch is configured to move from the locked position to the unlocked lid position in response to application of an unlocking force to the handle;

and wherein, when the latch is disposed in the unlocked lid position and the lid is disposed in the closed position, the lid is configured to move from the closed position to the open position in response to an application of a lid-opening force to the handle;

and wherein the unlocking force includes a horizontal component and a vertical component, and wherein the lid-opening force includes a horizontal component and a vertical component, and wherein a direction of the horizontal component of the lid-opening force is substantially opposite to the direction of the horizontal component of the unlocking force.

2. A refuse container comprising:

a container assembly including:

a bin defining a cavity; and a lid rotatably coupled to the bin, and configured for movement, relative to the bin, between an open position providing access to the cavity and a closed position inhibiting access to the cavity; and a locking mechanism including:

a latch including a handle, and moveable between a locked lid position and an unlocked lid position;

a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position;

wherein the latch is configured to move from the locked position to the unlocked lid position in response to application of an unlocking force to the handle;

and wherein, when the latch is disposed in the unlocked lid position and the lid is disposed in the closed position, the lid is configured to move from the closed position to the open position in response to an application of a lid-opening force to the handle;

and wherein the unlocking force effects rotation of the latch in one of a clockwise or counterclockwise direction, and wherein the lid-opening force effects rotation of the latch in the other one of a clockwise or a counterclockwise direction relative to a same frame of reference as a direction of the unlocking force.

3. A refuse container comprising:

a container assembly including:

a bin defining a cavity; and a lid rotatably coupled to the bin, and configured for movement, relative to the bin, between an open position providing access to the cavity, and a closed position inhibiting access to the cavity; and a locking mechanism including:

a latch comprising a handle, and moveable between a locked lid position and an unlocked lid position;

a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position;

wherein the latch is configured to move from the locked position to the unlocked lid position in response to application of an unlocking force to the handle;

and wherein, when the latch is disposed in the unlocked lid position and the lid is disposed in the closed position, the lid is configured to move from the closed position to the open position in response to an application of a lid-opening force to the handle;

and wherein, in moving from the locked lid position to the unlocked lid position, the latch rotates, relative to the container assembly, about a latch rotation axis, wherein the latch rotation axis and a longitudinal axis of the detent are substantially co-located when the latch is in the locked lid position.

4. A refuse container comprising:

a container assembly including:

a bin defining a cavity, and including:

a lip defining an opening to the cavity; and a rim extending peripherally about the lip;

a lid rotatably coupled to the bin, and movable relative to the bin between an open position providing access to the cavity, and a closed position inhibiting access to the cavity; and a locking mechanism including:

a latch including a handle, and moveable between a locked lid position and an unlocked lid position;

a detent acting between the bin and the lid, and co-operating with the latch so as to effect locking of the lid to the bin when the latch is in the locked lid position, and permit movement of the lid, relative to the bin, from the closed position to the open position when the latch is in the unlocked lid position;

wherein the latch is configured to move from the locked position to the unlocked lid position in response to application of an unlocking force to the handle;

and wherein, when the latch is disposed in the unlocked lid position and the lid is disposed in the closed position, the lid is configured to move from the closed position to the open position in response to an application of a lid-opening force to the handle;

and wherein the detent extends upwardly from the rim and is disposed below the lip.

* * * * *